US009640357B2

(12) United States Patent
Hashimoto et al.

(10) Patent No.: US 9,640,357 B2
(45) Date of Patent: May 2, 2017

(54) ELECTRONIC DEVICE AND ELECTRONIC APPARATUS HAVING A FUSE THAT IS FRACTURED BY EXTERNAL FORCES

(71) Applicant: Sony Corporation, Tokyo (JP)

(72) Inventors: Mitsuo Hashimoto, Kanagawa (JP); Akira Akiba, Kanagawa (JP); Hideo Niikura, Tokyo (JP); Satoshi Mitani, Kanagawa (JP); Shinya Morita, Tokyo (JP); Kunihiko Saruta, Kanagawa (JP)

(73) Assignee: Sony Corporation, Tokyo (JP)

( * ) Notice: Subject to any disclaimer, the term of this patent is extended or adjusted under 35 U.S.C. 154(b) by 38 days.

(21) Appl. No.: 14/553,290

(22) Filed: Nov. 25, 2014

(65) Prior Publication Data

US 2015/0179371 A1 Jun. 25, 2015

(30) Foreign Application Priority Data

Dec. 25, 2013 (JP) ..... 2013-267429

(51) Int. Cl.

| | |
|---|---|
| ***H01H 57/00*** | (2006.01) |
| ***H01H 85/46*** | (2006.01) |
| *H01H 1/00* | (2006.01) |
| *H01H 85/02* | (2006.01) |

(52) U.S. Cl.

CPC ..... *H01H 85/463* (2013.01); *H01H 1/0036* (2013.01); *H01H 2001/0078* (2013.01); *H01H 2085/0275* (2013.01)

(58) Field of Classification Search

CPC ..... H01L 23/5256; H05K 2201/10181; H01H 85/0241; H01H 85/0275; H01H 85/0283; H01H 85/04

USPC ..... 200/181; 257/E23, 149, 209, 655; 337/416

See application file for complete search history.

(56) References Cited

U.S. PATENT DOCUMENTS 6,501,107 B1 * 12/2002 Sinclair ..... B81B 3/0086 257/208

FOREIGN PATENT DOCUMENTS

| | | |
|---|---|---|
| JP | 2005-260398 | 9/2005 |
| JP | 2006-514786 | 5/2006 |
| JP | 2006-221956 | 8/2006 |
| JP | 2009-032559 | 2/2009 |
| JP | 2012-222241 | 11/2012 |

* cited by examiner

*Primary Examiner* — Vanessa Girardi
(74) *Attorney, Agent, or Firm* — Michael Best & Friedrich LLP

(57) ABSTRACT

There is provided an electronic device including a first member formed to include at least a part of a substrate material, a second member formed to include at least a part of the substrate material and configured to be relatively movable with respect to the first member, and a fuse configured to include at least a part of the substrate material and configured to electrically connect the first member to the second member via the substrate material.

18 Claims, 38 Drawing Sheets

ELECTRONIC DEVICE AND ELECTRONIC APPARATUS HAVING A FUSE THAT IS FRACTURED BY EXTERNAL FORCES

CROSS REFERENCE TO RELATED APPLICATIONS

This application claims the benefit of Japanese Priority Patent Application JP 2013-267429 filed Dec. 25, 2013, the entire contents of which are incorporated herein by reference.

BACKGROUND

The present disclosure relates to an electronic device, a fuse, and an electronic apparatus.

Electronic devices including driving units such as micro electro mechanical systems (MEMS) are used as switching elements in various sensors or electronic apparatuses. In general, the driving units include a plurality of members (for example, a fixed member and a movable member) configured to be relatively movable and relative movement amounts of these members are controlled, so that desired functions can be realized.

On the other hand, in the driving units of the electronic devices, constituent members of the driving units are charged during manufacturing processes and a difference in a charge amount occurs between the members, and thus attachment (sticking or stiction) between the members may occur in some cases. Since the occurrence of the sticking can be a cause of a manufacturing failure of an electronic device, there is a concern that deterioration in a product yield may be caused. Accordingly, various technologies have been developed in order to prevent sticking during manufacturing processes for electronic devices.

For example, JP 2009-32559A discloses a technology for preventing sticking between members during a manufacturing process by fabricating two members to be driven through separate processes and joining these members in a rear-stage process.

As other methods of preventing sticking, there are known technologies for connecting target members by a fuse in a manufacturing process, maintaining the members at substantially the same potential, and fracturing the fuse in a rear-stage process. For example, JP 2012-222241A and JP 2006-514786T disclose technologies for connecting two components by a fuse formed of a conductive material such as polysilicon or aluminum during a manufacturing process and applying an overcurrent in a rear-stage process to melt the fuse while maintaining the members at substantially the same potential.

As a method of fracturing a fuse instead of the melting method by the overcurrent, for example, JP 2006-221956A discloses a technology for forming a vibration body vibrated by a piezoelectric element near a fuse and bringing the vibration body into contact with the fuse to cut out the fuse. For example, JP 2005-260398A discloses a technology for forming an opening portion at a position corresponding to a fuse and performing laser irradiation or drying etching, or the like via the opening portion to cut out the fuse.

SUMMARY

In the technology disclosed in JP 2009-32559A, however, it is necessary to fabricate the members through separate processes and perform a process of joining these members in a rear-stage process. Therefore, since there is a probability of an increase in the total number of processes in the fabrication of the electronic device, there is a concern of a manufacturing cost increasing. In the technologies disclosed in JP 2012-222241A, JP 2006-514786T, JP 2006-221956A, and JP 2005-260398A, it is also necessary to provide the process of fabricating the fuse or the process of fracturing the fuse. Therefore, there is another concern of a manufacturing cost increasing.

In view of the foregoing circumstances, there has been a demand for a technology for suppressing an increase in a manufacturing cost by fabricating the fuse or fracturing the fuse formed between the members more easily. Accordingly, it is desirable to provide a novel and improved electronic device, a novel and improved fuse, and a novel and improved electronic apparatus capable of fabricating or fracturing a fuse more easily.

According to an embodiment of the present disclosure, there is provided an electronic device including a first member formed to include at least a part of a substrate material, a second member formed to include at least a part of the substrate material and configured to be relatively movable with respect to the first member, and a fuse configured to include at least a part of the substrate material and configured to electrically connect the first member to the second member via the substrate material.

According to another embodiment of the present disclosure, there is provided a fuse that is installed between a first member formed to include at least a part of a substrate material and a second member formed to include at least a part of the substrate material and to be relatively movable with respect to the first member, the fuse including at least a part of the substrate material, the fuse electrically connecting the first member to the second member via the substrate material.

According to another embodiment of the present disclosure, there is provided an electronic apparatus including an electronic device including a first member formed to include at least a part of a substrate material, a second member formed to include at least a part of the substrate material and configured to be relatively movable with respect to the first member, and a fuse formed to include at least a part of the substrate material and configured to electrically connect the first member to the second member via the substrate material.

According to another embodiment of the present disclosure, there is provided an electronic device including a first member, a second member configured to be moved relatively with respect to the first member when a predetermined potential difference is supplied between the first member and the second member, and a fuse configured to electrically connect the first member to the second member. In at least a partial region of the fuse, a high-resistance portion with a resistance value causing at least the predetermined potential difference is formed between the first member and the second member.

According to another embodiment of the present disclosure, there is provided a fuse that is installed between a first member and a second member moved relatively with respect to the first member when a predetermined potential difference is supplied between the first member and the second member and electrically connects the first member to the second member, the fuse including, in at least a partial region, a high-resistance portion with a resistance value causing at least the predetermined potential difference between the first member and the second member.

According to another embodiment of the present disclosure, there is provided an electronic apparatus including an electronic device including a first member, a second member configured to be moved relatively with respect to the first member when a predetermined potential difference is supplied between the first member and the second member, and a fuse that electrically connects the first member to the second member and in which a high-resistance portion with a resistance value causing at least the predetermined potential difference is formed between the first member and the second member in at least a partial region.

According to an embodiment of the present disclosure, the first member and the second member relatively movable with respect to the first member are electrically connected by the fuse. Accordingly, the first and second members are maintained at substantially the same potential, and thus sticking between the first and second members is prevented. The first member, the second member, and the fuse are formed to include at least parts of the substrate material. The fuse electrically connects the first member to the second member via the substrate material. Accordingly, since the fuse can be fabricated without, for example, addition of a process such as etching of the substrate material, the fuse can be fabricated more easily.

According to an embodiment of the present disclosure described above, it is possible to fabricate or fracture the fuse more easily. The foregoing advantages are not necessarily restrictive, but any advantage desired to be obtained in the present specification or other advantages understood from the present specification may be obtained along with the foregoing advantages or instead of the foregoing advantages.

DETAILED DESCRIPTION OF THE EMBODIMENTS

Figure 1:
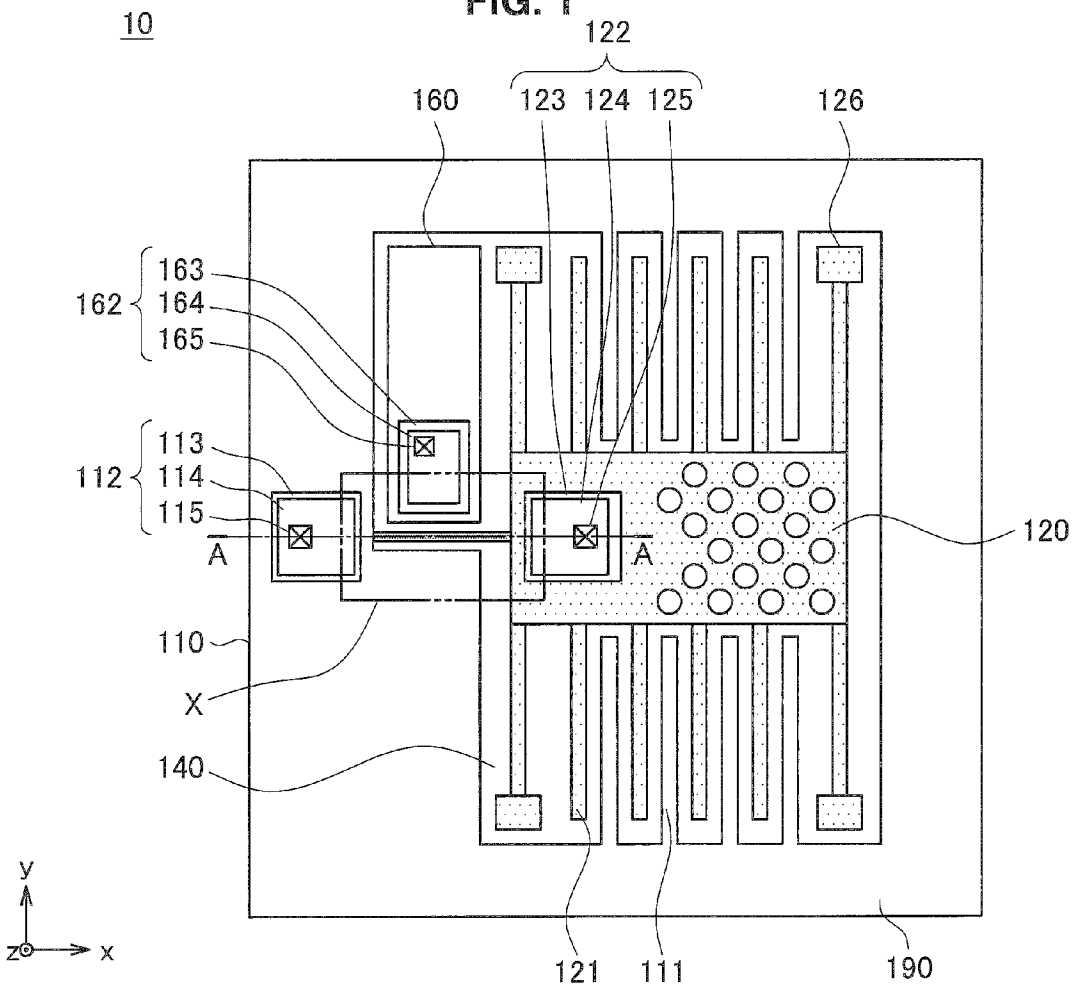
FIG. 1 is a top view illustrating an example of the configuration of an electronic device according to a first embodiment.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

The description will be made in the following order.

1. First embodiment
1-1. Configuration of electronic device
1-2. Configuration of fuse and method of fracturing fuse
1-3. Function of fuse in electronic device
1-4. Modification examples
1-4-1. Modification example in which fuse includes stress concentration portion
1-4-2. Modification example in which fuse after fracture is welded
1-4-3. Modification example in which fuse fracture portion includes plurality of fuse electrode portions
1-4-4. Modification example in which fuse fracture portion includes fracture driving portion
1-4-5. Modification example in which fuse is fractured by Lorentz force
1-4-6. Modification example in which fuse is fractured by vibration
1-4-7. Modification example in which fracture surface of fuse is parallel to cleavage surface of substrate
1-5. Conclusion of first embodiment
2. Second embodiment
2-1. Configuration of electronic device
2-2. Operation of electronic device and method of fracturing fuse
2-3. Detailed design of fuse
2-3-1. Method of designing shape of fuse
2-3-2. Method of designing resistance value of high-resistance portion of fuse
2-4. Modification examples
2-4-1. Modification example of high-resistance portion of fuse
2-4-2. Modification example of shape of fuse
2-4-3. Modification example in which re-contact prevention mechanism of fuse after fracture is formed
2-4-4. Modification example in which the position at which the fuse is formed is different
2-4-5. Modification example in which electronic device is surface MEMS
2-5. Application example
2-5-1. Application to switching element of electronic apparatus
2-6. Conclusion of second embodiment
3. Supplement <1. First Embodiment>

First, a first embodiment of the present disclosure will be described.

As described above, in electronic devices such as micro electro-mechanical systems (MEMS), there is a concern of sticking between members included in a driving unit during a manufacturing process. Accordingly, as a technology for preventing the sticking, for example, as disclosed in JP 2009-32559A, a technology for fabricating members included in a driving unit through separate processes and joining these members in a rear-stage process has been suggested. Further, as disclosed in JP 2012-222241A, JP 2006-514786T, JP 2006-221956A, and JP 2005-260398A, technologies for connecting target members included in the driving portion by a fuse in a manufacturing process, maintaining the members at substantially the same potential, and fracturing the fuse in a rear-stage process have been suggested.

On the other hand, as one technology when a MEMS is fabricated, there is bulk micromachining in which a MEMS is fabricated by processing a substrate material. In the MEMS (hereinafter also referred to as a bulk MEMS) fabricated using the bulk micromachining, members included in a driving unit, e.g., a fixed member and a movable member, can both be formed including at least a part of the substrate material.

Here, a case in which the fuse disclosed in JP 2012-222241A, JP 2006-514786T, JP 2006-221956A, and JP 2005-260398A is applied to the bulk MEMS will be considered. The fuse disclosed in JP 2012-222241A, JP 2006-514786T, JP 2006-221956A, and JP 2005-260398A is formed of a conductive material such as polysilicon or a metal (for example, aluminum). Accordingly, when such a fuse is attempted to be applied to the bulk MEMS, for example, it is necessary to stack a polysilicon layer, a metal layer, or the like on a substrate, process the layer in a pattern according to the fuse, and remove the substrate material located immediately below the pattern. Thus, when the fuse disclosed in JP 2012-222241A, JP 2006-514786T, JP 2006-221956A, and JP 2005-260398A is applied to the bulk MEMS, it is necessary to perform a process of removing the substrate material in addition to the process of processing the conductive material of which the fuse is formed, and thus there is a concern of a manufacturing cost increasing.

As described above, in the technology disclosed in JP 2009-32559A, there is a probability of a manufacturing cost increasing since the members included in the driving unit are fabricated separately. Further, in the technology disclosed in JP 2009-32559A, high alignment precision is necessary when the members included in the driving unit are joined. Accordingly, the technology disclosed in JP 2009-32559A can be said to be difficult to apply to a MEMS having a more refined configuration or a lateral driving type MEMS in which a driving direction is a direction in a plane parallel to a substrate.

In view of the foregoing circumstances, there has been a demand for a technology for suppressing an increase in a manufacturing cost by fabricating the fuse formed between the members more easily. Accordingly, the first embodiment of the present disclosure provides a technology for enabling a fuse to be fabricated more easily.

Hereinafter, the first embodiment will be described in detail. The first embodiment will be described below exemplifying an electrostatic MEMS that is fabricated as a bulk MEMS, which is an electronic device including a fuse according to the first embodiment, and performs electrostatic driving or electrostatic detection. The electrostatic MEMS can be applied as, for example, a switching element in various electronic apparatuses.

[1-1. Configuration of Electronic Device]

Figure 2:
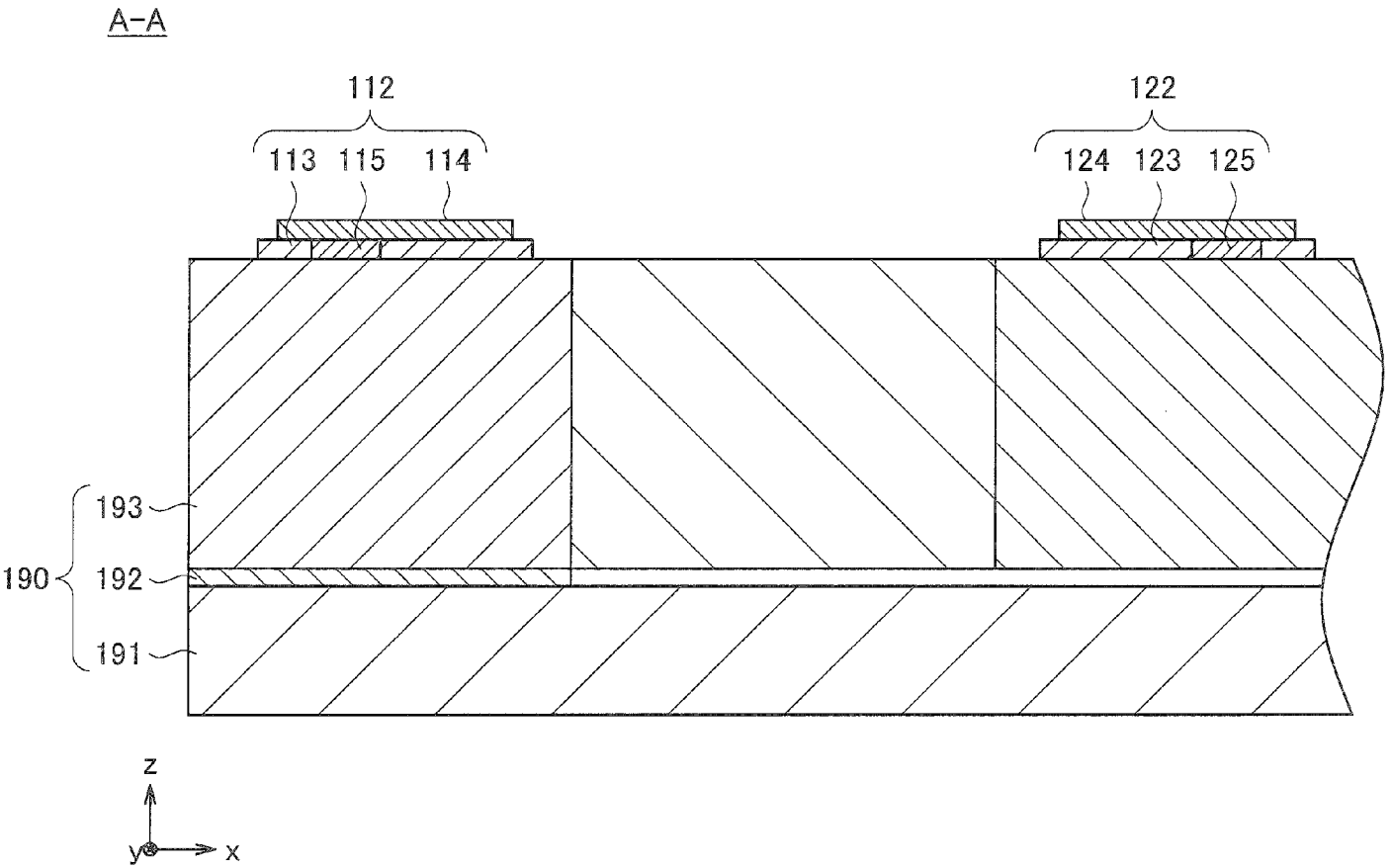
FIG. 2 is a sectional view illustrating the electronic device taken along the line A-A of FIG. 1.

First, an example of the configuration of the electronic device according to the first embodiment will be described with reference to FIGS. 1 and 2. FIG. 1 is a top view illustrating the configuration of an electronic device according to the first embodiment. FIG. 2 is a sectional view illustrating the electronic device taken along the line A-A of FIG. 1.

Referring to FIG. 1, an electronic device 10 according to the first embodiment includes a fixed member 110, a movable member 120, and a fuse 130. As described above, the electronic device 10 is an electrostatic MEMS fabricated as a bulk MEMS. The fixed member 110, the movable member 120, and the fuse 130 are fabricated by performing various etching processes on a substrate 190 and forming a trench 140 in a predetermined region of the substrate 190. In the description, different kinds of hatchings are given to and illustrated on members corresponding to the movable member 120 and the fuse 130 in FIG. 1 and the subsequent drawings to facilitate the description of the first embodiment. Thus, in the first embodiment, the fixed member 110, the movable member 120, and the fuse 130 may be formed to include at least parts of a substrate material of the substrate 190 (hereinafter also simply referred to as a substrate material). The electronic device 10 according to the first embodiment may have a configuration in which the fuse 130 according to the embodiment is formed between a fixed member and a movable member in a general electrostatic MEMS or any of the known configurations may be applied as the configuration of the electrostatic MEMS.

Here, in the following description, a depth direction of the substrate 190 is also referred to as a z-axis direction. A direction of a surface on which the fixed member 110, the movable member 120, and the fuse 130 are formed in the substrate 190 is also referred to as an upper direction or the positive direction of the z axis and its opposite direction is also referred to as a lower direction or the negative direction of the z axis. Further, two directions perpendicular to each other in a plane parallel to the surface of the substrate 190 are also referred to as the x-axis direction and the y-axis direction. In the example illustrated in FIGS. 1 and 2, a movement direction of the movable member 120 is assumed to be along the x axis in the plane parallel to the surface of the substrate 190.

The fixed member 110 is formed to include at least a part of the substrate material. The fixed member 110 is a member that is included in the driving unit of the electronic device 10 and is fixed without being moved when the electronic device 10 is driven. Hereinafter, the fixed member 110 is also referred to as a first member 110. In a partial region of the fixed member 110, for example, a plurality of fixed electrodes 111 extending in the y-axis direction are formed. An electrode portion 112 is formed in a partial region of the surface of the fixed member 110. The electrode portion 112 has, for example, a configuration in which an insulation film 113 and a wiring layer 114 are stacked in order on the substrate 190 and a contact 115 is formed between the surface of the substrate 190 and the wiring layer 114. The wiring layer 114 and the substrate 190 are electrically connected by the contact 115. Accordingly, by applying a predetermined voltage to the wiring layer 114 of the surface of the electrode portion 112, it is possible to control the voltage of the substrate material forming the fixed member 110.

The movable member 120 is formed to include at least a part of the substrate material. The movable member 120 is included in the driving unit of the electronic device 10 and is configured to be relatively movable with respect to the fixed member 110 when the electronic device 10 is driven. Hereinafter, the movable member 120 is also referred to as a second member 120. In the first embodiment, the movable member 120 can be moved relatively with respect to the fixed member 110 in a predetermined direction (x-axis direction) in the plane parallel to the substrate 190. The movable member 120 includes a plurality of movable electrodes 121 formed to face the fixed electrodes 111 of the fixed member 110. As in the fixed member 110, an electrode portion 122 is formed in a partial region of the surface of the movable member 120. As in the electrode portion 112, for example, the electrode portion 122 has a configuration in which an insulation film 123 and a wiring layer 124 are stacked in order on the substrate 190 and a contact 125 is formed between the surface of the substrate 190 and the wiring layer 124. The wiring layer 124 and the substrate 190 are electrically connected by the contact 125. Accordingly, by applying a predetermined voltage to the wiring layer 124 of the surface of the electrode portion 122, it is possible to control the voltage of the substrate material forming the movable member 120.

The fuse 130 is formed to include at least a part of the substrate material and electrically connects the fixed member 110 to the movable member 120 via the substrate material. The fuse 130 has a thin plate shape extending in the x-axis direction. Here, as will be described below, the fuse 130 electrically connects the fixed member 110 to the movable member 120 during a manufacturing process, but is fractured when the electronic device 10 is driven subsequently. Accordingly, the shape of the fuse 130 is preferably designed such that the fuse 130 is not fractured by an outside force applied during the manufacturing process, but can be fractured when an outside force with a greater predetermined magnitude is applied. Thus, parameters defining the shape of the fuse 130, such as the width (a width W illustrated in FIG. 3 to be described below) of the fuse 130 in the y-axis direction, the length (a length L illustrated in FIG. 3 to be described below) of the fuse 130 in the x-axis direction, and the depth of the fuse 130 in the z-axis direction can be appropriately designed according to a kind of process of fabricating the electronic device 10, a method of finally fracturing the fuse 130, or the like.

Referring to FIG. 2, the configuration of the fixed member 110, the movable member 120, and the fuse 130 in the depth direction will be described in detail. For example, a Si wafer is used as the substrate 190. The electronic device 10 can be fabricated by sequentially performing various processes, which are generally used at the time of fabrication of the bulk MEMS in a semiconductor process, on the Si wafer. The first embodiment is not limited to the example and the substrate in which the electronic device 10 is formed can be formed of any of various semiconductor materials. For example, in addition to the above-described Si, any of various materials, such as SiC, GaP, or InP, which can be generally used as a wafer of a semiconductor device, may be applied as the substrate 190. The material of the substrate 190 is not limited to the semiconductor material and any of various known materials of which the MEMS can be formed can be applied.

For example, the substrate 190 may be a silicon on insulator (SOI) substrate. As illustrated in FIG. 2, the substrate 190 has a configuration in which an insulator, e.g., a box layer 192 formed of $SiO_2$, is interposed between Si layers 191 and 193. The fixed member 110, the movable member 120, and the fuse 130 can be formed by processing the Si layer 193 of the upper layer of the substrate 190 which is the SOI substrate. For example, the depth of the trench 140 formed between the fixed members 110, the movable member 120, and the fuse 130 corresponds to the thickness (depth) of the Si layer 193 of the upper layer.

The box layer 192 in a region corresponding to a region immediately below the movable member 120 and the fuse 130 can be removed by, for example, an etching process. By removing the box layer 192 in the region corresponding to the region immediately below the movable member 120, the movable member 120 can be moved in the plane parallel to the SOI substrate 190. As will be described below, the fuse 130 is fractured when the electronic device 10 is driven. Therefore, the box layer 192 in the region corresponding to the region immediately below the movable member 120 is preferably removed. On the other hand, the box layer 192 in a region corresponding to a region immediately below the fixed member 110 remains without being removed. Accordingly, the fixed member 110 can be connected fixedly to the Si layer 191 of the lower layer with the box layer 192 interposed therebetween. However, in a partial region of the movable member 120, the box layer 192 is not removed and anchor portions 126 which can be connected fixedly to the Si layer 191 of the lower layer are formed. In the example illustrated in FIG. 1, the anchor portions 126 are formed in the front ends of some of the movable electrodes 121. The movable member 120 is configured such that the movable member 120 is fixed to the substrate 190 by the anchor portions 126 and other sites can be elastically moved relatively with respect to the fixed member 110.

Here, a resistance value of at least the Si layer 193 of the upper layer in the substrate 190 is adjusted to be equal to or less than a predetermined value, for example, by appropriately doping impurities. Thus, in the electronic device 10, by appropriately doping the impurities in the Si layer 193, the fixed member 110, the movable member 120, and the fuse 130 may behave as, so to speak, conductors. By appropriately doping the impurities in the substrate material, the fuse 130 can impart electrical conductivity to the fixed member 110 and the movable member 120 by the substrate material. In the first embodiment, however, a wiring layer formed as a conductor may be further formed on the surface of the fuse 130. When the wiring layer is further formed as a conductor on the surface of the fuse 130, the resistance value in the fuse 130 is further reduced, and thus the fixed member 110 and the movable member 120 can be electrically connected with lower resistance.

The configuration illustrated in FIG. 1 is illustrated as the configuration of the electronic device 10 during the manufacturing process. As illustrated in FIG. 1, since the fixed member 110 and the movable member 120 are electrically connected by the fuse 130 during the manufacturing process, the fixed electrodes 111 and the movable electrodes 121 are maintained at substantially the same potential. Accordingly, in each process of the manufacturing process at the time of the fabrication of the electronic device 10, e.g., a drying etching process or a sputtering process, a potential difference between the fixed electrode 111 and the movable electrode 121 can be suppressed to a small value even when the fixed electrode 111 and the movable electrode 121 are charged. Thus, it is possible to prevent sticking.

On the other hand, when the electronic device 10 is driven, a process of fracturing the fuse 130 is performed. By supplying the potential difference between the electrode portions 112 and 122 after the fracture of the fuse 130, a predetermined potential difference can be supplied between the fixed member 110 and the movable member 120. By supplying the predetermined potential difference between the fixed member 110 and the movable member 120 in the electronic device 10, it is possible to generate an electrostatic attractive force between the fixed electrode 111 and the movable electrode 121 formed to face each other and move the movable member 120 in the x-axis direction with respect to the fixed member 110. For example, the electronic device 10 is configured such that a terminal (not illustrated) is formed at an end portion of the movable member 120 in the x-axis direction and the movable member 120 is moved so that the terminal comes into contact with another terminal formed in another member, and thus the electronic device 10 can be used as a switching element. In contrast, for example, when an outside force is applied to the electronic device 10 and the movable member 120 is displaced in the x-axis direction, the displacement amount can be detected as a variation in the potential difference between the fixed member 110 and the movable member 120 in the electronic device 10. Thus, the electronic device 10 can be used as, for example, a sensor that detects various outside forces such as an acceleration and a pressure.

[1-2. Configuration of Fuse and Method of Fracturing Fuse]

In the first embodiment, as described above, the fixed member 110 and the movable member 120 are maintained at substantially the same potential by the fuse 130 during the manufacturing process for the electronic device 10 and the process of fracturing the fuse 130 is performed when the electronic device 10 is driven. Here, in the first embodiment, a mechanism that applies an outside force to the fuse 130 in a direction perpendicular to the extension direction of the fuse 130 is formed so that the fuse 130 is fractured by the outside force. In the first embodiment, a structure (hereinafter also referred to as a fuse fracture portion) that applies an outside force to the fuse 130 may be formed inside the electronic device 10 or an outside force may be applied from the outside of the electronic device 10 to the fuse 130.

FIG. 1 illustrates an example of a configuration in which the fuse fracture portion is formed inside the electronic device 10. For example, the fuse fracture portion can fracture the fuse 130 by applying an electrostatic attractive force with a predetermined magnitude from the outside to the fuse 130. In the example illustrated in FIG. 1, the fuse fracture portion includes a fuse electrode portion 160 that applies a predetermined electrostatic attractive force to the fuse 130 by supplying a predetermined potential difference between the fuse fracture portion and the fuse 130. As illustrated in FIG. 1, the fuse electrode portion 160 is formed to face the fuse 130 in a direction substantially perpendicular to the extension direction of the fuse 130.

As in the fixed member 110, for example, the fuse electrode portion 160 can be formed to include at least a part of a substrate material and to be fixed to the Si layer of the lower layer included in the substrate 190. The resistance value of the substrate material (the Si layer 193 of the upper layer) forming the fuse electrode portion 160 is adjusted to be equal to or less than a predetermined value, for example, by appropriately doping impurities, as in the fixed member 110, the movable member 120, and the fuse 130. An electrode portion 162 is formed in a partial region of the surface of the fuse electrode portion 160. A specific configuration of the electrode portion 162 may be the same as that of the electrode portions 112 and 122 described above and has, for example, a configuration in which an insulation film 163 and a wiring layer 164 are stacked in order on the substrate 190 and a contact 165 is formed between the surface of the substrate 190 and the wiring layer 164. The wiring layer 164 and the substrate 190 are electrically connected by the contact 165. Accordingly, by applying a predetermined voltage to the wiring layer 164 of the surface of the electrode portion 162, it is possible to control the voltage of the substrate material forming the fuse electrode portion 160.

Figure 3:
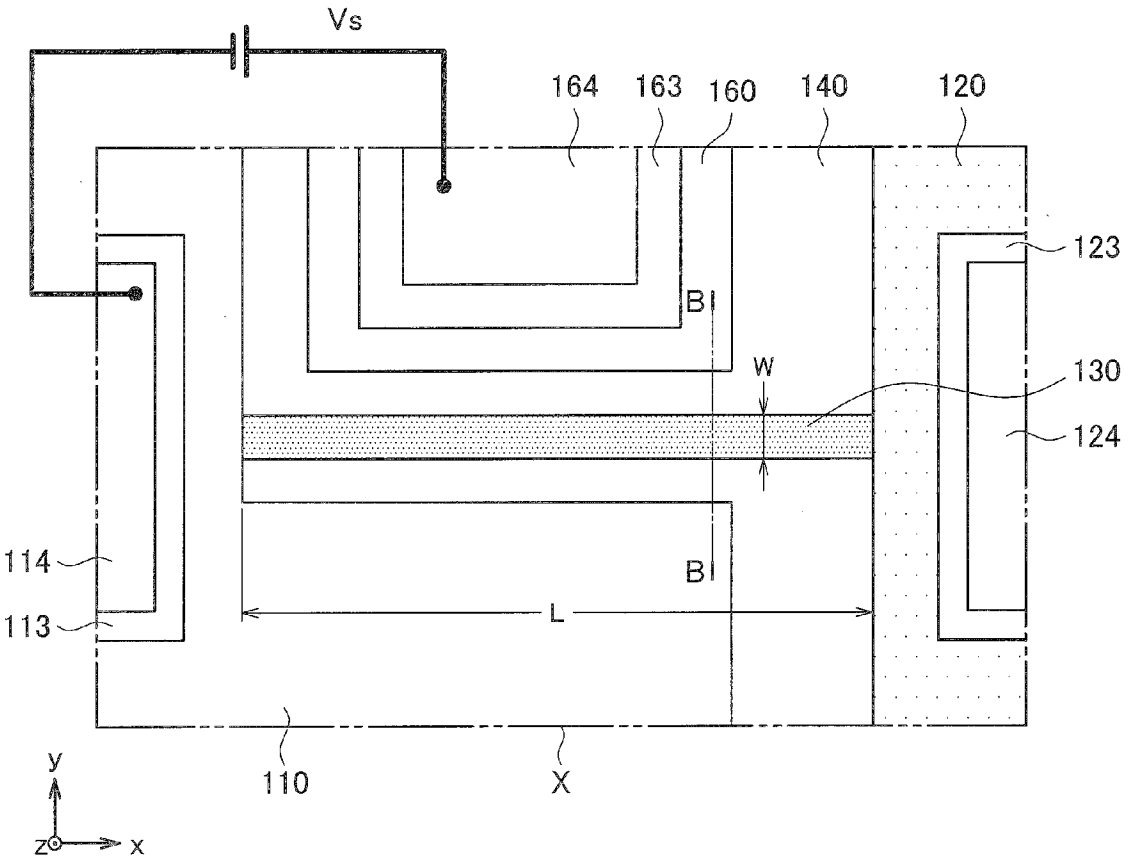
FIG. 3 is an enlarged view illustrating a region X including a fuse and a periphery thereof illustrated in FIG. 1.

A method of fracturing the fuse 130 will be described with reference to FIG. 3. FIG. 3 is an enlarged view illustrating a region X including a fuse and a periphery thereof illustrated in FIG. 1.

Referring to FIG. 3, the fuse 130 according to the first embodiment is formed by processing the substrate 190 to have a thin plate shape extending in the x-axis direction. In the following description, as illustrated in FIG. 3, the width of the fuse 130 in the y-axis direction is referred to as a width W and the length of the fuse 130 in the x-axis direction is referred to as a length L. Although not explicitly illustrated in FIG. 3, the width (for example, which corresponds to the depth of the Si layer 193 of the upper layer of the substrate 190) of the fuse 130 in the z-axis direction is referred to as a width D. For example, the fuse 130 is formed to have the length L of 210 (μm), the width W of 0.6 (μm), and the width D of 50 (μm). These numeral values indicate an example of the shape of the fuse 130 and the shape of the fuse 130 is not limited to the example. As described above, the shape of the fuse 130 may be appropriately designed according to a kind of process of fabricating the electronic device 10, a method of finally fracturing the fuse 130, or the like.

In the configuration illustrated in FIG. 3, for example, a potential of 0 (V) is supplied to the electrode portion 112 of the fixed member 110 and the electrode portion 122 of the movable member 120 (that is, a potential of 0 (V) is supplied to the fixed member 110 and the movable member 120) and a predetermined voltage (for example, 80 (V)) is applied to the fuse electrode portion 160. Then, an electrostatic attractive force is applied to the fuse 130 in a direction in which the fuse 130 is attracted toward the fuse electrode portion 160 by a potential difference Vs between the fuse 130 and the fuse electrode portion 160. The fuse 130 can be fractured by a bending stress caused by this electrostatic attractive force. The voltage value supplied to the fixed member 110 and the movable member 120 and the voltage value supplied to the fuse electrode portion 160 are not limited to the foregoing examples. In consideration of the shape of the fuse 130 or the like, these voltage values can be appropriately set so that the potential difference Vs obtained by applying a desired electrostatic attractive force which can fracture the fuse 130 is generated between the fuse 130 and the fuse electrode portion 160. For example, the voltage supplied to the fuse electrode portion 160 may be a negative value. When the voltage is a negative value, an electrostatic force acting in the negative direction of the y axis is applied to the fuse 130.

Since the electrostatic attractive force is generated according to the potential difference between the fuse electrode portion 160, and the fixed member 110 and the movable member 120, the magnitude of the electrostatic attractive force can be controlled by appropriately adjusting the potential difference. The potential difference between the fuse electrode portion 160, and the fixed member 110 and the movable member 120 may be appropriately set in consideration of the material (that is, the material of the substrate 190) of the fuse 130, the shape of the fuse 130, or the like so that the electrostatic attractive force which can fracture the fuse 130 is generated.

The first embodiment has been described above. As described above, in the first embodiment, the electronic device 10 includes the fixed member 110 which is the first member, the movable member 120 which is the second member, and the fuse 130 that electrically connects the fixed member 110 to the movable member 120. Thus, the fixed member 110 and the movable member 120 are electrically connected by the fuse 130, and the fixed member 110 and the movable member 120 are maintained at substantially the same potential. Therefore, sticking between the fixed member 110 and the movable member 120 during the manufacturing process is prevented. In the first embodiment, a mechanism that applies an outside force to the fuse 130 in a direction perpendicular to the extension direction of the fuse 130 may be installed, and thus the fuse 130 can be fractured by this outside force. By fracturing the fuse 130, a predetermined potential difference between the fixed member 110 and the movable member 120 can be supplied. Thus, for example, the original driving of the electronic device 10 serving as the MEMS is realized. In the first embodiment, the electronic device 10 may be, for example, a bulk MEMS. The fixed member 110, the movable member 120, and the fuse 130 are formed to include at least parts of the substrate. The fuse 130 electrically connects the fixed member 110 to the movable member 120 via the substrate material. Here, as described above, for example, in the technologies disclosed in JP 2012-222241A, JP 2006-514786T, JP 2006-221956A, and JP 2005-260398A, the fuse is formed of a conductive film layer stacked on the substrate. Therefore, for example, it is necessary to remove the substrate material immediately below the conductive film by etching or the like. As described above, however, in the first embodiment, the fuse 130 is formed by the substrate 190. Accordingly, for example, the fuse 130 can be formed without addition of a process of etching the substrate 190 or the like. Therefore, the fuse 130 can be fabricated in a simpler method. Thus, the manufacturing cost of the electronic device 10 can be further reduced.

In the technologies disclosed in JP 2012-222241A, JP 2006-514786T, JP 2006-221956A, and JP 2005-260398A, the case in which the fuse includes the substrate material is not assumed. Therefore, a method of fracturing the fuse including the substrate material has not been sufficiently examined. For example, this fracture is considered to be difficult even when a method such as the melting method by the overcurrent, the cutout by contact with the vibration body, or the cutout by laser irradiation or etching, as described in JP 2012-222241A, JP 2006-514786T, JP 2006-221956A, and JP 2005-260398A, is applied to the fuse 130 including the substrate material. On the other hand, in the first embodiment, the mechanism that applies an outside force to the fuse 130 in a direction perpendicular to the extension direction of the fuse 130 can be installed, and thus the fuse 130 can be fractured by this outside force. Accordingly, even the fuse 130 including the substrate material can be fractured more reliably, and thus it is possible to operate the electronic device 10 more reliably.

In the foregoing description, the case in which the electronic device 10 is the MEMS that includes the fixed member 110 which is the first member and the movable member 120 which is the second member has been described, but the first embodiment is not limited to this example. The fuse 130 according to the first embodiment may be formed between mutually different members that are relatively moved. For example, the first and second members may both be movable members. Even when the first and second members are both movable members, the fuse 130 can be formed in a simpler method and the sticking between the first and second members during the manufacturing process can be prevented by forming the fuse 130 as in the above-described embodiment.

In the first embodiment, the electronic device 10 may not be a MEMS. Since the fuse 130 according to the first embodiment electrically connects a plurality of members to each other via the substrate, the fuse 130 is a device formed by processing a part of the substrate and is applicable to all kinds of devices when the devices are devices in which the fuse can be formed between a plurality of mutually different members. According to the first embodiment, the fuse 130 can be fabricated more easily. Therefore, by applying the fuse 130 to various devices, the manufacturing cost of the device can be further reduced.

In the foregoing description, the method of using the electrostatic attractive force has been described as the method of fracturing the fuse 130, but the first embodiment is not limited to this example. In the first embodiment, the fuse 130 may be fractured by supplying the outside force in any direction perpendicular to the extension direction of the fuse 130 to the fuse 130 and any specific method can be used. Accordingly, the specific configuration of the fuse fracture portion is not limited to the configuration illustrated in FIG. 1 either and may be appropriately modified so that an outside force in any direction perpendicular to the extension direction of the fuse 130 can be supplied to the fuse 130. Other methods of fracturing the fuse 130 will be described in detail in the following [1-4. Modification examples].

A specific shape of the fuse 130 may be designed by analyzing a stress distribution of the fuse 130 through simulation using, for example, a finite element method (FEM). As described above, the shape of the fuse 130 is preferably designed such that the fuse 130 is not fractured by an outside force applied during the manufacturing process, but can be fractured when an outside force with a greater predetermined magnitude is applied. For example, a calculation model obtained by modeling the fuse 130 is created using a method such as the FEM and stress distributions when an outside force which can be applied to the calculation model during the manufacturing process and an outside force which can be applied at the time of the fracture of the fuse 130 is applied are each calculated. Then, the specific shape of the fuse 130 may be determined by repeatedly performing the calculation while appropriately changing the shape of the fuse 130 and searching for the shape of the fuse 130 for which the maximum stress generated during the manufacturing process is less than a fracture stress of the fuse 130 and the maximum stress generated at the time of the fracture of the fuse is greater than the fracture stress of the fuse 130. By repeatedly calculating the stress distribution while sequentially changing the outside force applied to the fuse 130 according to the foregoing method, it is also possible to appropriately calculate the value of an outside force by which the fuse 130 can be fractured.

[1-3. Function of Fuse in Electronic Device]

Figure 4A:
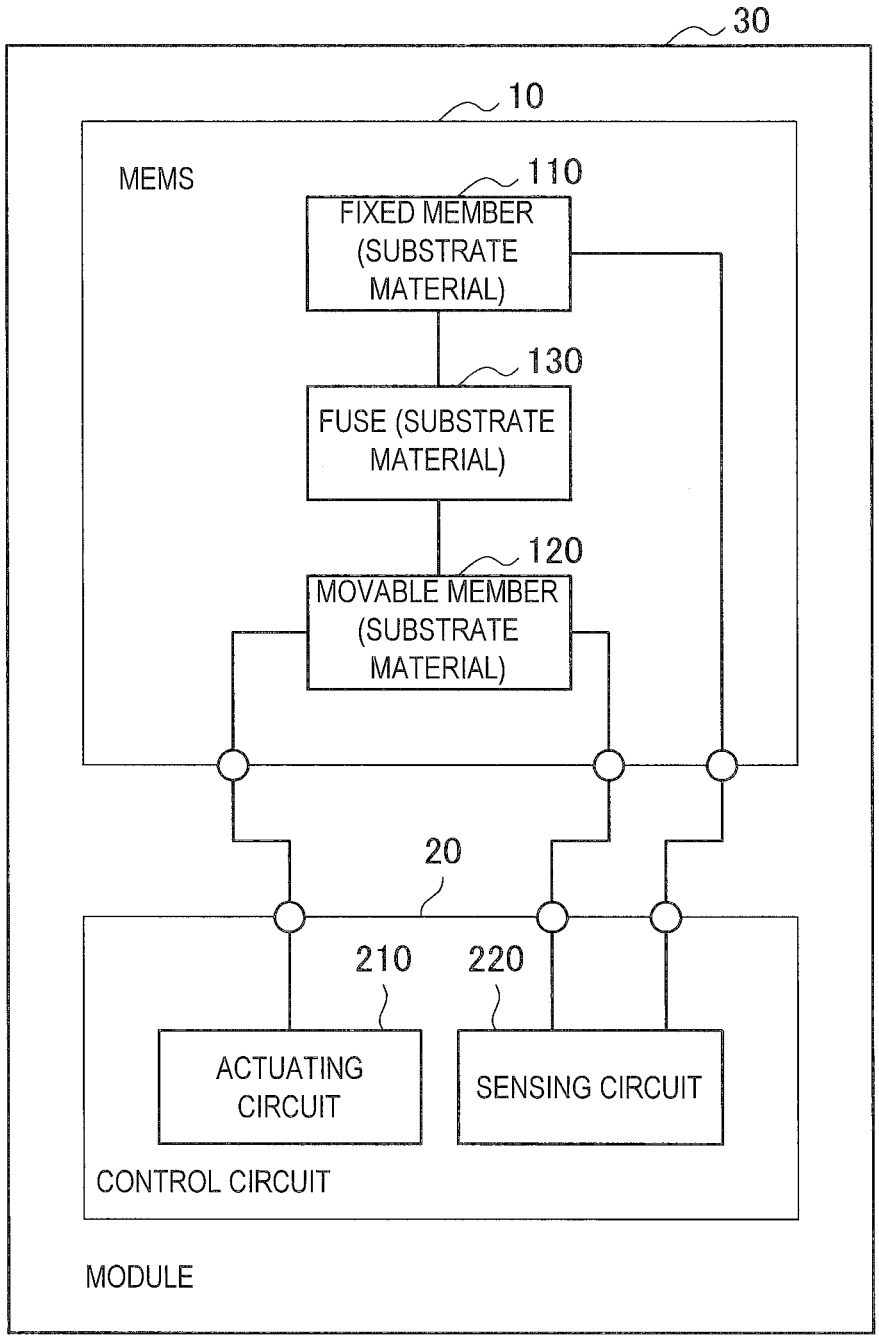
FIG. 4A is a functional block diagram illustrating an example of the configuration of a module on which the electronic device is mounted according to the first embodiment.
Figure 4B:
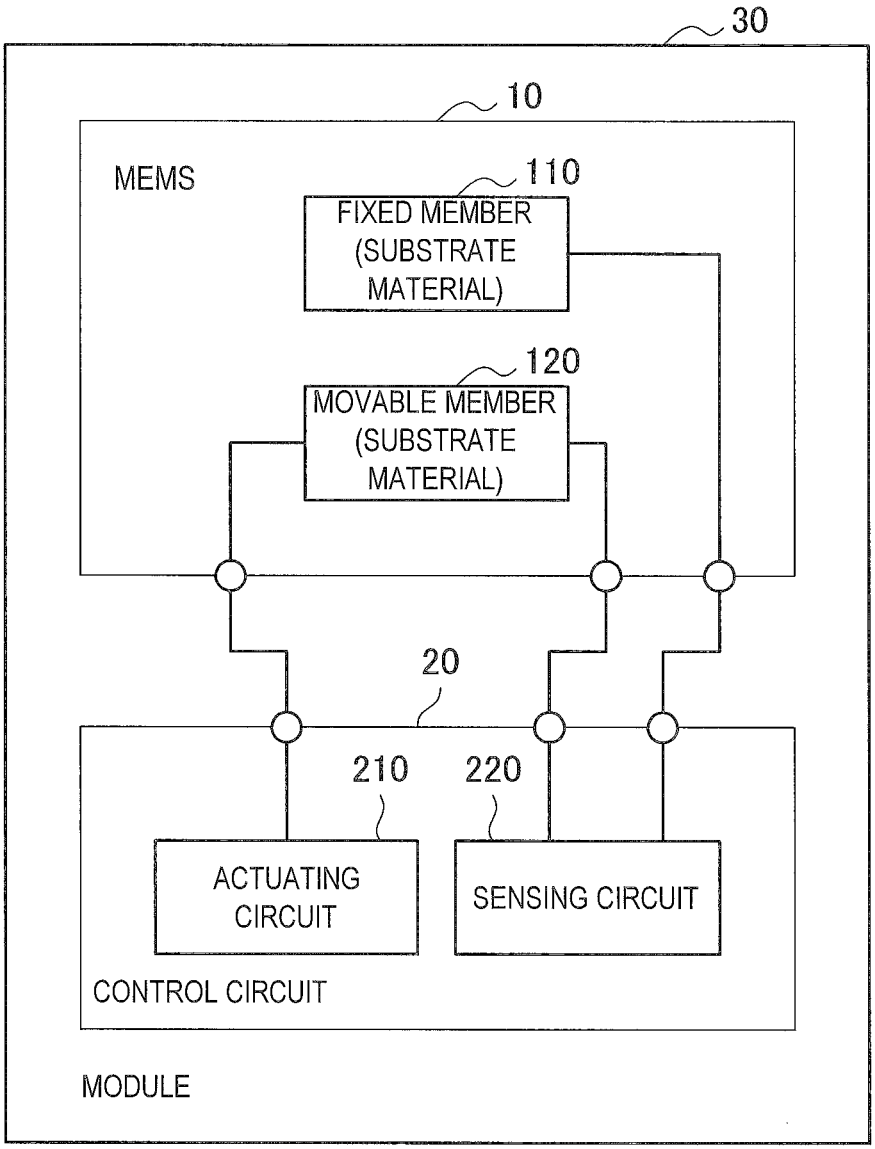
FIG. 4B is a functional block diagram illustrating the example of the configuration of the module on which the electronic device is mounted according to the first embodiment.

In the first embodiment as described above, the fixed member 110 and the movable member 120 are electrically connected by the fuse 130 during the manufacturing process and the fuse 130 is fractured when the electronic device 10 is driven. The function of the fuse 130 in the electronic device 10 will be described in more detail with reference to FIGS. 4A and 4B. FIGS. 4A and 4B are functional block diagrams illustrating an example of the configuration of a module on which the electronic device 10 is mounted according to the first embodiment.

FIG. 4A illustrates an example of the configuration of a module 30 during the manufacturing process. Referring to FIG. 4A, the module 30 includes the electronic device 10 and a control circuit 20. The electronic device 10 is, for example, a MEMS and has the configuration illustrated in FIG. 1. That is, the electronic device 10 includes the fixed member 110, the movable member 120 that is configured to be relatively movable with respect to the fixed member 110, and the fuse 130 that electrically connects the fixed member 110 to the movable member 120. The electronic device 10 is, for example, a bulk MEMS. The fixed member 110, the movable member 120, and the fuse 130 are formed to include at least parts of the substrate material.

The control circuit 20 includes, for example, any of various processors such as a central processing unit (CPU) and a digital signal processor (DSP) and controls driving of the electronic device 10 by performing a predetermined operation according to a predetermined program. The control circuit 20 includes an actuating circuit 210 that drives the electronic device 10 and a sensing circuit 220 that detects a predetermined physical amount from a behavior of the electronic device 10.

In the example described above with reference to FIG. 1, the electronic device 10 is an electrostatic MEMS in which the fixed electrodes 111 of the fixed member 110 and the movable electrodes 121 of the movable member 120 are formed to face each other. For example, the actuating circuit 210 is electrically connected to the movable member 120 of the electronic device 10. The actuating circuit 210 can drive the electronic device 10 so that the movable member 120 is moved with respect to the fixed member 110 by supplying a predetermined voltage to the movable member 120 to generate an electrostatic attractive force between the fixed electrodes 111 and the movable electrodes 121. For example, the sensing circuit 220 is electrically connected to the fixed member 110 and the movable member 120 of the electronic device 10. For example, when an outside force is applied to the electronic device 10 and the movable member 120 is moved with respect to the fixed member 110, the sensing circuit 220 can detect a physical amount (for example, an acceleration or a pressure) corresponding to the outside force by detecting a displacement amount of the movable member 120 as a variation amount of the potential difference between the fixed electrodes 111 and the movable electrodes 121.

In the state illustrated in FIG. 4A, since the fixed member 110 and the movable member 120 are electrically connected by the fuse 130, the fixed member 110 and the movable member 120 are maintained at substantially the same potential. Accordingly, the driving of the electronic device 10 by the actuating circuit 210 or the detection of the physical amount by the sensing circuit 220 using the electronic device 10 may not be realized. However, even when the fixed member 110 and the movable member 120 are charged, for example, in a dry etching process or a sputtering process during the manufacturing process, the potentials of both the fixed member 110 and the movable member 120 are maintained as substantially the same potential. Therefore, it is possible to prevent the sticking On the other hand, FIG. 4B illustrates an example of the configuration of the module 30 after the fracture of the fuse 130. Referring to FIG. 4B, the module 30 after the fracture of the fuse 130 has a configuration in which the fuse 130 is removed compared to the configuration illustrated in FIG. 4A. Accordingly, a predetermined potential difference between the fixed member 110 and the movable member 120 can be caused. Thus, as described above, it is possible to realize the driving of the electronic device 10 by the actuating circuit 210 and the detection of the physical amount by the sensing circuit 220 using the electronic device 10.

In the first embodiment, the fuse 130 may be fractured in any stage after a process in which there is a concern of sticking at the time of the manufacturing of the electronic device 10 or in any stage after the electronic device 10 is mounted on the module 30. The fuse 130 may be fractured at any timing after the process in which there is a concern of sticking and before the electronic device 10 is driven.

The function of the fuse 130 in the electronic device 10 has been described above with reference to FIGS. 4A and 4B.

[1-4. Modification Examples]

Next, several modifications of the above-described first embodiment will be described. In the first embodiment, the following configurations may be realized.

(1-4-1. Modification Example in which Fuse Includes Stress Concentration Portion)

In the embodiment described above with reference to FIGS. 1 to 3, the fuse 130 has the flat plate shape with the substantially constant width W. However, the first embodiment is not limited to this example. The fuse 130 may have a stress concentration portion on which a stress is concentrated when an outside force is applied, in the partial region. The stress concentration portion can be realized as a site that is formed in a partial region of the fuse 130 and is formed to have a smaller width in the direction in which the outside force is applied than the other regions.

A modification example in which the fuse includes the stress concentration portion will be described with reference to FIGS. 5 to 7 in the first embodiment. The modification example corresponds to an example in which the configuration of the fuse 130 is different in the embodiment described with reference to FIGS. 1 to 3 and the other remaining configurations, e.g., the configurations of the fixed member 110, the movable member 120, and the fuse electrode portion 160, may be the same as those of the foregoing embodiment. Accordingly, in the description of the following modification, differences from the above-described embodiment will be mainly described and the detailed description of the repeated factors will be omitted.

Figure 5:
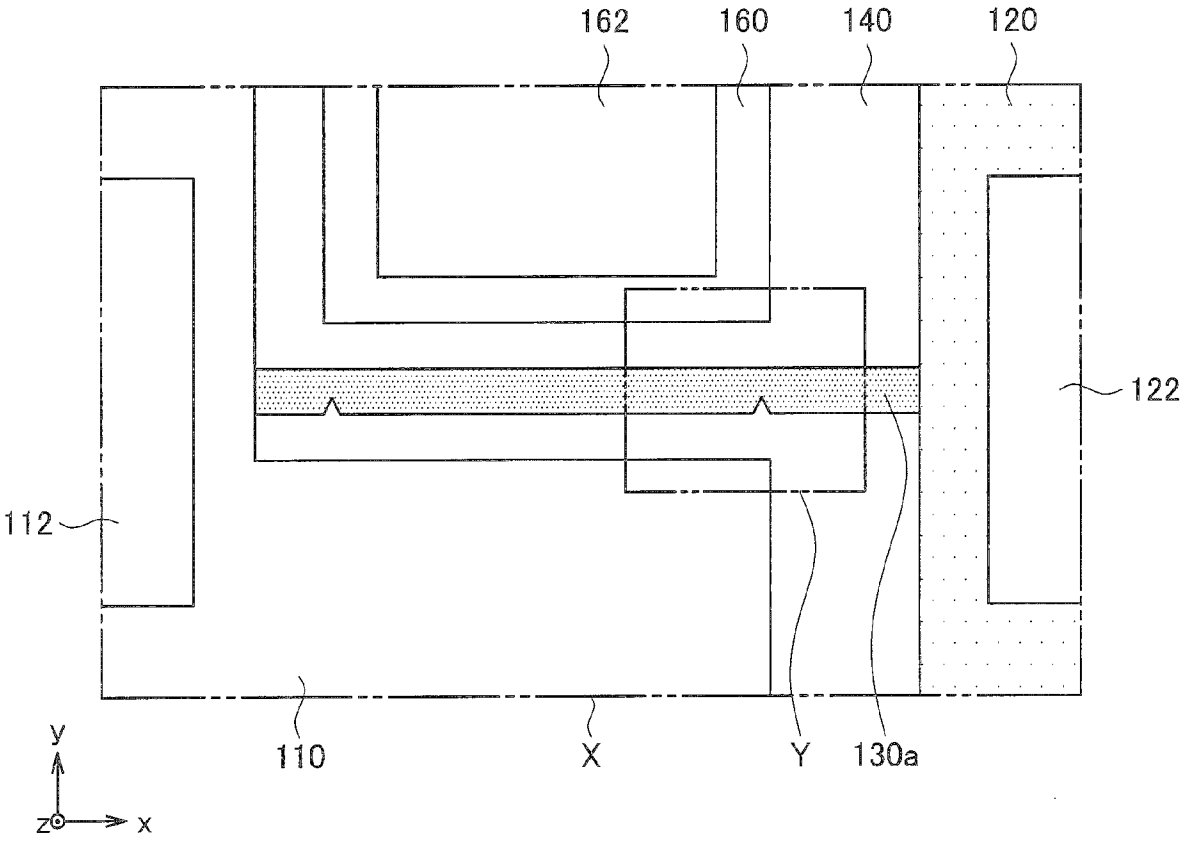
FIG. 5 is a top view illustrating an example of the configuration of a fuse including a stress concentration portion.

FIG. 5 is a top view illustrating an example of the configuration of the fuse including the stress concentration portion. FIG. 6 is an enlarged view illustrating the region Y including the stress concentration portion illustrated in FIG. 5. FIG. 7 is a top view illustrating another example of the configuration of the stress concentration portion. FIG. 5 is a drawing corresponding to FIG. 2 described above and corresponds to an enlarged view of a region X which is a region including the fuse and the periphery of the fuse in the configuration of the electronic device according to the modification example. In FIG. 5 and FIGS. 8 to 11 to be described below, the detailed configurations of the electrode portions 112, 122, and 162 are not illustrated for simplicity.

Figure 6:
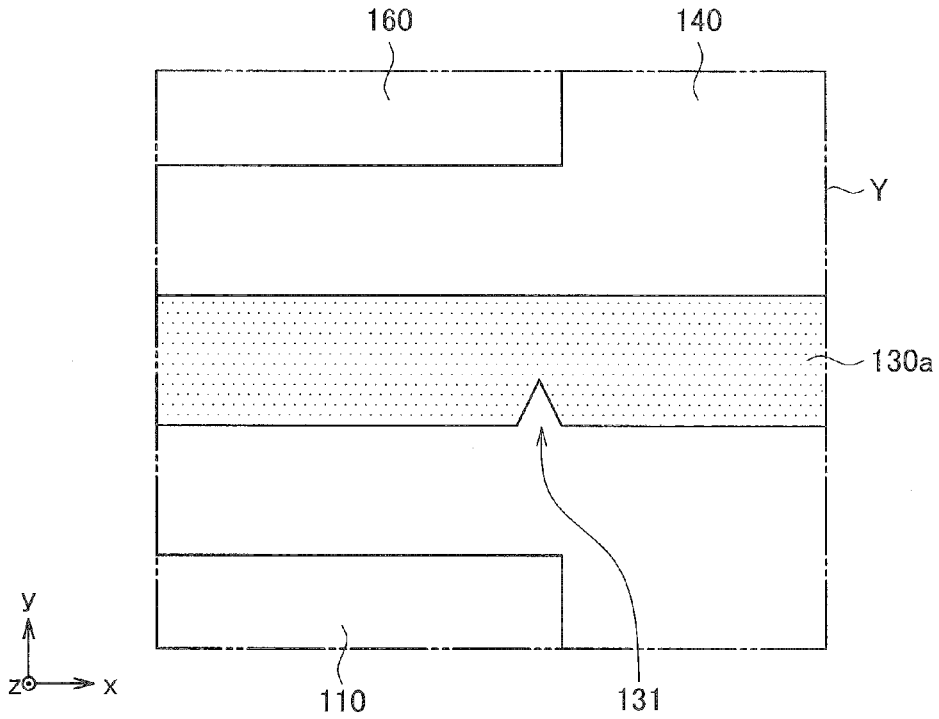
FIG. 6 is an enlarged view illustrating a region Y including the stress concentration portion illustrated in FIG. 5.
Figure 7:
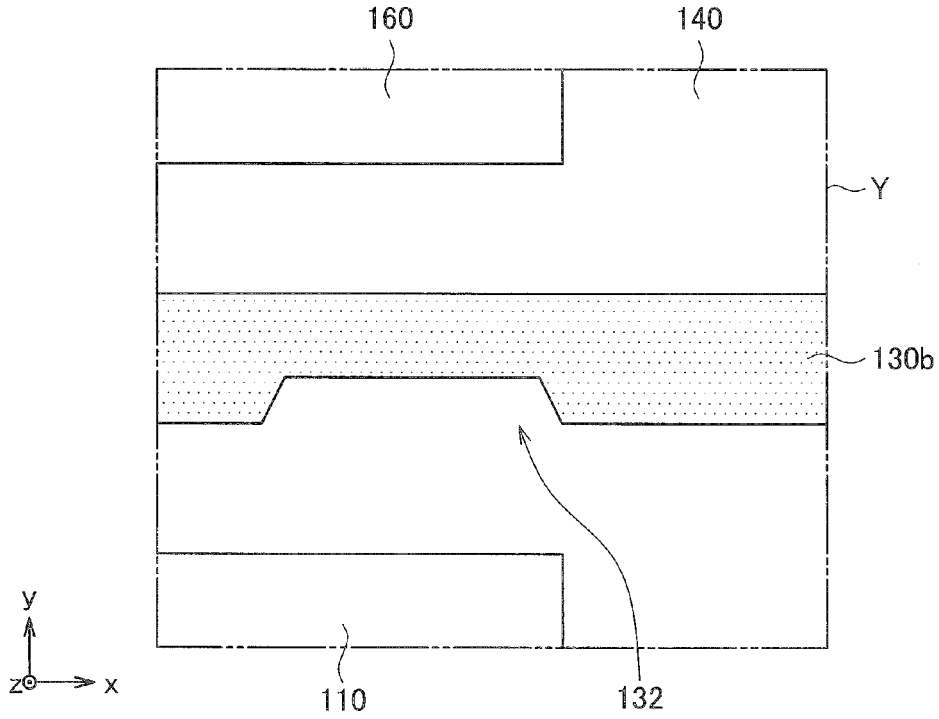
FIG. 7 is a top view illustrating another example of the configuration of the stress concentration portion.

Referring to FIGS. 5 and 6, a fuse 130*a* according to the modification example includes notches 131 in partial regions thereof. The notches 131 are formed in the partial regions of the fuse 130*a* in a direction (the y-axis direction) in which an outside force is applied to the fuse 130*a* at the time of the fracture of the fuse 130*a*. The width of the region in which the notch 131 is formed is reduced in the direction in which the outside force is applied, i.e., the cross-sectional area in the direction in which the outside force is applied is locally reduced. Therefore, the notches can function as the stress concentration portions when the outside force is applied. Accordingly, when the outside force is applied to the fuse 130*a*, for example, a crack spreads in the y-axis direction from the notches 131 and the fuse 130*a* is fractured.

In the example illustrated in FIGS. 5 and 6, the fuse electrode portion 160 which is the fuse fracture portion is formed in the y-axis direction of the fuse 130*a*. Accordingly, by supplying a potential difference to the fuse 130*a* and the fuse electrode portion 160 by the same method as the method described in the foregoing [1-2. Configuration of fuse and method of fracturing fuse], an electrostatic attractive force acting in the y-axis direction is applied to the fuse 130*a*.

To confirm the advantages of the modification example, the inventors created a calculation model obtained by modeling the fuse 130*a* and calculated stress values obtained in the fuse 130*a* through simulation when a predetermined electrostatic attractive force is applied in the calculation model. In the calculation model, the length L, the width W, the width D of the fuse 130*a* were set to 210 (μm), 0.6 (μm), and 50 (μm), respectively. The depths of the notches 131 in the y-axis direction were set to 0.3 (μm). In the calculation model, when an electrostatic force with a magnitude of 80 V/6 μm was applied in the y-axis direction, it was confirmed by calculation that a stress of about the maximum 2600 (MPa) occurred in the notches 131. On the other hand, a stress value necessary to fracture the fuse 130 having the foregoing configuration was separately calculated and the stress value serving as a fracture criterion was about 1000 (MPa). Accordingly, it was confirmed that the fuse 130*a* can be sufficiently fractured by the stress occurring in the notches 131 under the foregoing conditions.

Thus, in the modification example, by installing the notches 131 which are the stress concentration portions in the partial regions of the fuse 130*a*, it is possible to generate a larger stress in the region. Thus, it is possible to fracture the fuse 130*a* more easily. In the example illustrated in FIGS. 5 and 6, the notches 131 are formed near both ends of the fuse 130*a*, i.e., are formed near each of the fixed member 110 and the movable member 120, but the modification example is not limited to this example. The positions and the number of notches 131 and the shapes of the notches 131 may be appropriately set. As described above, in the fuse 130*a*, the stress is concentrated on the regions at which the notches 131 are formed, and thus the fuse 130*a* is easily fractured in these regions. Accordingly, for example, the positions at which the notches 131 are formed can be adjusted to positions at which the fuse 130*a* is desired to be fractured. When a distribution occurs in an internal stress of the fuse 130 at the time of the fabrication of the fixed member 110, the movable member 120, and the fuse 130, the notches 131 are formed in sites at which the internal stress is larger, so that the fuse 130*a* is fractured more easily.

The shape of the stress concentration portion formed in the fuse 130*a* is not limited to the notch 131 illustrated in FIG. 6. For example, the stress concentration portion may be a thin portion 132 illustrated in FIG. 7. The thin portion 132 can be formed by processing a region that has a predetermined length in the x-axis direction in the fuse 130*a* so that the width of the region in the y-axis direction is smaller than that of the other region. As in the notch 131, the thin portion 132 functions as a stress concentration portion when an outside force is applied. However, the modification is not limited to this example. A stress concentration portion on which a stress is concentrated may be formed in a partial region of the fuse 130*a* and the stress concentration portion may have any shape.

The modification example in which the fuse has the stress concentration portions has been described above with reference to FIGS. 5 to 7 in the first embodiment. In the modification example, as described above, for example, since the stress concentration portions, such as the notches 131 or the thin portions 132, on which a stress is concentrated when an outside force is applied are formed in the partial regions of the fuse 130*a*, it is possible to fracture the fuse 130*a* more easily. When an outside force is applied, there is a high probability of the fuse 130*a* being fractured in the regions at which the stress concentration portions are formed. Therefore, by adjusting the positions at which the stress concentration portions are formed, it is possible to control the sites at which the fuse 130*a* is fractured.

(1-4-2. Modification Example in which Fuse after Fracture is Welded)

In the embodiment described above with reference to FIGS. 1 to 3, when the fuse 130 is fractured to drive the electronic device 10, the fuse 130 after the fracture has a shape similar to a pair of cantilevers each supported in the connection sites with the fixed member 110 or the movable member 120. In such a state, when the electronic device 10 is driven and the movable member 120 is moved with respect to the fixed member 110, there is a concern of the fractured surfaces of the fuse 130 coming into contact with each other. When the fractured surfaces of the fuse 130 come into contact with each other, the fixed member 110 and the movable member 120 are electrified to have substantially the same potential. Therefore, there is a probability of the electronic device 10 not being driven normally. Further, there is also a concern of the fuse 130 after the fracture being further cracked due to the contact. When the fuse 130 is further cracked, a normal operation of the electronic device 10 can be considered to be hindered due to particles which may be produced due to the crack, and thus there is a concern of reliability of the electronic device 10 deteriorating.

Thus, in the modification example, by welding the fuse 130 after the fracture to a predetermined site and fixing the fuse 130 after the fracture to a position different from the position of the fuse 130 before the fracture, the fractured surfaces of the fuse 130 are prevented from coming into re-contact with each other. A modification example in which the fuse after the fracture is welded will be described with reference to FIG. 8 in the first embodiment. The modification example corresponds to an example in which a predetermined process is added after the process of fracturing the fuse in the embodiment described with reference to FIGS. 1 to 3 and the other remaining configurations, e.g., the configurations of the fixed member 110, the movable member 120, and the fuse electrode portion 160, may be the same as the foregoing embodiment. Accordingly, in the description of the following modification, differences from the above-described embodiment will be mainly described and the detailed description of the repeated factors will be omitted.

Figure 8:
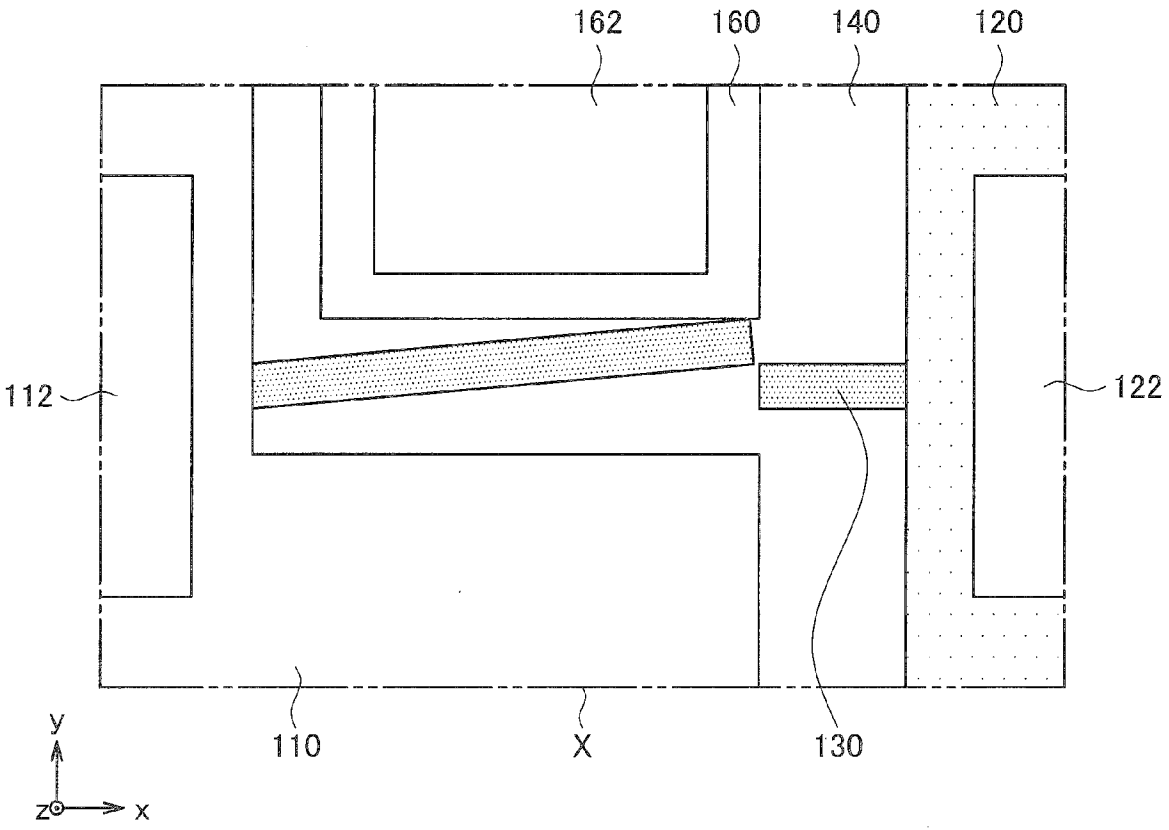
FIG. 8 is a top view illustrating a form in which the fuse after fracture is welded.

FIG. 8 is a top view illustrating a form in which the fuse after fracture is welded. FIG. 8 is a drawing corresponding to FIG. 2 described above and corresponds to an enlarged view of a region X which is a region including the fuse and the periphery of the fuse in the configuration of the electronic device according to the modification example.

Referring to FIG. 8, in the modification example, as in the embodiment described with reference to FIG. 3, the fuse 130 is fractured by supplying a predetermined potential difference between the fuse electrode portion 160 and the fuse 130 and applying an electrostatic attractive force to the fuse 130. Here, as described above, the fuse 130 after the fracture can behave as a cantilever supported in the connection site with the fixed member 110. Accordingly, even after the fuse 130 is fractured, a site corresponding to the free end of the fuse 130 after the fracture can be attracted in the direction of the fuse electrode portion 160 by continuously supplying the potential difference between the fuse electrode portion 160 and the fuse 130, as illustrated in FIG. 8.

Here, in the modification example, when the fuse 130 after the fracture is attracted to the fuse electrode portion 160, the positions at which the fuse 130 and the fuse electrode portion 160 are formed are set so that at least a partial region of the fuse 130 comes into contact with the substrate 190 forming the fuse electrode portion 160. When at least the partial region of the fuse 130, e.g., the site corresponding to the free end, comes into contact with the substrate 190 from the fuse electrode portion 160, a current flows between the fuse 130 and the substrate 190 at the same time as the contact and a contact portion with larger resistance is fused and adhered by Joule heat. Thus, in the modification example, the site corresponding to the free end of the fuse 130 after the fracture is welded to the fuse electrode portion 160, the fuse 130 after the fracture can be prevented from coming into re-contact or being broken further. Thus, a normal operation of the electronic device 10 is maintained.

In the modification example, the fuse 130 after the fracture may not necessarily come into contact with the fuse electrode portion 160. For example, by using an electric arc produced through close approach between the fuse 130 and the fuse electrode portion 160, the fuse 130 and the fuse electrode portion 160 may be welded. The potential difference applied between the fuse electrode portion 160 and the fuse 130 may have a constant value or may be appropriately changed from the time of the facture of the fuse 130 to the attraction and the welding of the fuse 130 after the fracture. The potential difference may be appropriately set according to the material of the fuse 130 and the substrate 190, the shape of the fuse 130, or the like so that the fracture and the welding of the fuse 130 can be realized. The site to which the fuse 130 after the fracture is welded is not limited to the fuse electrode portion 160. By applying the electrostatic attractive force to the fuse 130 after the fracture from another site which can be formed in the electronic device 10, the fuse 130 after the fracture may be attracted and welded to the other site.

The modification example described in the foregoing (1-4-1. Modification example in which fuse includes stress concentration portion) can also be combined with this modification example. As described above, in the fuse 130*a* including the stress concentration portion, the fracture position can be controlled by adjusting the position at which the stress concentration portion is formed. Accordingly, by appropriately adjusting the position at which the stress concentration portion is formed in the fuse 130*a*, it is possible to control the position at which the free end in the cantilever formed by the fuse 130*a* after the fracture is formed. Accordingly, since the position at which the fuse 130 after the fracture comes into contact with the fuse electrode portion 160 can be accurately predicted, it is possible to more accurately design the positions at which the fuse 130 and the fuse electrode portion 160 are formed.

The modification example in which the fuse after the fracture is welded has been described above with reference to FIG. 8 in the first embodiment. In the modification example, as described above, the partial region of the fuse 130 after the fracture is welded to another site, e.g., the fuse electrode portion 160. Accordingly, it is possible to prevent the fuse 130 after the fracture from coming into re-contact to form a leak path or from being broken further, and thus higher reliability is ensured for the driving of the electronic device 10.

(1-4-3. Modification Example in which Fuse Fracture Portion Includes Plurality of Fuse Electrode Portions)

In the embodiment described above with reference to FIGS. 1 to 3, the fuse fracture portion formed in the electronic device 10 includes one fuse electrode portion 160. However, the first embodiment is not limited to this example and the fuse fracture portion may include the plurality of fuse electrode portions 160.

A modification example in which the fuse fracture portion includes plurality of fuse electrode portions will be described with reference to FIG. 9 in the first embodiment. The modification example corresponds to an example in which the configuration of the fuse fracture portion is different in the embodiment described with reference to FIGS. 1 to 3 and the other remaining configurations, e.g., the configurations of the fixed member 110 and the movable member 120 may be the same as those of the foregoing embodiment. Accordingly, in the description of the following modification, differences from the above-described embodiment will be mainly described and the detailed description of the repeated factors will be omitted.

Figure 9:
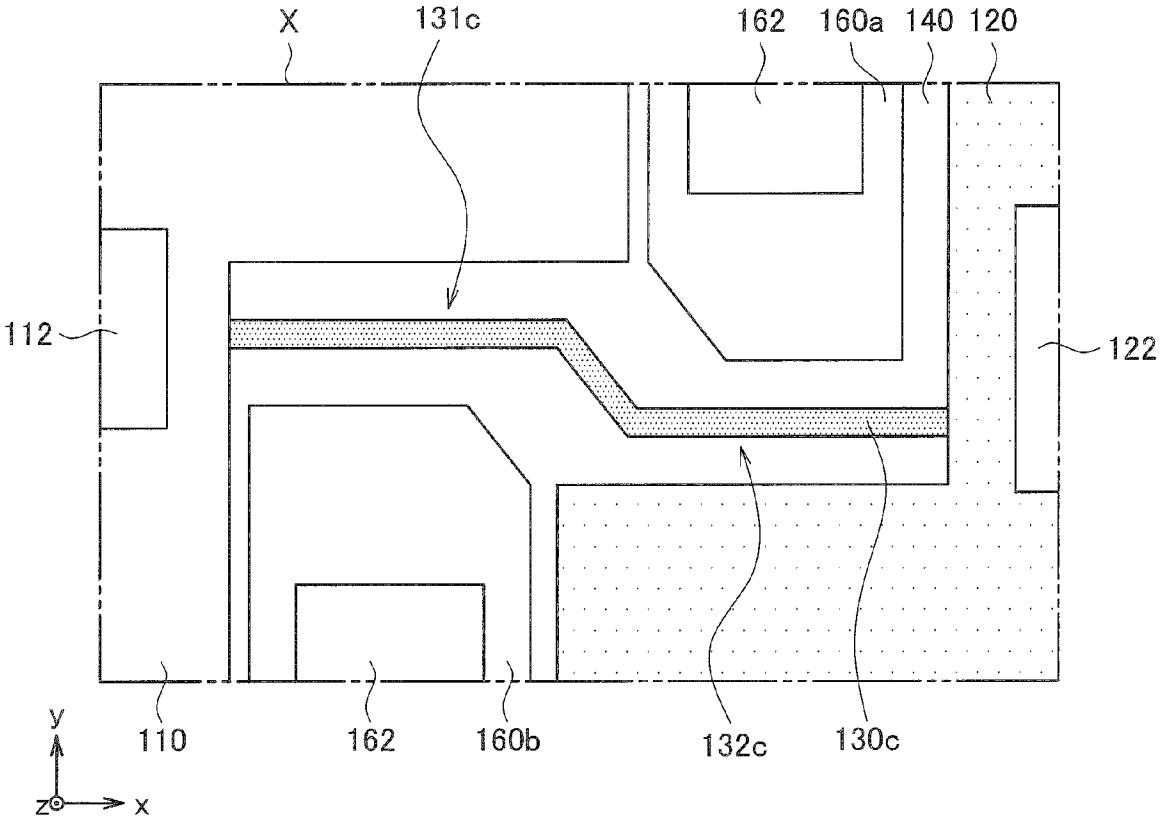
FIG. 9 is a top view illustrating an example of the configuration of an electronic device in which a fuse fracture portion includes a plurality of fuse electrode portions.

FIG. 9 is a top view illustrating an example of the configuration of an electronic device in which a fuse fracture portion includes a plurality of fuse electrode portions. FIG. 9 is a drawing corresponding to FIG. 2 described above and corresponds to an enlarged view of a region X which is a region including the fuse and the periphery of the fuse in the configuration of the electronic device according to the modification example.

Referring to FIG. 9, in the modification example, the fuse fracture portion includes a plurality of fuse electrode portions 160*a* and 160*b*. The fuse electrode portions 160*a* and 160*b* are formed in different directions with a fuse 130*c* interposed therebetween. The fuse electrode portions 160*a* and 160*b* are formed not to face each other with the fuse 130*c* interposed therebetween, i.e., are formed to face different sites of the fuse 130*c*. The fuse 130*c* electrically connects the fixed member 110 to the movable member 120 and has the same function as the fuse 130 illustrated in FIG. 1. Since the specific configuration of the fuse electrode portions 160*a* and 160*b* is the same as the configuration of the fuse electrode portion 160 illustrated in FIG. 1, the detailed description will be omitted.

In the example illustrated in FIG. 9, the fuse electrode portion 160*a* is formed to face a region 131*c* which is a region having a predetermined length in the x-axis direction from the fixed member 110 of the fuse 130*c*. For example, the fuse electrode portion 160*a* is formed to face the fuse 130*c* in the negative direction of the y axis. The fuse electrode portion 160*b* is formed to face a region 132*c* which is a region having a predetermined length in the x-axis direction from the movable member 120 of the fuse 130*c*. For example, the fuse electrode portion 160*b* is formed to face the fuse 130*c* in the positive direction of the y axis. Thus, in the example illustrated in FIG. 9, at least one fuse electrode portion 160*a* is disposed to apply an electrostatic attractive force in a first direction (the negative direction of the y axis) to a first region (the region 131*c*) of the fuse 130*c* and at least another fuse electrode portion 160*b* is disposed to apply an electrostatic attractive force in a second direction (the positive direction of the y axis) which is the opposite direction to the first direction to a second region (the region 132*c*) different from the first region of the fuse 130*c*.

In this configuration, when a predetermined potential difference is supplied between the fuse electrode portions 160*a* and 160*b*, and the fuse 130*c*, the electrostatic attractive force to attract the fuse 130*c* in the arrangement direction of the fuse electrode portion 160*a*, i.e., the negative direction of the y axis, is applied to the region 131*c* of the fuse 130*c* and the electrostatic attractive force to attract the fuse 130*c* in the arrangement direction of the fuse electrode portion 160*b*, i.e., the positive direction of the y axis, is applied to the region 132*c* of the fuse 130*c*. Thus, in the modification example, the outside force is applied to one end side and the other end side of the fuse 130*c* in the opposite directions of the direction perpendicular to the extension direction of the fuse 130*c*. Accordingly, a stress increases near substantially the center of the fuse 130*c* and the fuse 130*c* can be fractured more easily.

In the modification example, as illustrated in FIG. 9, the fuse 130*c* does not extend in a straight line in the x-axis direction, but has a bent portion bent in the x-y plane between the regions 131*c* and 132*c*. The bent portion functions as a stress concentration portion in the fuse 130*c*. Therefore, by including the bent portion, the fuse 130*c* can be fractured more easily. However, the modification example is not limited to this example. For example, the plurality of fuse electrode portions 160*a* and 160*b* may be formed in the fuse 130 having the straight shape illustrated in FIG. 1.

In the modification example, the positions at which the fuse electrode portions 160*a* and 160*b* are disposed and the number of fuse electrode portions 160*a* and 160*b* are not limited to the example illustrated in FIG. 9, but may be appropriately set. For example, the fuse electrode portions 160*a* and 160*b* are not formed in the mutually different directions with the fuse 130*c* interposed therebetween, but may be formed in the same direction (for example, the positive or negative directions of the y axis) with respect to the fuse 130*c*. More of the fuse electrode portions 160*a* and 160*b* may be formed. In the modification example, by appropriately changing the positions at which the fuse electrode portions 160*a* and 160*b* are disposed or the number of disposed fuse electrode portions 160*a* and 160*b*, the stress concentration position in the fuse 130*c*, i.e., the fracture position, may be adjusted.

The modification example in which the fuse fracture portion includes the plurality of fuse electrode portions has been described above with reference to FIG. 9 in the first embodiment. In the modification example, as described above, the fuse fracture portion includes the plurality of fuse electrode portions 160*a* and 160*b*. Therefore, when the fuse 130*c* is fractured, the outside force applied to the fuse 130*c* increases, and thus the fuse 130*c* is fractured more easily. By appropriately changing the positions at which the plurality of fuse electrode portions 160*a* and 160*b* are disposed or the number of disposed fuse electrode portions 160*a* and 160*b*, the fracture positions in the fuse 130*c* can be controlled.

(1-4-4. Modification Example in which Fuse Fracture Portion Includes Fracture Driving Portion)

In the embodiment described above with reference to FIGS. 1 to 3, the fuse fracture portion includes the fuse electrode portion 160 and the fuse 130 is fractured by the electrostatic attractive force. However, the first embodiment is not limited to this example. The fuse fracture portion may fracture the fuse 130 by applying an outside force to the fuse 130 in another configuration. In the modification example, the fuse fracture portion includes a fracture driving portion that fractures the fuse 130 by pressurizing a partial region of the fuse 130 in a predetermined direction and applying an outside force.

A modification example in which the fuse fracture portion includes fracture driving portion will be described with reference to FIG. 10 in the first embodiment. The modification example corresponds to an example in which the configuration of the fuse fracture portion is different in the embodiment described with reference to FIGS. 1 to 3 and the other remaining configurations, e.g., the configurations of the fixed member 110, the movable member 120, and the fuse fracture portion 130, may be the same as those of the foregoing embodiment. Accordingly, in the description of the following modification, differences from the above-described embodiment will be mainly described and the detailed description of the repeated factors will be omitted.

Figure 10:
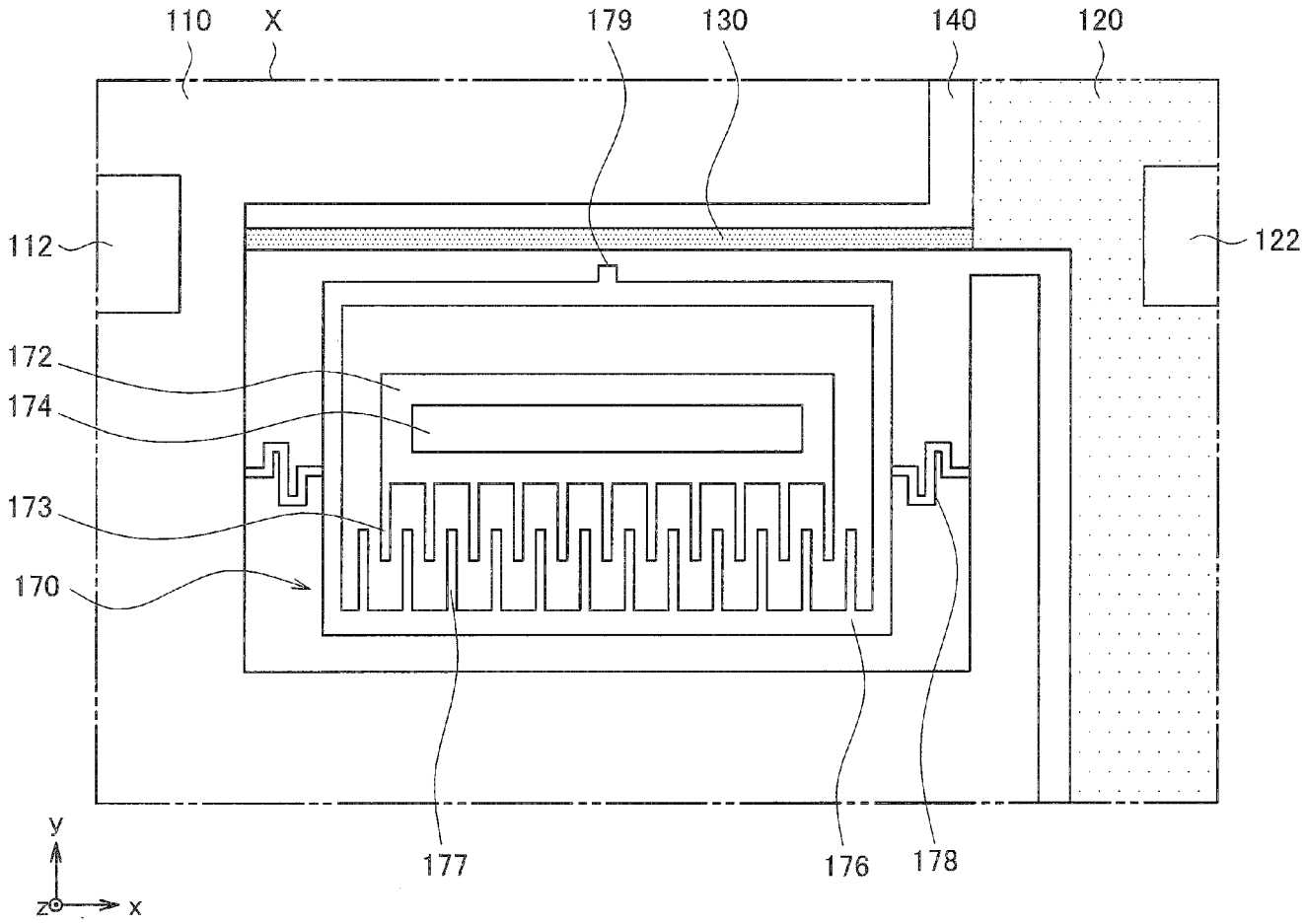
FIG. 10 is a top view illustrating an example of the configuration of an electronic device according to a modification example in which a fuse fracture portion includes a fracture driving portion.

FIG. 10 is a top view illustrating an example of the configuration of an electronic device according to a modification example in which a fuse fracture portion includes a fracture driving portion. FIG. 10 is a drawing corresponding to FIG. 2 described above and corresponds to an enlarged view of a region X which is a region including the fuse and the periphery of the fuse in the configuration of the electronic device according to the modification example. Referring to FIG. 10, in the modification example, the fuse fracture portion includes a fracture driving portion 170. The fracture driving portion 170 is formed to face the fuse 130 in the negative direction of the y axis.

The configuration of the fracture driving portion 170 will be described in detail. The fracture driving portion 170 may be an electrostatic bulk MEMS formed by processing the substrate 190. The fracture driving portion 170 includes a fracture fixed member 172 and a fracture movable member 176.

The fracture fixed member 172 is a member that is formed by processing the Si layer 193 of the upper layer of the substrate 190 and is fixed without being moved when the fracture driving portion 170 is driven, as in the fixed member 110. For example, a plurality of fracture fixed electrodes 173 protruding in the y-axis direction are formed in partial regions of the fracture fixed member 172. A fracture driving wiring 174 for applying a predetermined voltage to the fracture fixed member 172 is formed in a partial region of the surface of the fracture fixed member 172. The fracture driving wiring 174 corresponds to the electrode portion 112 of the fixed member 110. The fracture driving wiring 174 is electrically connected to the substrate 190 forming the fracture fixed member 172 via, for example, a contact hole (not illustrated), and thus can control a voltage of the fracture fixed member 712 by supplying the predetermined voltage to the fracture driving wiring 174.

The fracture movable member 176 is formed by processing the Si layer 193 of the upper layer of the substrate 190 and is configured to be relatively movable with respect to the fracture fixed member 172 when the fracture driving portion 170 is driven, as in the movable member 120. For example, a plurality of fracture movable electrodes 177 protruding in the y-axis direction are formed in partial regions of the fracture movable member 76 to face the fracture fixed electrodes 173. A partial region of the fracture movable member 176 is connected to the fixed member 110 by a spring 178. The spring 178 provides a force of restitution returning the fracture movable member 176 to the original position with respect to the fracture movable member 176 when the fracture movable member 176 is moved. Further, a protrusion portion 179 protruding toward the fuse 130 is formed in a partial region of the site facing the fuse 130 of the fracture movable member 176.

The fracture driving portion 170 is an electrostatic MEMS that is driven by an electrostatic force and is driven when a predetermined voltage is applied to the fracture driving wiring 174. Specifically, in the example illustrated in FIG. 10, by applying the predetermined voltage to the fracture driving wiring 174, the fracture movable member 176 is moved in the positive direction of the y axis. When the fracture movable member 176 is moved in the positive direction of the y axis, the protrusion portion 179 comes into contact with the fuse 130 from the negative direction of the y axis and the fuse 130 is pressed and bent by the driving force of the fracture driving portion 170.

In the method of fracturing the fuse 130 by the above-described electrostatic attractive force, the electrostatic attractive force is applied as a distribution load distributed in the x-axis direction to the fuse 130. Therefore, there is a probability of a relatively large outside force being necessary to facture the fuse 130. On the other hand, in the modification example, when the protrusion portion 179 comes into direct contact with and pressurizes the fuse 130, the outside force is applied. Therefore, the concentrated load on the contact site with the protrusion portion 179 is applied to the fuse 130. Accordingly, the stress is concentrated on the contact site, and thus the fuse 130 can be fractured more easily. By adjusting the position at which the protrusion portion 179 is formed in the fracture movable member 176, i.e., the position of the contact site between the protrusion portion 179 and the fuse 130, it is possible to control the fracture position of the fuse 130. Using the electrostatic MEMS as the fracture driving portion 170, for example, a displacement amount of the fracture movable member 176 is increased by forming the configuration of the fracture fixed electrodes 173 and the fracture movable electrodes 177 in a comb-shaped form, or the driving force is adjusted by changing the electrode areas of the fracture fixed electrodes 173 and the fracture movable electrodes 177. In this way, various design methods and control methods used in a general electrostatic MEMS can be applied. Thus, the fracture driving portion 170 can be designed more appropriately.

In the example illustrated in FIG. 10, the case in which the fracture driving portion 170 is the electrostatic MEMS has been described, but the modification example is not limited to this example. The fracture driving portion 170 may be configured to be driven to pressurize the fuse 130 in a predetermined direction and fracture the fuse 130 and any of the various known MEMSs may be applied as the fracture driving portion 170. For example, the method of driving the fracture driving portion 170 is not limited to the method by the electrostatic force, but may be a method of using an electromagnetic force or heat.

Figure 11:
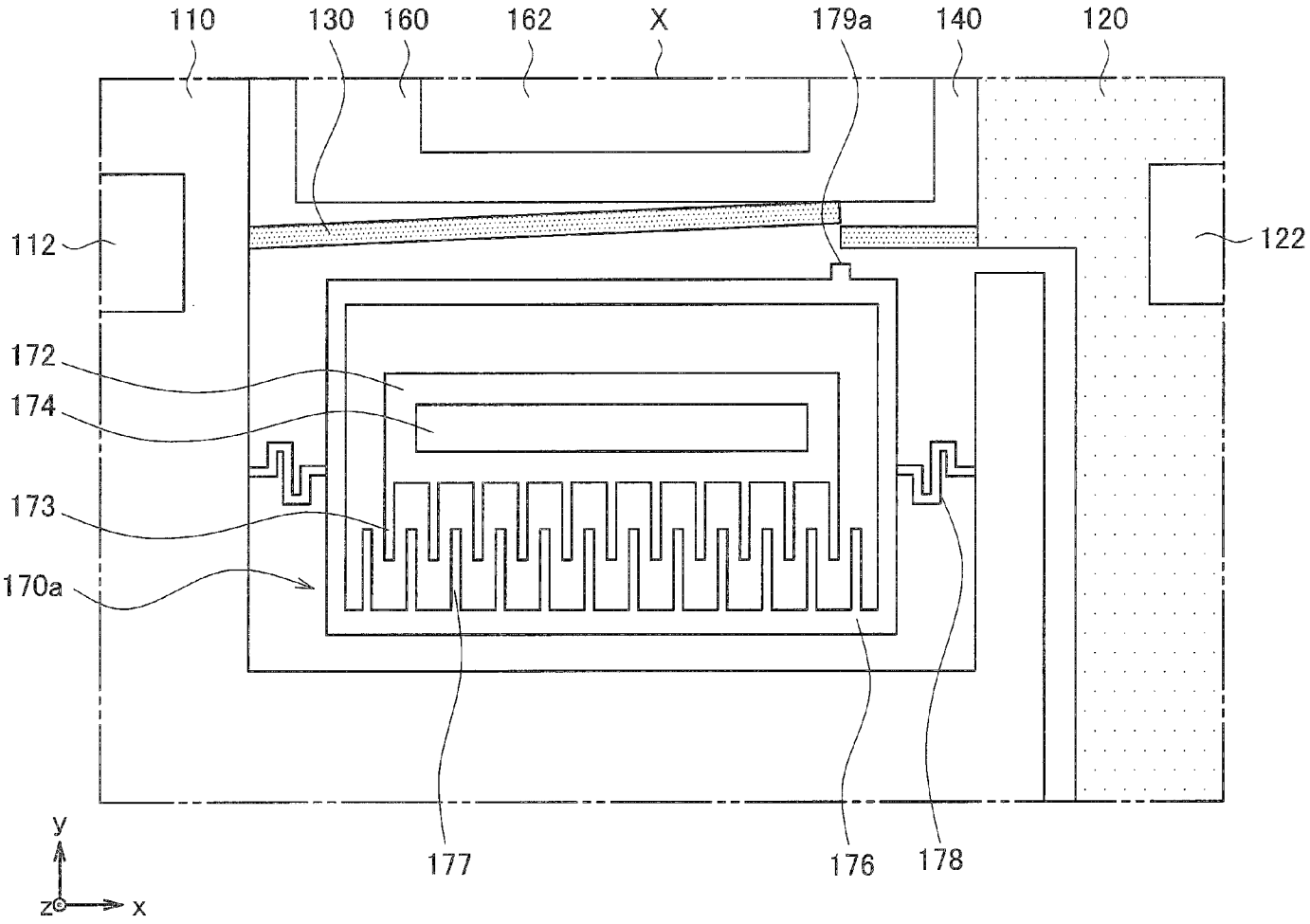
FIG. 11 is a top view illustrating an example of the configuration of an electronic device according to a modification example in which a modification example in which a fuse fracture portion includes a fracture driving portion and a modification example in which a fuse after fracture is welded are combined.

Here, the modification example described in the foregoing (1-4-2. Modification example in which fuse after fracture is welded) can also be combined with this modification example. A modification example in which the modification example in which the fuse fracture portion includes the fracture driving portion and the modification example in which the fuse after the fracture is welded are combined will be described with reference to FIG. 11. FIG. 11 is a top view illustrating an example of the configuration of an electronic device according to a modification example in which the modification example in which the fuse fracture portion includes the fracture driving portion and the modification example in which a fuse after fracture is welded are combined. FIG. 11 is a drawing corresponding to FIG. 2 described above and corresponds to an enlarged view of a region X which is a region including the fuse and the periphery of the fuse in the configuration of the electronic device according to the modification example.

Referring to FIG. 11, in the modification example, the fuse fracture portion includes a fuse electrode portion 160 and a fracture driving portion 170*a*. Specifically, in the modification example, as illustrated in FIG. 11, the fracture driving portion 170*a* and the fuse electrode portion 160 are formed at positions facing each other with the fuse 130 interposed therebetween. Since the fracture driving portion 170*a* corresponds to a change in the position at which the protrusion portion 179 is formed with respect to the fracture driving portion 170 illustrated in FIG. 10 and the remaining configuration is the same as that of the fracture driving portion 170, the description of the detailed configuration will be omitted. A protrusion portion 179*a* of the fracture driving portion 170*a* according to the modification example is formed to face the fuse 130 at a position shifted from the vicinity of substantially the center of the fuse 130 in the x-axis direction. In the example illustrated in FIG. 11, the protrusion portion 179*a* is formed to face the fuse 130 at a position closer to the movable member 120 in the x-axis direction of the fuse 130. When the fracture driving portion 170*a* is driven, the fuse 130 is fractured at the position corresponding to the position at which the protrusion portion 179*a* is formed. However, the position at which the protrusion portion 179*a* is formed in the fracture driving portion 170*a* is not limited to the illustrated example, but may be appropriately set in consideration of a contact site with the fuse 130, i.e., a stress concentration site when the fuse 130 is fractured.

In the modification example, as in the method described with reference to FIG. 10, by driving the fracture driving portion 170*a*, the fuse 130 is pressurized by the protrusion portion 179*a* and the fuse 130 is fractured. Then, after the fuse 130 is fractured, a predetermined potential difference is supplied between the fuse 130 and the fuse electrode portion 160. Accordingly, a site corresponding to the free end of the cantilever of the fractured fuse 130 can be attracted to the fuse electrode portion 160 by the electrostatic attractive force and is welded to the fuse electrode portion 160. By welding the fuse 130 after the fracture to the fuse electrode portion 160, it is possible to prevent a leak path from being formed due to re-contact of the fuse after the fracture or prevent the fuse after fracture from being broken further. Accordingly, more reliable driving of the electronic device 10 is ensured.

In the modification example, when the fuse 130 is fractured, the fracture driving portion 170*a* may be driven and a predetermined potential difference may be supplied between the fuse 130 and the fuse electrode portion 160. Thus, since a bending stress by the pressurization force of the protrusion portion 179*a* and a bending stress by the electrostatic attractive force are applied together, the fuse 130 is fractured more easily. In the modification example, when the fuse 130 after the fracture is welded to the fuse electrode portion 160, the fuse 130 after the fracture may be pressurized by the protrusion portion 179*a* by supplying the predetermined potential difference between the fuse 130 and the fuse electrode portion 160 and driving the fracture driving portion 170. Thus, since the electrostatic attractive force and the pressurization force by the protrusion portion 179 are applied together to the fuse 130 after the fracture, the fuse 130 after the fracture is attracted and welded to the fuse electrode portion 160 more reliably.

The modification example in which the fuse fracture portion includes the fracture driving portion has been described above with reference to FIG. 10 in the first embodiment. In the modification example, as described above, the fuse fracture portion includes the fracture driving portion 170 which is, for example, an electrostatic MEMS. By driving the fracture driving portion 170 and bringing the protrusion portion 179 into direct contact with and pressurizing the fuse 130, the fuse 130 is fractured. Since the concentrated load is applied to the contact site of the fuse 130 with the protrusion portion 179, the fuse 130 is fractured more easily. By changing the position at which the protrusion portion 179 is formed, it is possible to control the fracture position of the fuse 130.

The modification example in which the modification example in which the fuse fracture portion includes the fracture driving portion and the modification example in which the fuse after the fracture is welded are combined has been described with reference to FIG. 11. In the modification example, since the fuse 130 after the fracture is welded to the fuse electrode portion 160, it is possible to prevent the fuse 130 from coming into re-contact or prevent the fuse 130 from being broken further. Thus, the more reliable driving of the electronic device 10 is ensured. In the modification example, when the fuse 130 is fractured and/or the fuse 130 is welded, the electrostatic force by the fuse electrode portion 160 and the pressurization force by the protrusion portion 179*a* at the time of the driving of the fracture driving portion 170*a* may be applied together to the fuse 130. Thus, the fuse 130 can be fractured more easily. The fuse 130 after the fracture and the fuse electrode portion 160 can be welded more reliably.

(1-4-5. Modification Example in which Fuse is Fractured by Lorentz Force)

In the embodiment described above with reference to FIGS. 1 to 3, the fuse fracture portion includes the fuse electrode portion 160 and the fuse 130 is fractured by the electrostatic attractive force. In the foregoing (1-4-4. Modification example in which fuse fracture portion includes fracture driving portion), the modification example in which the fuse fracture portion includes the fracture driving portion 170 has been described as another method of fracturing the fuse 130. However, the first embodiment is not limited to this example, but the fuse 130 may be fractured by supplying an outside force in another configuration. In the modification example, by applying a predetermined current to the fuse 130 and applying a magnetic field to the fuse 130 in this state, the fuse 130 is fractured by a bending stress caused by the Lorentz force generated in the fuse 130.

A modification example in which the fuse is fractured by Lorentz force will be described with reference to FIGS. 12 to 15B in the first embodiment. The modification example corresponds to an example in which the configuration for fracturing the fuse is different in the embodiment described with reference to FIGS. 1 to 3 and the other remaining configurations, e.g., the configurations of the fixed member 110, the movable member 120, and the fuse fracture portion 130, may be the same as those of the foregoing embodiment. Accordingly, in the description of the following modification, differences from the above-described embodiment will be mainly described and the detailed description of the repeated factors will be omitted.

Figure 12:
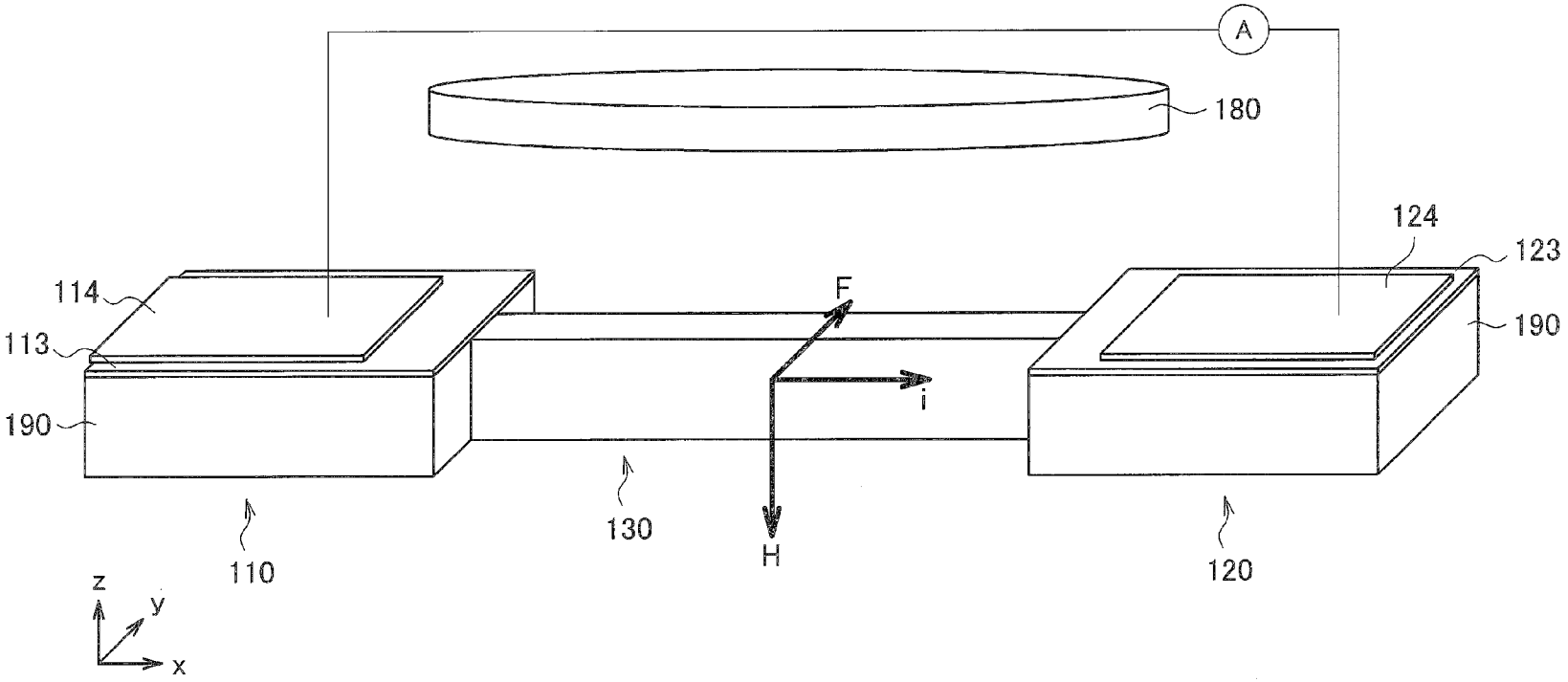
FIG. 12 is an explanatory diagram of a modification example in which a fuse is fractured by a Lorentz force.

FIG. 12 is an explanatory diagram of a modification example in which a fuse is fractured by the Lorentz force. In FIG. 12 and FIGS. 13, 14, 15A, and 15B to be described below, the configuration corresponding to the electrode portion 112 of the fixed member 110, the electrode portion 122 of the movable member 120, and the fuse 130 are extracted from the configuration illustrated in FIG. 1 for simplicity and such a configuration is illustrated simply.

In the modification example, the fuse fracture portion may not be formed in the electronic device 10. In the modification example, by applying a current and a magnetic field from the outside of the electronic device 10 to the fuse 130, the Lorentz force is generated in the fuse 130 and the fuse 130 is fractured by a bending stress caused by the Lorentz force.

A method of fracturing the fuse 130 in the modification example will be described in detail with reference to FIG. 12. In the modification example, as illustrated in FIG. 12, when the fuse 130 is fractured, a current with a predetermined value is applied between the electrode portion 112 of the fixed member 110 and the electrode portion 122 of the movable member 120. Thus, inside the fuse 130, the current flows in the x-axis direction. The magnetic field with a predetermined magnitude is applied to the fuse 130 in the z-axis direction. The magnetic field can be applied, for example, by disposing a magnet 180 in the z-axis direction of the fuse 130. The configuration in which the magnetic field is applied to the fuse 130 is not limited to this example, but any of the various known configurations in which a magnetic field can be generated may be used. For example, a coil (electromagnet) or the like may be used instead of the magnet 180.

When a current i is applied to the fuse 130 in the x-axis direction and a magnetic field H is applied in the z-axis direction, the Lorentz force F acting in the y-axis direction is generated in the fuse 130. In FIG. 12, the directions of the current i, the magnetic field H, and the Lorentz force F in the fuse 130 are indicated schematically by arrows. By generating the Lorentz force F in the fuse 130, the bending stress is caused in the fuse 130 in the y-axis direction and the fuse 130 can thus be fractured in the y-axis direction. The magnitudes of the current i and the magnetic field H to be applied can be appropriately adjusted so that the Lorentz force sufficient to fracture the fuse 130 is generated.

Thus, in the modification example, the fuse 130 is fractured using the Lorentz force by applying the current and the magnetic field from the outside of the electronic device 10 to the fuse 130. In the modification example, since it is not necessary to form the fuse fracture portion (for example, the fuse electrode portion 160 or the fracture driving portion 170 described above) in the electronic device 10, it is possible to further miniaturize the electronic device 10.

Figure 13:
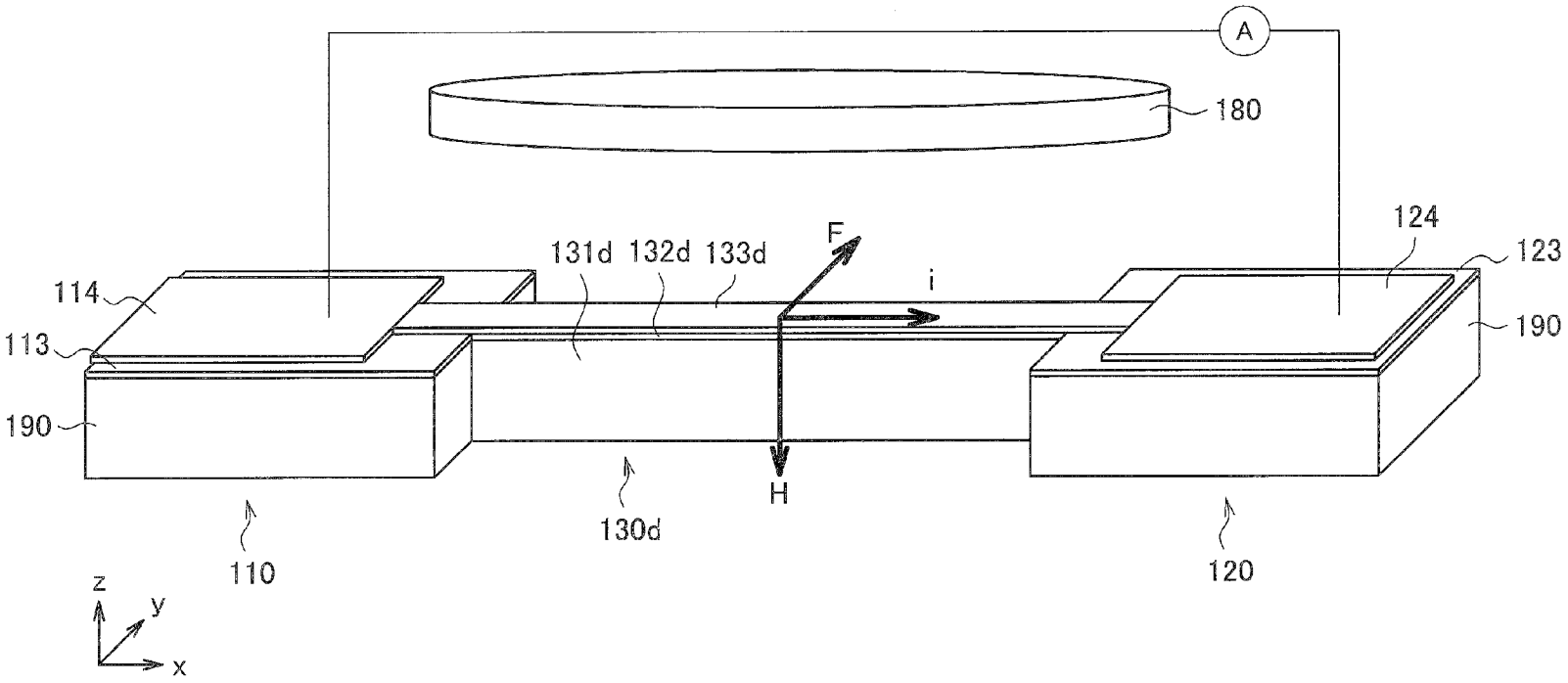
FIG. 13 is an explanatory diagram of a modification example in which a fuse includes a wiring layer and the fuse is fractured by a Lorentz force.
Figure 14:
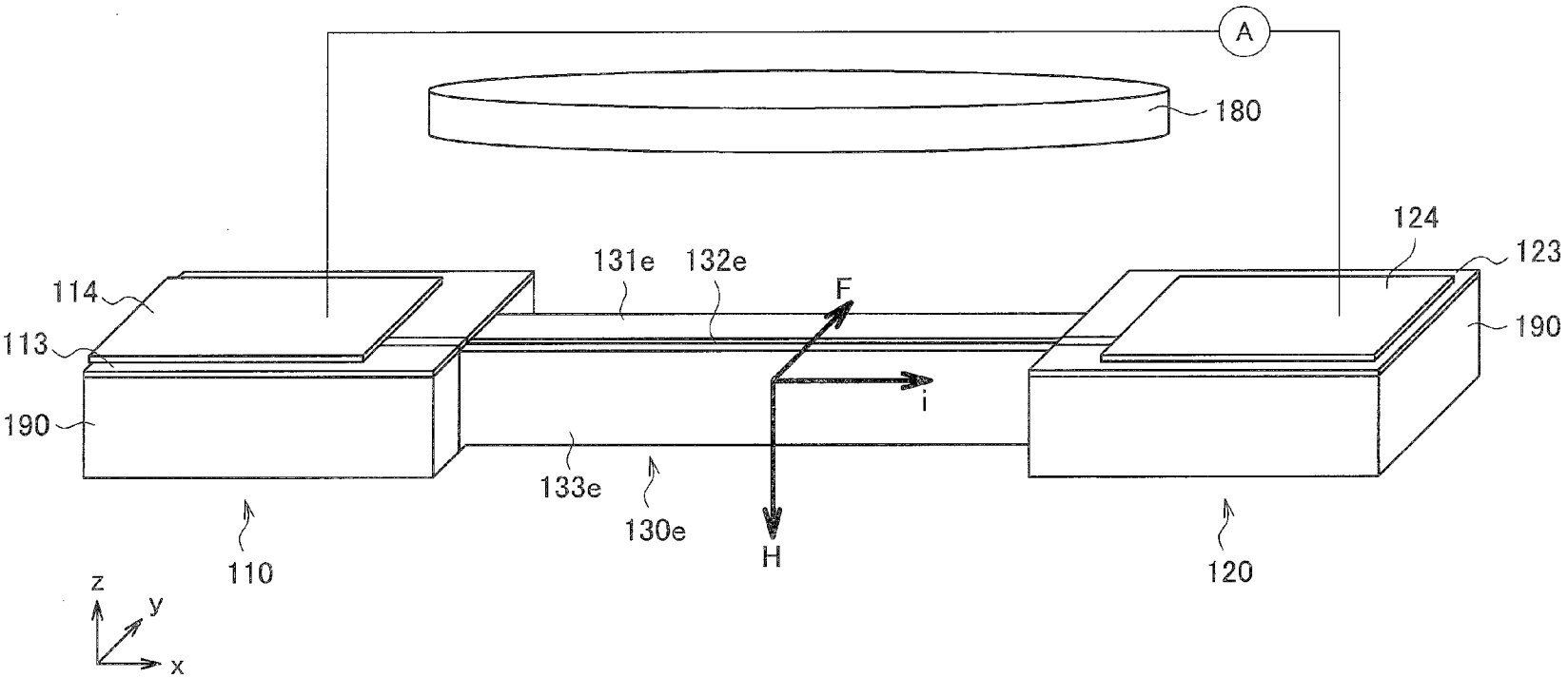
FIG. 14 is an explanatory diagram of a modification example in which a fuse includes a wiring layer and the fuse is fractured by a Lorentz force.

In the first embodiment, a wiring layer formed of a conductor may be formed on the surface of the fuse 130. The modification example is also applicable to the fuse in which such a wiring layer is formed. A modification example in which the fuse includes the wiring layer and the fuse is fractured by the Lorentz force will be described with reference to FIGS. 13 and 14. FIGS. 13 and 14 are explanatory diagrams of a modification example in which the fuse includes the wiring layer and the fuse is fractured by the Lorentz force.

Referring to FIG. 13, a fuse 130*d* has a configuration in which an insulation film layer 132*d* and a wiring layer 133*d* formed of a conductive material are sequentially stacked on the upper surface of a fuse substrate 131*d* formed by processing the substrate 190. Referring to FIG. 14, a fuse 130*e* has a configuration in which an insulation film layer 132*e* and a wiring layer 133*e* formed of a conductive material are sequentially stacked on a side surface (which is a surface parallel to the x-z plane) of a fuse substrate 131*e* formed by processing the substrate 190. The wiring layer 133*d* and the wiring layer 133*e* are electrically connected to the wiring layer 114 of the electrode portion 112 of the fixed member 110 and the wiring layer 124 of the electrode portion 122 of the movable member 120.

In the fuses 130*d* and 130*e*, as in the fuse 130 illustrated in FIG. 12, a current i is applied in the x-axis direction and a magnetic field H is applied in the z-axis direction, so that the Lorentz force F acting in the y-axis direction is also generated. The fuses 130*d* and 130*e* are fractured by a bending stress caused by the Lorentz force F. However, in the fuses 130*d* and 130*e*, the Lorentz force F can be generated in both the fuse substrates 131*d* and 131*e* and the wiring layers 133*d* and 133*e*. By forming the wiring layers 133*d* and 133*e*, the magnitude of the current i can be increased by further reducing the resistance of the fuses 130*d* and 130*e*. Therefore, the magnitude of the Lorentz force F can be further increased, and the fuses 130*d* and 130*e* are fractured more easily. The specific configurations of the fuses 130*d* and 130*e*, e.g., the presence or absence of the wiring layers or the layout of the wiring layers, are not limited to the illustrated examples, but may be appropriately selected in consideration of a relation with the other constituent members.

Figure 15A:
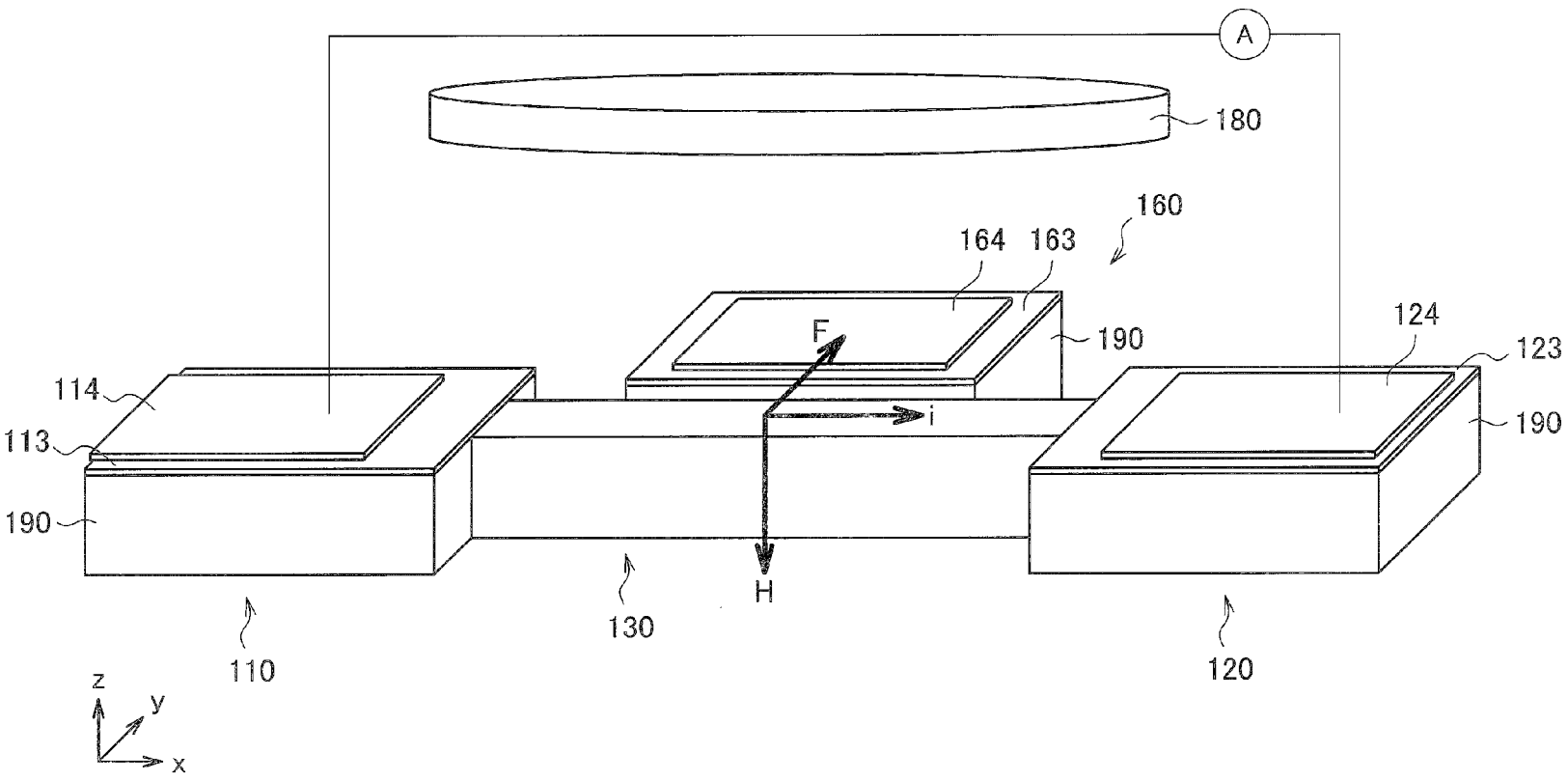
FIG. 15A is an explanatory diagram of a modification example in which a modification example in which a fuse is fractured by a Lorentz force and a modification example in which the fuse after fracture is welded are combined.
Figure 15B:
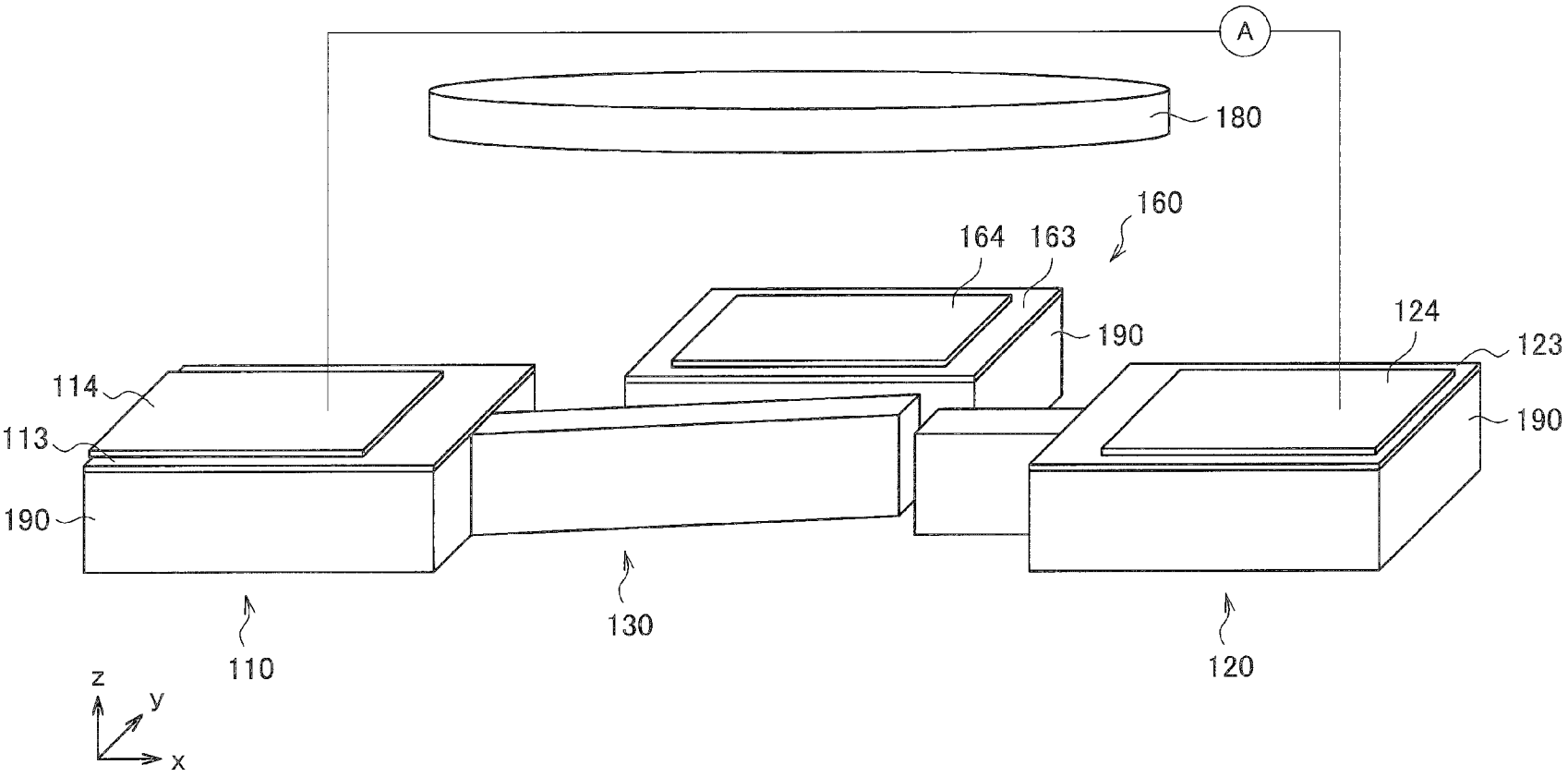
FIG. 15B is an explanatory diagram of a modification example in which a modification example in which a fuse is fractured by a Lorentz force and a modification example in which the fuse after fracture is welded are combined.

Here, the modification example described in the foregoing (1-4-2. Modification example in which fuse after fracture is welded) can also be combined with this modification example. A modification example in which the modification example in which the fuse is fractured by the Lorentz force and the modification example in which the fuse after the fracture is welded are combined will be described with reference to FIGS. 15A and 15B. FIGS. 15A and 15B are explanatory diagrams of the modification example in which the modification example in which the fuse is fractured by the Lorentz force and the modification example in which the fuse after fracture is welded are combined.

Referring to FIGS. 15A and 15B, in the modification example, the fuse electrode portion 160 is formed to face the fuse 130 in a direction in which the Lorentz force F acts on the fuse 130. The fuse electrode portion 160 may have the same configuration described with reference to FIG. 1. In FIGS. 15A and 15B, a part of the fuse electrode portion 160 is illustrated simply.

FIG. 15A illustrates a form before the fuse 130 is fractured in the modification example. As in the method described with reference to FIG. 12, the Lorentz force F acting on the fuse 130 in the y-axis direction is generated by applying a current i to the fuse 130 in the x-axis direction and applying a magnetic field H in the z-axis direction. The fuse 130 is fractured in the y-axis direction by a bending stress caused by the Lorentz force F.

FIG. 15B illustrates a form after the fuse 130 is fractured in the modification example. In this embodiment, after the fuse 130 is fractured, a predetermined potential difference is supplied between the fuse 130 and the fuse electrode portion 160. Accordingly, a site corresponding to the free end of the cantilever of the fractured fuse 130 can be attracted to the fuse electrode portion 160 by the electrostatic attractive force and is welded to the fuse electrode portion 160. By welding the fuse 130 after the fracture to the fuse electrode portion 160, it is possible to prevent a leak path from being formed due to re-contact of the fuse after the fracture or prevent the fuse after fracture from being broken further. Accordingly, more reliable driving of the electronic device 10 is ensured.

In the modification example, when the fuse 130 is fractured, the current i and the magnetic field H may be applied to the fuse 130 and a predetermined potential difference may be supplied between the fuse 130 and the fuse electrode portion 160. Thus, since the bending stress caused by the electrostatic attractive force and the bending stress caused by the Lorentz force F are applied together to the fuse 130, the fuse 130 is fractured more easily. In the modification example, when the fuse 130 after the fracture is welded to the fuse electrode portion 160, a predetermined potential difference may be supplied between the fuse 130 and the fuse electrode portion 160 and the current i and the magnetic field H may be applied to the fuse 130. Thus, since the electrostatic attractive force and the Lorentz force F are applied together to the fuse 130 after the fracture, the fuse 130 after the fracture is attracted and welded to the fuse electrode portion 160 more reliably.

The modification example in which the fuse 130 is fractured by the Lorentz force has been described above with reference to FIGS. 12 to 14 in the first embodiment. In the modification example, as described above, the Lorentz force F acting on the fuse 130 in the y-axis direction is generated by applying the current i to the fuse 130 in the x-axis direction and applying the magnetic field H in the z-axis direction. Further, the fuse 130 is fractured in the y-axis direction by the bending stress caused by the Lorentz force F. In the modification example, since it is not necessary to form the mechanism (for example, the fuse electrode portion 160 or the fracture driving portion 170 described above) fracturing the fuse in the electronic device 10, it is possible to further miniaturize the electronic device 10.

The modification example in which the modification example in which the fuse 130 is fractured by the Lorentz force and the modification example in which the fuse 130 after the fracture is welded are combined has been described with reference to FIGS. 15A and 15B. In the modification example, since the fuse 130 after the fracture is welded to the fuse electrode portion 160, it is possible to prevent the fuse 130 after the fracture from coming into re-contact or prevent the fuse 130 from being broken further. Thus, the more reliable driving of the electronic device 10 is ensured. In the modification example, when the fuse 130 is fractured and/or the fuse 130 is welded, the electrostatic force by the fuse electrode portion 160 and the Lorentz force may be applied together to the fuse 130. Thus, the fuse 130 can be fractured more easily. The fuse 130 after the fracture and the fuse electrode portion 160 can be welded more reliably.

(1-4-6. Modification Example in which Fuse is Fractured by Vibration)

In the embodiment described with reference to FIGS. 1 to 3, the fuse fracture portion includes the fuse electrode portion 160 and the fuse 130 is fractured by supplying the predetermined potential difference between the fuse 130 and the fuse electrode portion 160 and applying the electrostatic attractive force with the substantially constant magnitude to the fuse 130. However, the first embodiment is not limited to this example, but the fuse 130 may be fractured by periodically changing a force to be applied to the fuse 130 and vibrating the fuse 130.

A modification example in which the fuse is fractured by the vibration will be described with reference to FIG. 16 in the first embodiment. The modification example corresponds to an example in which the value of the potential difference supplied between the fuse 130 and the fuse electrode portion 160 is changed periodically in the embodiment described with reference to FIGS. 1 to 3 and the other remaining configurations, e.g., the configurations of the fixed member 110, the movable member 120, and the fuse electrode portion 160, may be the same as those of the foregoing embodiment. Accordingly, in the description of the following modification, differences from the above-described embodiment will be mainly described and the detailed description of the repeated factors will be omitted.

In the above-described embodiment, as described with reference to FIG. 3, for example, the electrostatic attractive force acting in the attraction direction of the fuse 130 to the fuse electrode portion 160 has been applied to the fuse 130 by the potential difference Vs generated by supplying the potential of 0 (V) to the fixed member 110 and the movable member 120 and applying the predetermined voltage (for example, 80 (V)) to the fuse electrode portion 160. On the other hand, in the modification example, the voltage supplied to the fuse electrode portion 160 is changed at a predetermined period when the potential of 0 (V) is supplied to the fixed member 110 and the movable member 120 in the configuration illustrated in FIGS. 1 to 3. Accordingly, the electrostatic force applied to the fuse 130 is also changed periodically, and thus the fuse 130 can be vibrated. By vibrating the fuse 130, the stress is repeatedly applied to the fuse 130, and thus the fracture of the fuse 130 is further accelerated.

Here, it is preferable that a change period of the voltage supplied to the fuse electrode portion 160 be substantially the same as the natural frequency of the fuse 130. When the change period of the voltage supplied to the fuse electrode portion 160, i.e., the change period of the electrostatic force applied to the fuse 130, is substantially the same as the natural frequency of the fuse 130, the fuse 130 resonates and its amplitude increases. As a result, a large bending stress is caused in the fuse 130, and thus the fuse 130 is fractured more easily.

The natural frequency f of the fuse 130 can be calculated by the following expression (1), for example, when the fuse 130 is considered as a both-end support beam.

$$f = \frac{\lambda^2}{2\pi l^2}\sqrt{\frac{EI}{\rho A}} \quad (1)$$

Here, λ is a coefficient called a frequency coefficient and is a coefficient of which a value is decided, for example, according to the shape of a beam serving as a calculation model. E is a modulus of longitudinal elasticity, I is a second moment of area, ρ is a specific gravity, and A is a cross-sectional area.

Figure 16:
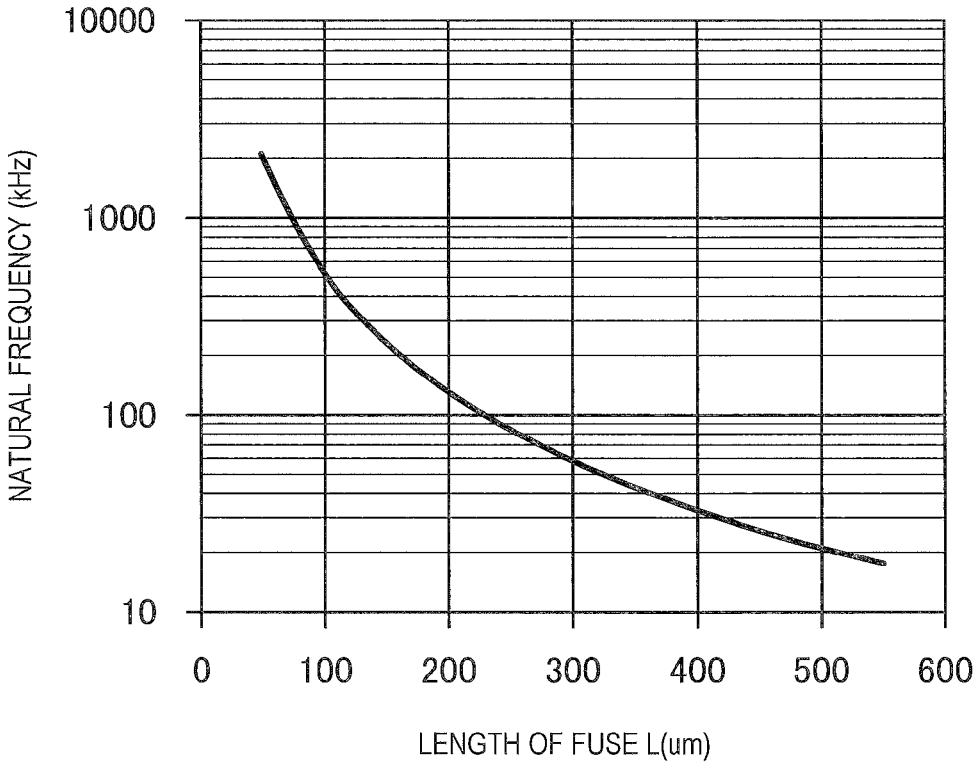
FIG. 16 is a graph illustrating a relation between a length L and a natural frequency f of the fuse.

For example, when the width W of the fuse 130 is set to 0.6 (μm), the width D of the fuse 130 in the z-axis direction is 50 (μm), and a relation between the length L and the natural frequency f of the fuse 130 is illustrated in FIG. 16. FIG. 16 is a graph illustrating the relation between the length L and the natural frequency f of the fuse 130. In FIG. 16, the horizontal axis represents the length L of the fuse 130 and the vertical axis represents the natural frequency f of the fuse 130, and the relation between the length L and the natural frequency f is plotted.

FIG. 16 shows dependency of the natural frequency of the fuse 130 on the length L. Thus, the shape dependency of the natural frequency of the fuse 130 can be obtained using the foregoing expression (1). The fuse 130 can be resonated by calculating the natural frequency of the fuse 130 from the shape of the fuse 130 and changing the voltage to be supplied to the fuse electrode portion 160 at a period corresponding to the natural frequency. For example, when the length L of the fuse 130 is 200 (μm), the natural frequency of about 130 (kHz) is calculated from FIG. 16. Accordingly, the fuse 130 can be resonated by changing the voltage to be supplied to the fuse electrode portion 160 at the period of about 130 (kHz).

The modification example in which the fuse 130 is fractured by the vibration has been described above with reference to FIG. 16 in the first embodiment. In the modification example, as described above, the electrostatic force applied to the fuse 130 is changed periodically by changing the voltage to be supplied to the fuse electrode portion 160 at the predetermined frequency. Accordingly, the stress is repeatedly supplied to the fuse 130, and thus the fracture of the fuse 130 is further accelerated. In the modification example, control may be performed such that the change period of the voltage supplied to the fuse electrode portion 160 is substantially the same as the natural frequency of the fuse 130. By allowing the change period of the voltage supplied to the fuse electrode portion 160 to be substantially the same as the natural frequency of the fuse 130, the fuse 130 is resonated, and thus the fuse 130 is fractured more easily.

(1-4-7. Modification Example in which Fracture Surface of Fuse is Parallel to Cleavage Surface of Substrate)

In the first embodiment, as described with reference to FIGS. 1 to 3, the fuse 130 is formed to include at least a part of the substrate 190. In the modification example, the fuse 130 is fractured more easily by forming the fuse 130 so that the fracture surface of the fuse 130 and the cleavage surface of the substrate 190 are parallel to each other.

A modification example in which the fracture surface of the fuse and the cleavage surface of the substrate are parallel to each other will be described with reference to FIGS. 17, 18A, and 18B in the first embodiment. The modification example corresponds to an example in which the direction in which the fuse 130 and the other constituent members are formed with respect to the substrate 190 is adjusted in the embodiment described with reference to FIGS. 1 to 3, and the specific configurations of the constituent members, e.g., the fixed member 110, the movable member 120, the fuse 130, and the fuse electrode portion 160, may be the same as those of the above-described embodiment. Accordingly, in the description of the following modification, differences from the above-described embodiment will be mainly described and the detailed description of the repeated factors will be omitted.

Figure 17:
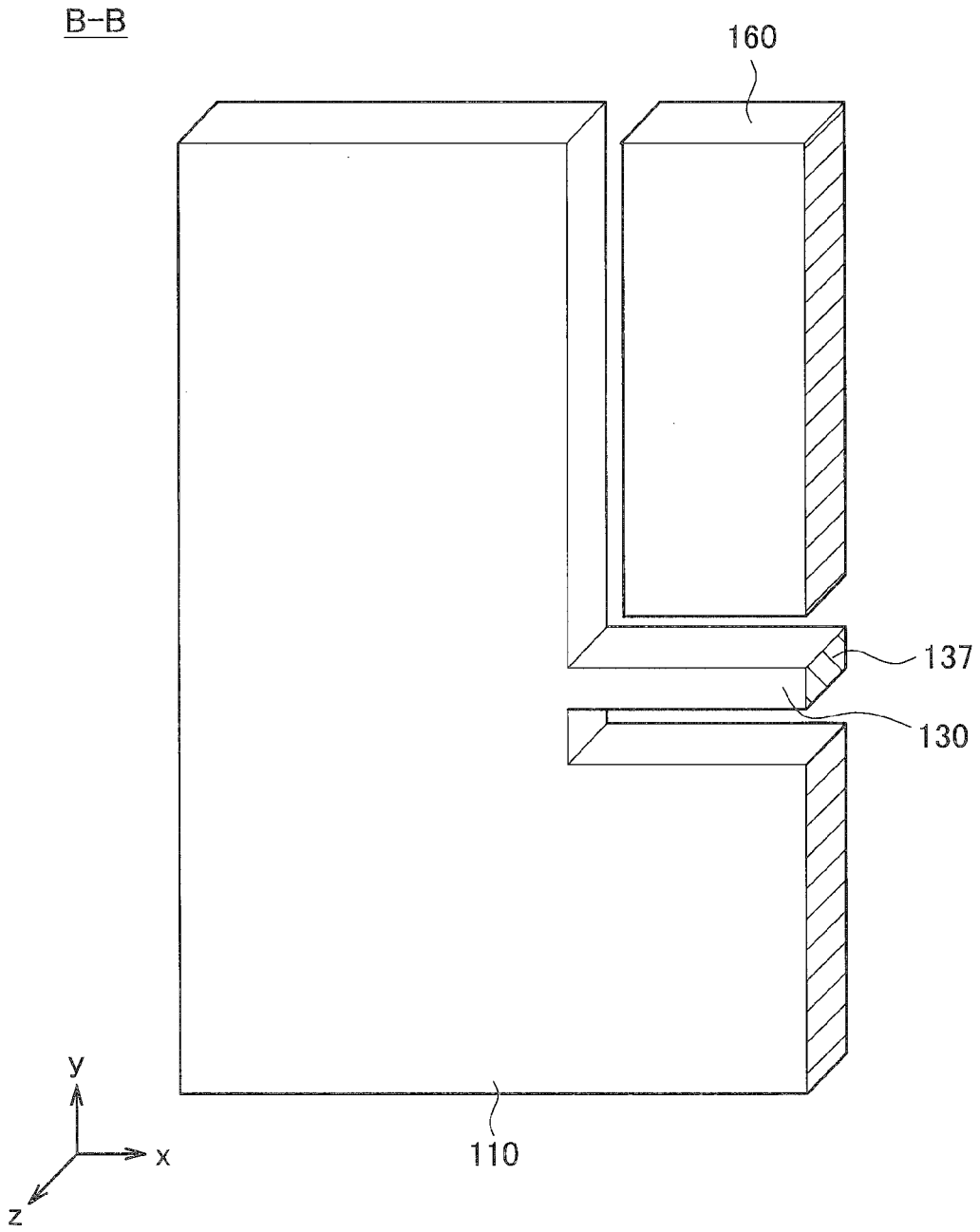
FIG. 17 is a perspective view illustrating the electronic device taken along the line B-B of FIG. 3.

FIG. 17 is a perspective view illustrating the electronic device 10 taken along the line B-B of FIG. 3. For example, in the case of the configuration illustrated in FIG. 3, the electrostatic attractive force is applied to the fuse 130 in the y-axis direction and the fuse 130 is fractured. Therefore, a fracture surface 137 can be a surface substantially parallel to the y-z plane, as illustrated in FIG. 17.

On the other hand, the substrate 190 can be, for example, a Si wafer. FIGS. 18A and 18B are perspective views schematically illustrating a Si wafer which is an example of the substrate 190. The Si wafer is formed of, for example, monocrystalline Si and the cleavage surface thereof is known to be a (100) surface. In general, in the Si wafer, crystal orientation in the plane is decided.

Figure 18A:
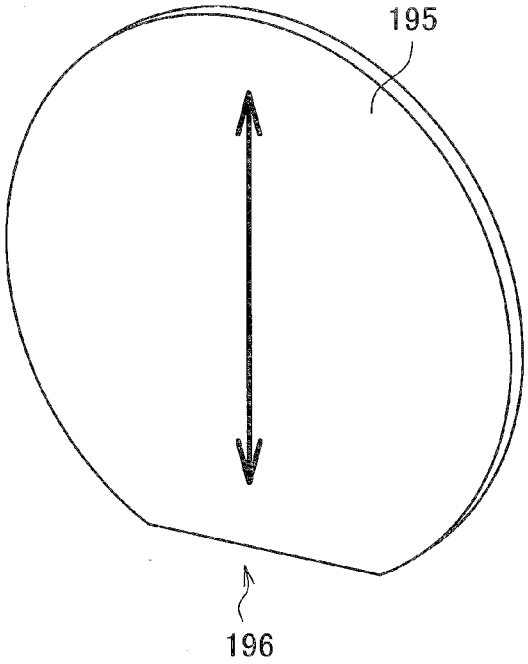
FIG. 18A is a perspective view schematically illustrating a Si wafer which is an example of a substrate.
Figure 18B:
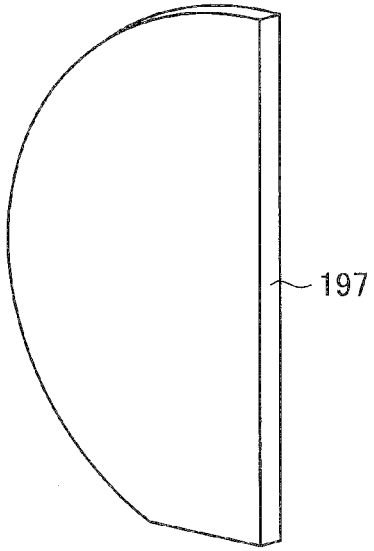
FIG. 18B is a perspective view schematically illustrating a Si wafer which is an example of a substrate.

For example, as illustrated in FIG. 18A, when a notch 196 in a Si wafer 195 faces down and the (100) surface is present in the vertical direction (a direction indicated by an arrow in the drawing), the cleavage direction of the Si wafer 195 is the vertical direction. FIG. 18B illustrates the shape of the Si wafer 195 after the Si wafer 195 is cloven. As illustrated in FIG. 18B, a cleavage surface 197 of the Si wafer 195 can become the (100) surface.

In the modification example, the fuse 130 and the other constituent members are disposed at the time of the fabrication of the electronic device 10 so that the fracture surface 137 of the fuse 130 is parallel to the cleavage surface 197 of the substrate 190 (for example, the Si wafer 195). That is, in the modification example, each constituent member of the electronic device 10 is disposed such that the y-z plane illustrated in FIG. 1 is parallel to the (100) surface which is the cleavage surface of the Si wafer 195. In this state, for example, when a bending stress occurs in the fuse 130 due the electrostatic attractive force or the like in order to fracture the fuse 130, a crack caused by the bending stress extends in parallel to the y-z plane, i.e., in a direction in which the shortest distance can be obtained for the fracture of the fuse 130, and thus the fuse 130 can be fractured with a small energy. The modification example in which the fracture surface of the fuse and the cleavage surface of the substrate are parallel to each other has been described with reference to FIGS. 17, 18A, and 18B in the first embodiment. In the modification example, as described above, the fuse 130 and the other constituent members are disposed at the time of the fabrication of the electronic device 10 so that the fracture surface 137 of the fuse 130 is parallel to the cleavage surface 197 of the substrate 190. Accordingly, when the fuse 130 is fractured, the crack extends in the direction in which the shortest distance can be obtained in order to fracture the fuse 130. Therefore, the fuse 130 is fractured more easily.

(1-5. Conclusion of First Embodiment)

As described above, in the first embodiment, the electronic device 10 includes the fixed member 110 which is the first member, the movable member 120 which is the second member, and the fuse 130 that electrically connects the fixed member 110 to the movable member 120. Thus, the fixed member 110 and the movable member 120 are electrically connected by the fuse 130, and the fixed member 110 and the movable member 120 are maintained at substantially the same potential. Therefore, sticking between the fixed member 110 and the movable member 120 during the manufacturing process is prevented. In the first embodiment, a mechanism that applies an outside force to the fuse 130 in a direction perpendicular to the extension direction of the fuse 130 may be installed, and thus the fuse 130 can be fractured by this outside force. By fracturing the fuse 130, a predetermined potential difference between the fixed member 110 and the movable member 120 can be supplied. Thus, for example, the original driving of the electronic device 10 serving as the MEMS is realized.

In the first embodiment, the electronic device 10 may be, for example, a bulk MEMS. The fixed member 110, the movable member 120, and the fuse 130 are formed to include at least parts of the substrate. The fuse 130 electrically connects the fixed member 110 to the movable member 120 via the substrate material. Here, as described above, for example, in the technologies disclosed in JP 2012-222241A, JP 2006-514786T, JP 2006-221956A, and JP 2005-260398A, the fuse is formed of a conductive film layer stacked on the substrate. Therefore, for example, it is necessary to remove the substrate material immediately below the conductive film by etching or the like. As described above, however, in the first embodiment, the fuse 130 is formed by the substrate 190. Accordingly, for example, the fuse 130 can be formed without addition of a process of etching the substrate 190 or the like. Therefore, the fuse 130 can be fabricated in a simpler method. Thus, the manufacturing cost of the electronic device 10 can be further reduced.

In the technologies disclosed in JP 2012-222241A, JP 2006-514786T, JP 2006-221956A, and JP 2005-260398A, the case in which the fuse includes the substrate material is not assumed. Therefore, a method of fracturing the fuse including the substrate material has not been sufficiently examined. For example, this fracture is considered to be difficult even when a method such as the melting method by the overcurrent, the cutout by contact with the vibration body, or the cutout by laser irradiation or etching, as described in JP 2012-222241A, JP 2006-514786T, JP 2006-221956A, and JP 2005-260398A, is applied to the fuse 130 including the substrate material. On the other hand, in the first embodiment, the mechanism that applies an outside force to the fuse 130 in a direction perpendicular to the extension direction of the fuse 130 can be installed, and thus the fuse 130 can be fractured by this outside force. Accordingly, even the fuse 130 including the substrate material can be fractured more reliably, and thus it is possible to operate the electronic device 10 more reliably.

The first embodiment and each modification example described above may be combined to be applied within the possible scope. By combining and applying the configurations described in the first embodiment and each modification example, it is possible to obtain the advantages obtained in the embodiment and each modification example as well.

<2. Second Embodiment>

Next, a second embodiment of the present disclosure will be described.

In recent years, there has been a considerable demand for miniaturizing an electronic device such as a MEMS and lowering power of a driving voltage. According to this demand, there has been a demand for further miniaturization of each constituent member of the MEMS. However, as a gap between a fixed member and a movable member in a driving unit of the MEMS is narrower, sticking between the members is considered to occur more easily during a manufacturing process. Thus, there is a concern of manufacturing failures increasing.

Accordingly, as a technology for preventing the sticking, for example, as disclosed in JP 2009-32559A, a technology for fabricating members included in a driving unit through separate processes and joining these members in a rear-stage process has been suggested. Further, as disclosed in JP 2012-222241A, JP 2006-514786T, JP 2006-221956A, and JP 2005-260398A, technologies for connecting target members included in the driving portion by a fuse in a manufacturing process, maintaining the members at substantially the same potential, and fracturing the fuse in a rear-stage process have been suggested.

Here, in the technology disclosed in JP 2009-32559A, there is a probability of a manufacturing cost increasing since the members included in the driving unit are fabricated separately. Further, in the technology disclosed in JP 2009-32559A, high alignment precision is necessary when the members included in the driving unit are joined. Accordingly, the technology disclosed in JP 2009-32559A can be said to be difficult to apply to a MEMS having a more refined configuration or a lateral driving type MEMS in which a driving direction is a direction in a plane direction parallel to a substrate on which the MEMS is formed.

For the fuse disclosed in JP 2012-222241A, JP 2006-514786T, JP 2006-221956A, and JP 2005-260398A, it is necessary to perform the process of fracturing the fuse, e.g., a process of applying a current to melt the fuse, a process of coming into contact with a vibration body to cut the fuse, or a process of cutting the fuse by etching, separately from a process of fabricating the MEMS. Thus, when the fuse disclosed in JP 2012-222241A, JP 2006-514786T, JP 2006-221956A, and JP 2005-260398A is applied to the MEMS, it is necessary to add the process of fracturing the fuse. Thus, there is a concern of a manufacturing cost increasing.

In view of the foregoing circumstances, there has been a demand for a technology for suppressing an increase in a manufacturing cost by fracturing the fuse formed between the members more easily. Accordingly, the first embodiment of the present disclosure provides a technology for enabling a fuse to be fractured more easily.

Hereinafter, a second embodiment will be described in detail. The second embodiment will be described below exemplifying a case in which an electrostatic MEMS that is fabricated as a bulk MEMS, which is an electronic device including a fuse according to the second embodiment, and performs electrostatic driving or electrostatic detection is used as a switching element. However, the second embodiment is not limited to this example, but the electronic device according to the second embodiment may be a MEMS that is driven by an electrostatic attractive force of a capacitance variable capacitor, a movable mirror, or the like and has a use other than as the switching element. For example, the electronic device according to the second embodiment may not be a bulk MEMS or may be a MEMS (hereinafter referred to as a surface MEMS) that is fabricated on the surface of a substrate using surface micromachining. Further, the electronic device according to the second embodiment may be a device other than the electrostatic MEMS.

[2-1. Configuration of Electronic Device]

Figure 19:
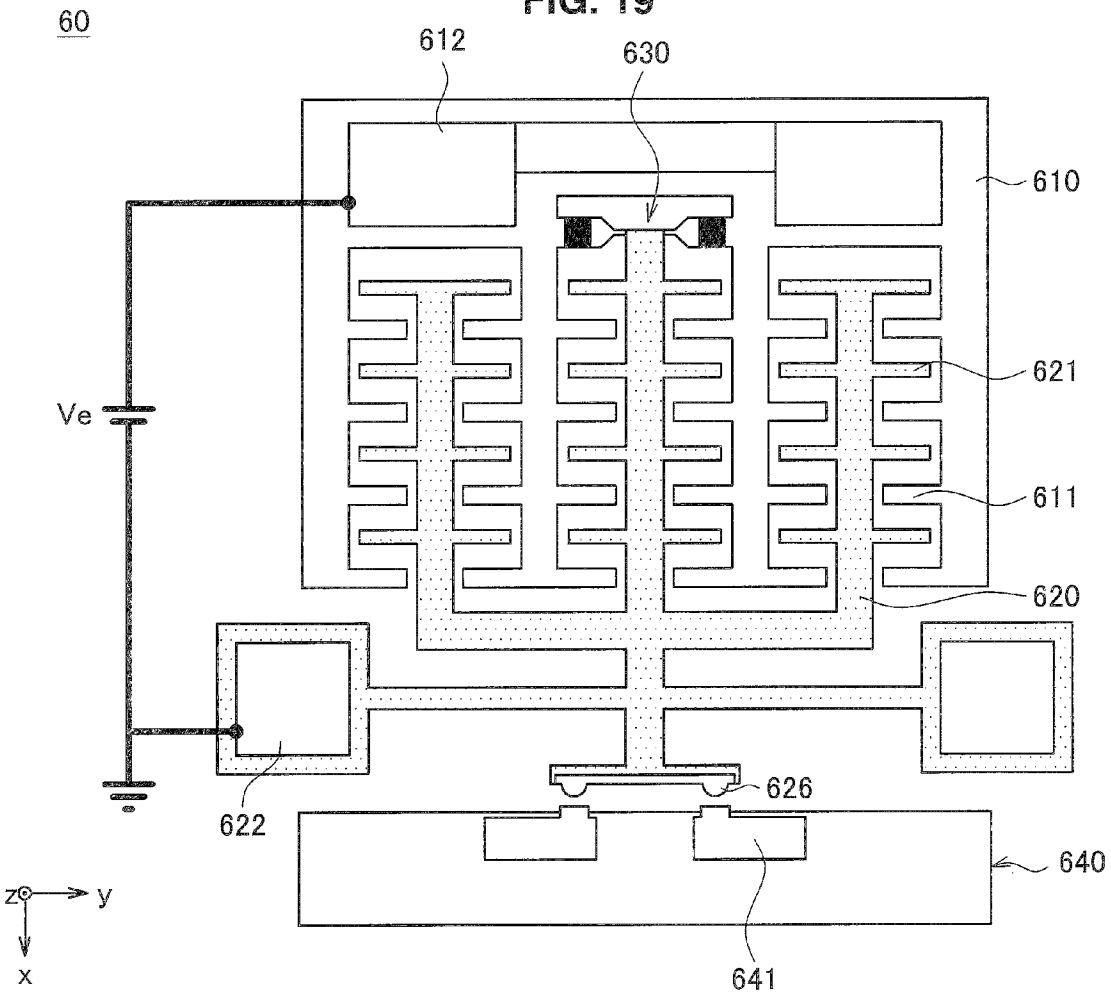
FIG. 19 is a top view illustrating an example of the configuration of an electronic device according to a second embodiment.
Figure 20:
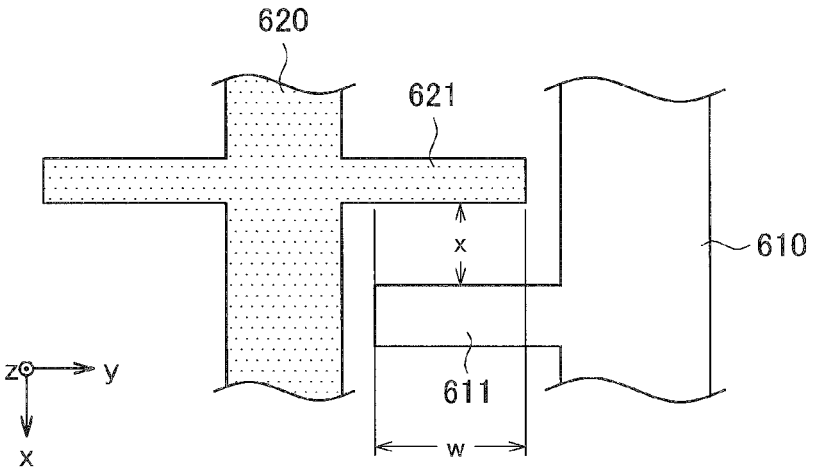
FIG. 20 is an enlarged view illustrating a predetermined region including a pair of a fixed electrode and a movable electrode of the electronic device illustrated in FIG. 19.
Figure 21:
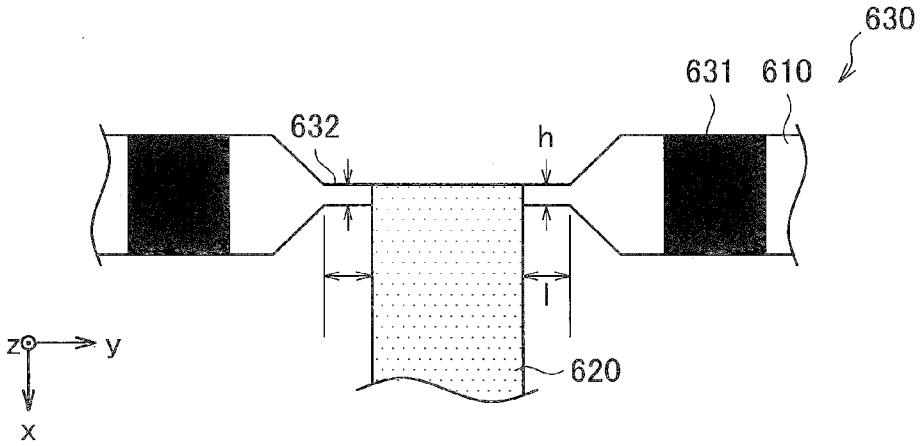
FIG. 21 is an enlarged view illustrating a predetermined region including a fuse of the electronic device illustrated in FIG. 19.

First, an example of the configuration of the electronic device according to the second embodiment will be described with reference to FIGS. 19 to 21. FIG. 19 is a top view illustrating an example of the configuration of an electronic device according to the second embodiment. FIG. 20 is an enlarged view illustrating a predetermined region including a pair of a fixed electrode and a movable electrode of the electronic device illustrated in FIG. 19. FIG. 21 is an enlarged view illustrating a predetermined region including a fuse of the electronic device illustrated in FIG. 19.

Referring to FIG. 19, an electronic device 60 according to the second embodiment includes a fixed member 610, a movable member 620, and a fuse 630. As described above, the electronic device 60 is an electrostatic MEMS that is fabricated as a bulk MEMS and performs electrostatic driving or electrostatic detection. The fixed member 610, the movable member 620, and the fuse 630 are fabricated by performing various etching processes on a substrate 660 and forming a trench in a predetermined region of the substrate. In the description, hatchings are given to and illustrated on members corresponding to the movable member 620 and the fuse 630 in FIG. 19 and the subsequent drawings to facilitate the description of the second embodiment. Thus, in the second embodiment, the fixed member 610, the movable member 620, and the fuse 630 may be formed to include at least parts of a substrate material of the substrate. The electronic device 60 according to the second embodiment may have a configuration in which the fuse 630 according to the embodiment is formed between a fixed member and a movable member in a general electrostatic MEMS or any of the known configurations may be applied as the configuration of the electrostatic MEMS.

For example, a Si wafer is used as the substrate. The electronic device 60 can be fabricated by sequentially performing various processes, which are generally used at the time of fabrication of the bulk MEMS in a semiconductor process, on the Si wafer. The second embodiment is not limited to the example and the substrate in which the electronic device 60 is formed can be formed of any of various semiconductor materials. For example, in addition to the above-described Si, any of various materials, such as SiC, GaP, or InP, which can be generally used as a wafer of a semiconductor device, may be applied as the substrate. The material of the substrate is not limited to the semiconductor material and any of various known materials of which the MEMS can be formed can be applied.

For example, the electronic device 60 may be formed on an SOI substrate, as in the electronic device 10 according to the first embodiment. The fixed member 610, the movable member 620, and the fuse 630 can be formed by processing the Si layer of the upper layer in the SOI substrate. At this time, the box layer in a region corresponding to a region immediately below the movable member 620 and the fuse 630 can be removed by, for example, an etching process. By removing the box layer in the region corresponding to the region immediately below the movable member 620, the movable member 620 can be moved in the plane parallel to the SOI substrate. As will be described below, the fuse 630 is fractured when the electronic device 60 is driven. Therefore, the box layer in the region corresponding to the region immediately below the movable member 620 is preferably removed. On the other hand, the box layer in a region corresponding to a region immediately below the fixed member 610 remains without being removed. Accordingly, the fixed member 610 can be connected fixedly to the Si layer of the lower layer with the box layer interposed therebetween. However, in a partial region of the movable member 620, the box layer is not removed and anchor portions (not shown) which can be connected fixedly to the Si layer of the lower layer may be formed. The movable member 620 is configured such that the movable member 620 is fixed to the substrate by the anchor portions and other sites can be elastically moved with respect to the fixed member 610.

Here, a resistance value of at least the Si layer of the upper layer in the SOI substrate is adjusted to be equal to or less than a predetermined value, for example, by appropriately doping impurities. Thus, in the electronic device 60, by appropriately doping the impurities in the Si layer of the upper layer, the fixed member 610, the movable member 620, and the fuse 630 may behave as, so to speak, conductors. However, as will be described below, a high-resistance portion with a higher resistance value than the other regions is formed in a partial region of the fuse 630.

The fixed member 610 is a member that is included in the driving unit of the electronic device 60 and is fixed without being moved when the electronic device 60 is driven. Hereinafter, the fixed member 610 is also referred to as a first member 610. In a partial region of the fixed member 610, for example, a plurality of fixed electrodes 611 extending in the y-axis direction are formed. An electrode portion 612 applying a predetermined voltage to the fixed member 620 is formed in a partial region of the surface of the fixed member 610. The electrode portion 612 has, for example, a configuration in which an insulation film and a wiring layer are stacked in order on the substrate and a contact is formed between the surface of the substrate and the wiring layer. The wiring layer and the surface of the substrate are electrically connected by the contact. Accordingly, by applying a predetermined voltage to the wiring layer of the surface of the electrode portion 612, it is possible to control the voltage of the substrate material forming the fixed member 610.

The movable member 620 is a member included in the driving unit of the electronic device 60 and configured to be relatively movable with respect to the fixed member 610. As in the fixed member 610, the movable member 620 may be formed to include at least a part of the substrate material. Hereinafter, the movable member 620 is also referred to as a second member 620. In the second embodiment, the movable member 620 can be moved relatively with respect to the fixed member 610 in a predetermined direction (x-axis direction) in the plane parallel to the substrate in which the electronic device 60 is formed. For example, a plurality of movable electrodes 621 formed to extend in the y-axis direction and face fixed electrodes 611 of the fixed member 610 are formed in partial regions of the movable member 620. As in the fixed member 610, an electrode portion 622 applying a predetermined voltage to the movable member 620 is formed in a partial region of the movable member 620. As in the electrode portion 612, for example, the electrode portion 622 has a configuration in which an insulation film and a wiring layer are stacked in order on the substrate and a contact is formed between the surface of the substrate and the wiring layer. The wiring layer and the surface of the substrate are electrically connected by the contact. Accordingly, by applying a predetermined voltage to the wiring layer of the surface of the electrode portion 622, it is possible to control the voltage of the substrate material forming the movable member 620.

FIG. 20 illustrates a pair of a fixed electrode 611 and a movable electrode 621 among the plurality of fixed electrodes 611 and movable electrodes 621 formed in the electronic device 60. The movable electrode 621 can be moved with respect to the fixed electrode 611 by supplying the potential difference between the fixed electrode 611 and the movable electrode 621 and generating the electrostatic attractive force between these electrodes. In the following description, as illustrated in FIG. 20, a gap between the fixed electrode 611 and the movable electrode 621 in the x-axis direction is referred to as an inter-electrode distance x and a width in the y-axis direction by which the regions of the fixed electrode 611 and the movable electrode 621 face each other is referred to as a facing width w.

The fuse 630 electrically connects the fixed member 610 to the movable member 620. In the example illustrated in FIG. 19, the fuse 630 has a plate shape that extends in the y-axis direction and has a surface parallel to the y-z plane.

The configuration of the fuse 630 according to the second embodiment will be described in detail with reference to FIG. 21. Referring to FIG. 21, in the fuse 630 according to the second embodiment, a high-resistance portion 631 which is a site with higher resistance than other regions is formed in a partial region. For example, the high-resistance portion 631 can be formed by masking a predetermined region using a photoresist, a hard mask, or the like in an ion implantation process of doping impurities in the Si layer of the upper layer of the SOI substrate to lower the impurity concentration of the region more than the other regions. The high-resistance portion 631 may be formed, for example, by adjusting the impurity concentration of a predetermined region using a method such as thermal diffusion. Here, as will be described in detail in the following [2-3. Detailed design of fuse], the resistance value of the high-resistance portion 631 can be adjusted to a sufficient value to electrify both of the fixed member 610 and the movable member 620 so that sticking does not occur between the fixed member 610 and the movable member 620 and to generate a potential difference so that the movable member 620 is moved with respect to the fixed member 610 when a predetermined voltage value is applied between the fixed member 610 and the movable member 620.

Here, in the second embodiment, the position at which the high-resistance portion 631 is formed is not limited to the illustrated example, but the high-resistance portion 631 may be formed at another position of the fuse 630. In the second embodiment, the fixed member 610 and the movable member 620 may be electrically connected via the high-resistance portion 631 or the high-resistance portion 631 may be formed at any position.

The fuse 630 further includes a fracture portion 632 formed to have a narrower width than the other regions in the movement direction (x-axis direction) of the movable member 620. In the example illustrated in FIG. 21, the fracture portion 632 is formed in a region connected to the movable member 620. As will be described in the following [2-2. Operation of electronic device and method of fracturing fuse], in the second embodiment, the fuse 630 is fractured by driving the electronic device 60 and moving the movable member 620. The fracture portion 632 functions as a stress concentration portion on which a stress is concentrated when the electronic device 60 is driven and the stress is applied to the fuse 630 and in which the fracture starts from the fracture portion 632. In the following description, to define the shape of the fracture portion 632, as illustrated in FIG. 21, a length in the extension direction (y-axis direction) of the fracture portion 632 is referred to as a fracture portion length l and a width of the fracture portion 632 in the movement direction (x-axis direction) of the movable member 620 is referred to as a fracture portion width h.

Here, in the second embodiment, the position at which the fracture portion 632 is formed is not limited to the illustrated example, but the fracture portion 632 may be formed at another position of the fuse 630. The shape of the fracture portion 632 is not limited to the illustrated example and the fracture portion 632 may have another shape. In the second embodiment, the fracture portion 632 may not necessarily be formed in the fuse 630. In the second embodiment, as described above, the fuse 630 is fractured by driving the electronic device 60. Therefore, whether the fracture portion 632 is formed in the fuse 630, the position at which the fracture portion 632 is formed, the shape of the fracture portion 632, and the like may be appropriately designed so that the fuse 630 is reliably fractured in consideration of the stress applied to the fuse 630 at the time of the driving of the electronic device 60.

[2-2. Operation of Electronic Device and Method of Fracturing Fuse]

Figure 22:
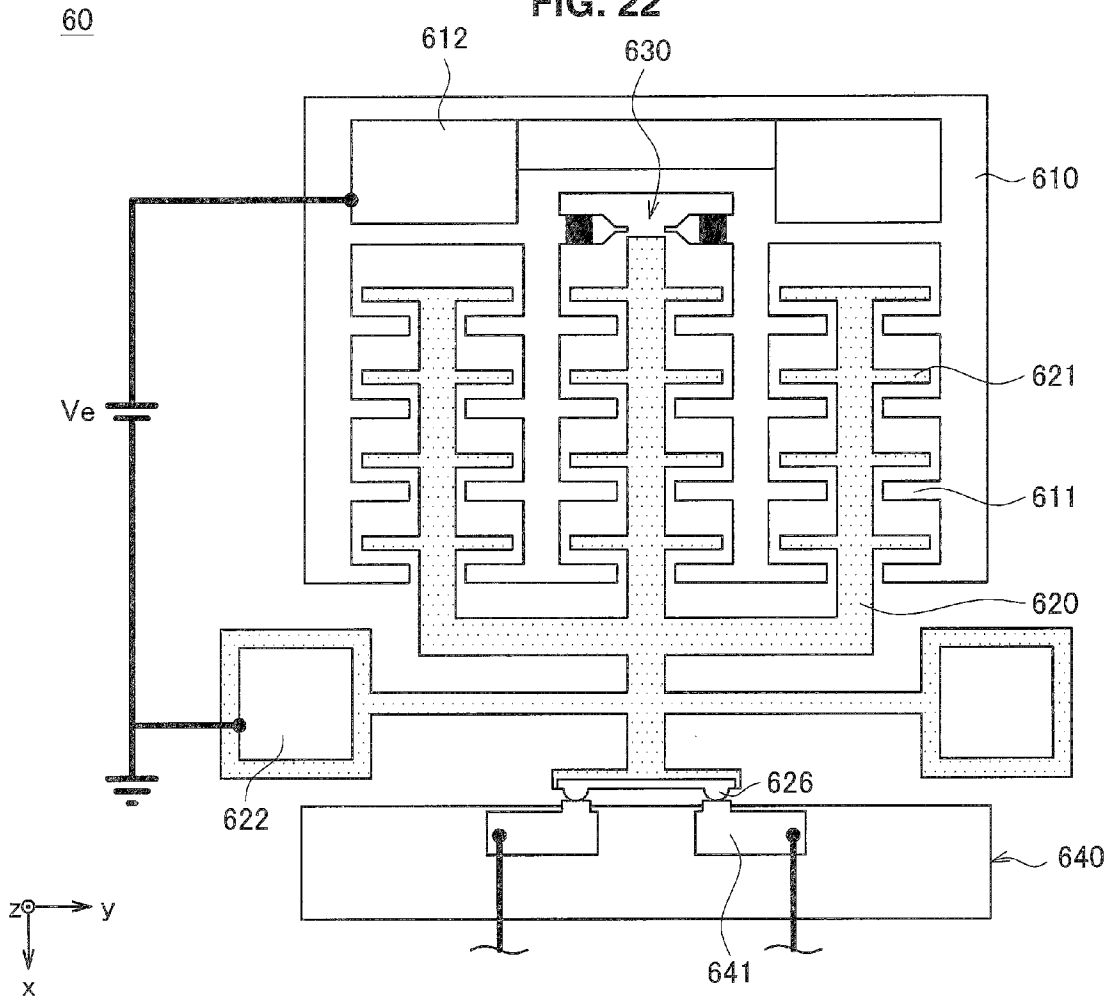
FIG. 22 is a top view illustrating a form in which the fuse is fractured by driving the electronic device.

Next, an operation of the electronic device 60 and a method of fracturing the fuse 630 according to the second embodiment will be described with reference to FIG. 22. In the second embodiment, the fuse 630 is fractured by driving the electronic device 60 and moving the movable member 620 with respect to the fixed member 610. FIG. 22 is a top view corresponding to FIG. 19 and is a top view illustrating a form in which the fuse 630 is fractured by driving the electronic device 60.

In the electronic device 60, as described above, the movable electrode 621 is moved with respect to the fixed electrode 611 by supplying the potential difference between the fixed electrode 611 and the movable electrode 621 and generating the electrostatic attractive force between these electrodes. Here, a known general electrostatic MEMS is configured such that a fixed member and a movable member are electrically insulated, and a predetermined potential difference can be supplied between the fixed member and the movable member to drive the electrostatic MEMS. For example, when the fixed member is electrically connected to the movable member by a general fuse, the fixed member and the movable member are electrically connected to each other in a state in which there is little resistance. Therefore, the predetermined potential difference may not be supplied between the fixed member and the movable member, and thus the electrostatic MEMS may not be driven.

However, in the fuse 630 according to the second embodiment, the high-resistance portion 631 is formed in the partial region. Accordingly, between the fixed member 610 and the movable member 620, a predetermined potential difference sufficient to drive the electronic device 60 can be caused by a voltage drop in the high-resistance portion 631.

As illustrated in FIG. 22, when a predetermined potential difference Ve is supplied between the fixed member 610 and the movable member 620, the movable member 62 is moved in the positive direction (the lower direction in the drawing) of the x axis from the state illustrated in FIG. 19. A stress is applied to the fuse 630 with the movement of the movable member 620 and the fuse 630 is fractured, for example, in the fracture portion 632 by the stress. Since the fixed member 610 and the movable member 620 are electrically insulated after the fracture of the fuse 630, the electronic device 60 can operate as in the general electrostatic MEMS.

For example, a movable terminal 626 is formed at an end of the movable member 620 in the movement direction. A switch portion 640 which can be formed as a part of the fixed member 610 is formed at a position facing the movable terminal 626 of the electronic device 60. For example, a switch terminal 641 electrically connected to another external device of the electronic device 60 is formed on the surface of the switch portion 640 facing the movable terminal 626. By driving the electronic device 60 and moving the movable member 620 in the positive direction of the x axis, the movable terminal 626 comes into contact with the switch terminal 641 and the movable member 620 and the switch portion 640 enter an electrical conduction state (that is, a state in which a switch is turned on). By moving the movable member 620 in the positive direction of the x axis and separating the movable terminal 626 from the switch terminal 641, the movable member 620 and the switch portion 640 enter a non-electrical conduction state (that is, a state in which the switch is turned off). Thus, the electronic device 60 can function as a switching element.

Thus, in the second embodiment, the fixed member 610 and the movable member 620 are electrically connected via the fuse 630 including the high-resistance portion 631. The resistance value of the high-resistance portion 631 can be adjusted to a sufficient value to electrify both of the fixed member 610 and the movable member 620 so that sticking does not occur between the fixed member 610 and the movable member 620 and to generate a potential difference so that the movable member 620 is moved with respect to the fixed member 610 when a predetermined voltage value is applied between the fixed member 610 and the movable member 620. Accordingly, the electronic device 60 can be driven in the state of the connection with the fuse 630, while suppressing sticking during the manufacturing process. The shape of the fuse 630 is designed so that the fuse 630 can be fractured by driving the electronic device 60. Accordingly, since the fuse 630 can be fractured by performing an operation of operating the normal electronic device 60, for example, in product inspection (for example, an operation test) before shipment, it is not necessary to perform a separate process of fracturing the fuse 630.

Here, as described above, in the technologies disclosed in JP 2012-222241A, JP 2006-514786T, JP 2006-221956A, and JP 2005-260398A, it is necessary to separately provide a configuration for fracturing the fuse, such as a vibrator for cutting the fuse or a pad for applying a current at the time of melting of the fuse, inside the electronic device. In the technologies disclosed in JP 2012-222241A, JP 2006-514786T, JP 2006-221956A, and JP 2005-260398A, in order to fracture the fuse, for example, it is necessary to separately provide equipment, such as power equipment applying a large current, which is not used in the manufacturing process for a normal electronic device. In the embodiment, as described above, in the electronic device 60 according to the second embodiment, the fuse 630 is fractured by driving the electronic device 60. Therefore, it is not necessary to separately provide the configuration for fracturing the fuse inside the electronic device 60. Accordingly, the electronic device 60 can be fabricated to be smaller. The fuse 630 is included between the fixed member 610 and the movable member 620. Accordingly, since it is not necessary to ensure a region in which the fuse 630 is formed other than the regions of the fixed member 610 and the movable member 620, the electronic device 60 can be further miniaturized. For example, equipment used in the manufacturing process for a normal electronic device, such as an apparatus for performing an operation test, can be used as equipment for fracturing the fuse 630. Thus, according to the second embodiment, the fuse 630 can be fractured more easily and the manufacturing cost of the electronic device 60 can be further reduced.

In the foregoing description, the case in which the electronic device 60 is the MEMS that includes the fixed member 610 which is the first member and the movable member 620 which is the second member has been described, but the second embodiment is not limited to this example. The fuse 630 according to the second embodiment may be formed between mutually different members that are relatively moved when a predetermined potential difference is supplied. For example, the first and second members may both be movable members. Even when the first and second members are both movable members, the fuse 630 can be fractured in a simpler method and the sticking between the first and second members during the manufacturing process can be prevented by forming the fuse 630 as in the above-described embodiment.

In the second embodiment, the electronic device 60 may not be the MEMS. In the second embodiment, for example, the fuse 630 including the high-resistance portion 631 may electrify the first member which is the fixed member 610 and the second member which is the movable member 620 so that the sticking does not occur and may connect the first and second members so that the sufficient potential difference to move the second member with respect to the first member is caused when the predetermined voltage value is applied between the first and second members. The fuse 630 can be applied to all kinds of devices. In the second embodiment, the fuse 630 can be fractured more easily. Therefore, by applying the fuse 630 to various kinds of devices, the manufacturing cost of the device can be reduced further.

[2-3. Detailed Design of Fuse]

Next, a detailed method of designing the fuse 630 will be described. In the second embodiment, as described above, the fuse 630 is fractured by driving the electronic device 60 and moving the movable member 620 with respect to the fixed member 610. Accordingly, the shape of the fuse 630 can be designed so that the fuse 630 can be fractured by the stress applied when the electronic device 60 is driven. As described above, the resistance value of the high-resistance portion 631 of the fuse 630 can be designed as a sufficient value to electrify both of the fixed member 610 and the movable member 620 so that sticking does not occur between the fixed member 610 and the movable member 620 and to generate a potential difference so that the movable member 620 is moved with respect to the fixed member 610 when a predetermined voltage value is applied between the fixed member 610 and the movable member 620.

(2-3-1. Method of Designing Shape of Fuse)

Figure 23:
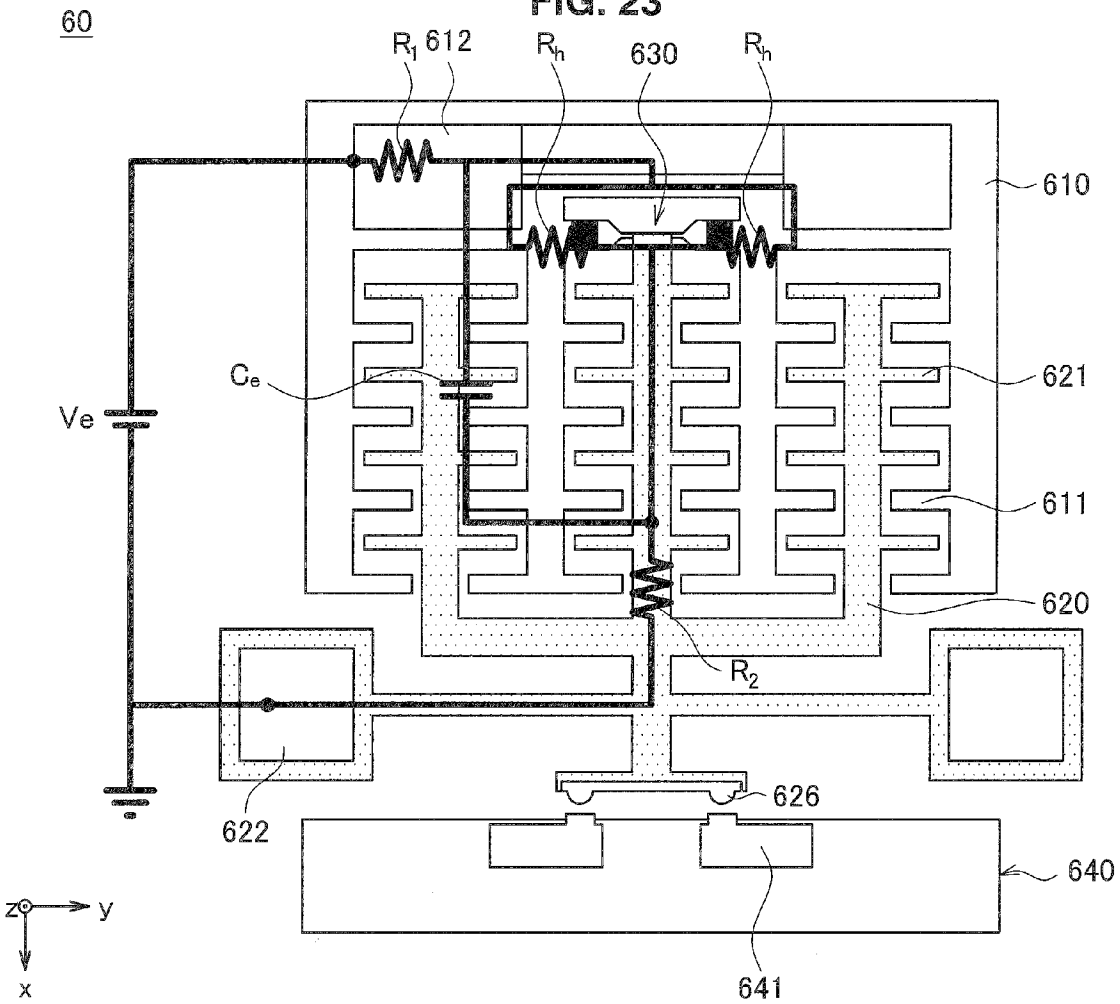
FIG. 23 is a schematic view illustrating an equivalent circuit of the electronic device illustrated in FIG. 19.
Figure 24:
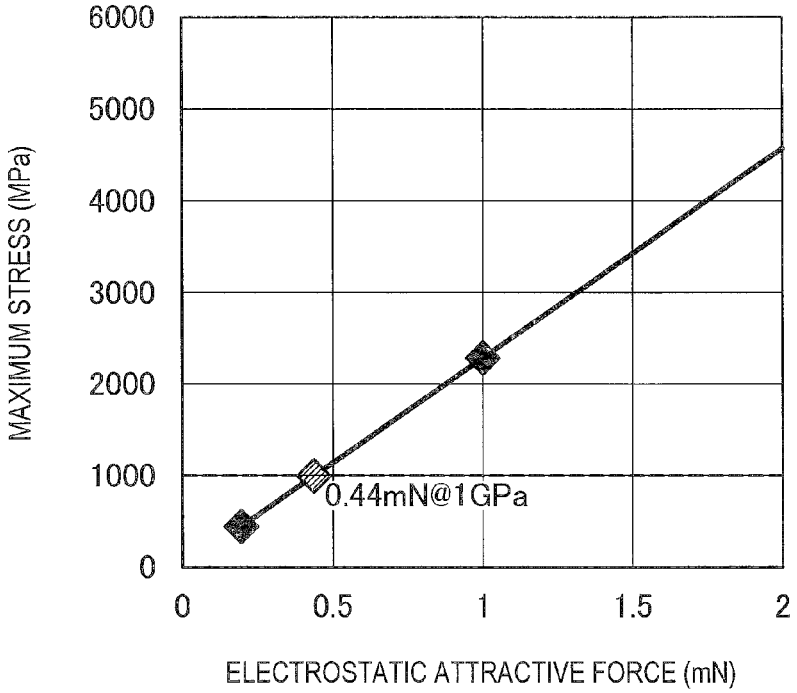
FIG. 24 is a graph illustrating a relation between an electrostatic attractive force applied to the movable member at the time of driving of the electronic device and the maximum stress occurring in the fuse.

First, a method of designing the shape of the fuse 630 will be described with reference to FIGS. 23 and 24. FIG. 23 is a schematic view illustrating an equivalent circuit of the electronic device 60 illustrated in FIG. 19. FIG. 24 is a graph illustrating a relation between an electrostatic attractive force applied to the movable member 620 at the time of driving of the electronic device 60 and the maximum stress occurring in the fuse 630.

The method of designing the shape of the fuse 630 exemplifying specific numerical values will be described below. However, the numerical values to be indicated below are merely examples of the numerical values used when the shape of the fuse 630 is set. The shape of the fuse 630 can be designed even under other conditions by appropriately substituting the numerical values with values according to the configuration of the electronic device 60 and performing the same calculation.

For example, the inter-electrode distance x between the fixed electrode 611 and the movable electrode 621 is assumed to be 1.3 (μm) and the facing width w is assumed to be 100 (μm). For example, the widths (for example, which correspond to the depth of the Si layer of the upper layer of the substrate in which the electronic device 60 is formed) of the fixed electrode 611 and the movable electrode 621 in the z-axis direction are 50 (μm). At this time, for example, when 400 of the fixed electrodes 611 and 400 of the movable electrodes 621 are formed inside the electronic device 60, an electrode area S which is a sum value of the areas of the fixed electrodes 611 and the movable electrodes 621 in the electronic device 60 is $2\times10^{-6}$ ($m^2$).

When the electronic device 60 is driven, a spring constant k of a return spring returning to the original position of the movable member 620 (that is, the position of the movable member 620 when no potential difference is supplied between the fixed member 610 and the movable member 620) is assumed to be 900 (N/m). In this case, an operation voltage of the electronic device 60, i.e., the pull-in voltage $V_{pull\text{-}in}$, is about 5.8 (V). Here, the pull-in voltage refers to a voltage which is a threshold value by which the movable electrode is attracted to come into contact with the fixed electrode when the potential difference between the fixed electrode and the movable electrode exceeds the pull-in voltage in the electrostatic MEMS (electrostatic actuator). For the details of the pull-in voltage or a method of calculating the pull-in voltage, for example, description of "RF MEMS Theory, Design, and Technology," p. 36 to 38 by Gabriel M. Rebeiz can be referred to. A driving voltage (rated voltage) to be supplied to the electronic device 60 is assumed to be 12 (V).

Here, the equivalent circuit of the electronic device 60 will be examined with reference to FIG. 23. FIG. 23 illustrates the equivalent circuit of the electronic device 60 which is superimposed on the top view of the electronic device 60 illustrated in FIG. 19. As illustrated in FIG. 23, the equivalent circuit of the electronic device 60 has a configuration in which a capacitance $C_e$ corresponding to a combination of the plurality of fixed electrodes 611 and movable electrodes 621 facing each other and a resistor $R_h$ corresponding to the high-resistance portion 631 of the fuse 630 are disposed in parallel. As illustrated in FIG. 23, since the high-resistance portions 631 are formed at two positions with the movable member 620 interposed therebetween in the fuse 630, two resistors $R_h$ are also disposed in parallel. In the equivalent circuit, a resistant component in the fixed member 610 is assumed to be a resistor $R_1$ and a resistant component in the movable member 620 is assumed to be a resistor $R_2$, and the resistors are disposed in series. The potential difference between the fixed member 610 and the movable member 620 is assumed to be $V_e$.

For example, the resistor $R_h$ is assumed to have 100 (kΩ) and both of the resistors $R_1$ and $R_2$ are assumed to have 500(Ω). Since the two resistors $R_h$ are disposed in parallel in the equivalent circuit, a combined resistance in the fuse 130 is 50 (kΩ). The capacitance $C_e$ is calculated to be 13.6 (pF) from the shape of the fixed electrodes 611 and the movable electrodes 621 described above.

Here, the electrostatic attractive force applied to the movable member 620 when the electronic device 60 having the above-described conditions is driven will be considered. The electrostatic attractive force is calculated by the following expression (2).

$$F = \frac{1}{2}\frac{\varepsilon_0 S}{x^2}V_e^2 \tag{2}$$

Here, S is the above-described electrode area, x is the inter-electrode distance, $V_e$ is the potential difference between the fixed member 610 and the movable member 620 and $\in_0$ is a dielectric constant of vacuum ($\approx 0.85\times10^{-12}$). When the rated voltage 12 (V) is supplied to the electronic device 60 from the outside, $V_e$ is about 11.76 (V) in consideration of a voltage drop by the resistors $R_1$ and $R_2$. When the above-described numerical values are substituted into the foregoing expression (2) and the value of an electrostatic attractive force F to be applied to the movable member 620 is calculated, F=0.75 (mN) can be obtained.

Accordingly, the shape of the fuse 630 may be designed so that the fuse 630 is fractured by applying the force of 0.75 (mN) to a connection portion with the movable member 620 in the x-axis direction. For example, the shape of the fuse 630 may be designed by analyzing a stress distribution of the fuse 630 by a simulation using FEM or the like. Specifically, for example, for a calculation model (for example, a both-end support beam) obtained by modeling the fuse 630, the stress distribution is calculated by a simulation by supplying the force of 0.75 (mN) to one end in a direction perpendicular to the extension direction of the beam. When the maximum value (maximum stress) of the stress is greater than a stress (hereinafter referred to as a fracture stress) by which the fuse 630 can be fractured, the fuse 630 can be fractured. Accordingly, by changing the shape of the calculation model and repeatedly performing the simulation, it is possible to design the shape of the fuse 630 so that the maximum stress is greater than the fracture stress.

An example of the shape of the fuse 630 obtainable in the second embodiment will be described. For example, in the fuse 630 illustrated in FIG. 21, the fracture portion length l of the fracture portion 632 is assumed to be 4 (μm) and the fracture portion width h is assumed to be 0.2 (μm). The width (for example, which corresponds to the depth of the Si layer of the upper layer of the substrate in which the electronic device 60 is formed) of the fracture portion 632 in the z-axis direction is assumed to be 50 (μm). Two fracture portions 632 of the fuse 630 can be considered to be two beams which are mechanically connected between the fixed member 610 and the movable member 620 and have the above-described shape. By moving the movable member 620 in the positive direction of the x axis, the electrostatic attractive force F calculated above is applied in the positive direction of the x axis to the connection site of the fracture portion 632 with the movable member 620.

FIG. 24 illustrates a result obtained in the simulation by calculating the maximum stress caused in the fracture portion 632 when the electrostatic attractive force is applied to the fracture portion 632 with the foregoing shape. In FIG. 24, the horizontal axis represents the electrostatic attractive force and the vertical axis represents the maximum stress caused in the fracture portion 632, and the relation between the electrostatic attractive force and the maximum stress is plotted.

Here, from the result of the separately executed simulation, the fracture stress of the fuse 630 is known to be about 1 (Gpa). From FIG. 24, it can be understood that the electrostatic attractive force of about 0.44 (mN) is applied to the movable member 620 to supply the fracture stress to the fracture portion 632.

However, when the movable member 620 is moved in the x-axis direction, a force of restitution is generated by the return spring. In the simulation, a displacement amount of the movable member 620 in the x-axis direction was about 0.2 (μm) when the stress of 1 (GPa) was caused in the fracture portion 632. Accordingly, the force of restitution of about 0.18 (mN) is calculated using the spring constant k=900 (N/m) of the return spring described above. In consideration of the force of restitution, the electrostatic attractive force necessary to fracture the fuse 630 in the fracture portion 632 is calculated as about 0.62 (mN) which is a sum of 0.44 (mN) and 0.18 (mN).

Here, as described above, the electrostatic attractive force generated in the electronic device 60 and calculated from the foregoing expression (2) is about 0.75 (mN). This value is greater than 0.62 (mN) which is the electrostatic attractive force necessary to fracture the fuse 630 in the fracture portion 632. Thus, in the second embodiment, it can be understood that the fuse 630 can be fractured by forming the fracture portion 632 of the fuse 630 in the above-described shape.

The specific method of designing the shape of the fuse 630 and, particularly, the shape of the fracture portion 632, has been described above. The shapes and characteristics of the constituent members of the electronic device 60 described above are merely examples in the second embodiment. Even when the constituent members of the electronic device 60 are different from the foregoing examples, the shape of the fracture portion 632 in the shape of the fuse 630 can be appropriately designed by performing the calculation according to the above-described method.

(2-3-2. Method of Designing Resistance Value of High-Resistance Portion of Fuse)

Figure 25:
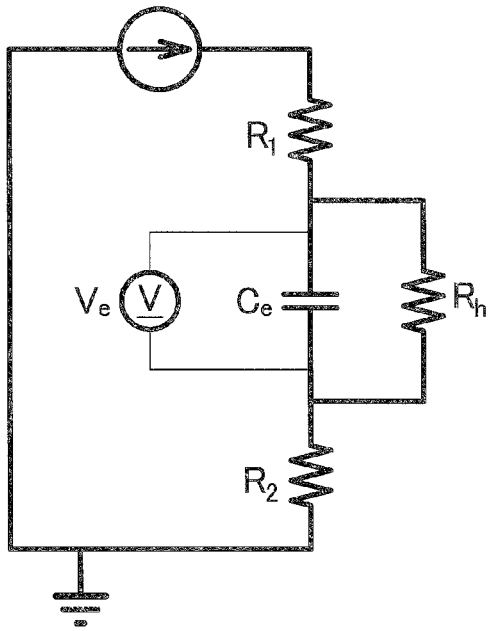
FIG. 25 is a schematic view illustrating an equivalent circuit of the electronic device in consideration of charging during a manufacturing process.

Next, a method of designing the resistance value of the high-resistance portion 631 of the fuse 630 will be described with reference to FIG. 25. FIG. 25 is a schematic view illustrating an equivalent circuit of the electronic device 60 in consideration of charging during a manufacturing process.

The method of designing the resistance value of the high-resistance portion 631 of the fuse 630 will be described below exemplifying specific numerical values. However, the numerical values to be indicated below are merely examples of the numerical values used when the resistance value of the high-resistance portion 631 is set. The resistance value of the high-resistance portion 631 can be designed even under other conditions by appropriately substituting the numerical values with values according to the configuration of the electronic device 60 or the manufacturing process for the electronic device 60 and performing the same calculation.

Charging to the fixed member 610 and the movable member 620, which is a cause of sticking, can occur in, for example, a process using plasma such as deep reactive ion etching (DRIE). In the process using the plasma, charge supply which is a cause of the charging is realized by ion current density during the process. The charge supply by the ion current density can be expressed as a constant current source in the equivalent circuit.

Referring to FIG. 25, the equivalent circuit of the electronic device 60 considering the charging during the manufacturing process corresponds to a circuit in which a constant current source $I_{in}$ is added to the equivalent circuit illustrated in FIG. 23. In FIG. 25, the resistance values of two high-resistance portions 631 are illustrated representatively by one resistance value $R_h$ for simplicity. Here, the magnitude of the constant current source $I_{in}$ is expressed using an ion current density j during the process and a surface area $S_{in}$ of the fixed electrode 611 in the following expression (3).

$$I_{in}=j\times S_{in} \tag{3}$$

Here, a condition in which no sticking occurs between the fixed electrode 611 and the movable electrode 621 during the manufacturing process will be considered. To prevent the sticking during the manufacturing process, the potential difference $V_e$ caused by the charging between the fixed electrode 611 and the movable electrode 621 may be within a range in which no sticking occurs. That is, when the potential difference $V_e$ is less than the pull-in voltage $V_{pull\text{-}in}$ of the electronic device 60, that is, satisfies the following expression (4), it is possible to prevent sticking $$V_e<V_{pull\text{-}in} \tag{4}$$

Here, from FIG. 25, the potential difference $V_e$ corresponding to the capacitance $C_e$ between the fixed electrode 611 and the movable electrode 621 is expressed in the following expression (5).

$$V_e=R_h\times I_{in} \tag{5}$$

From the foregoing expressions (4) and (5), the resistance value $R_h$ of the high-resistance portion 631 of the fuse 130 is understood to satisfy the following expression (6) in order to suppress the sticking during the manufacturing process.

$$R_h<\frac{V_{pull-in}}{I_{in}} \tag{6}$$

As an example of the method of designing the resistance value $R_h$, the resistance value $R_h$ will be calculated specifically for the electronic device 60 having the shape described in the foregoing (2-3-1. Method of designing shape of fuse). As described above, the pull-in voltage $V_{pull\text{-}in}$ of the electronic device 60 is, for example, 5.8 (V). For example, when an ion saturation current density j during the manufacturing process is assumed to be 2 (mA/cm$^2$) and the surface area $S_{in}$ of the fixed electrode 611 is assumed to be 0.5 (mm$^2$), the constant current source $I_{in}$ is $I_{in}$=2 (mA/cm$^2$)×0.005 (cm$^2$)=10 (μA) from the foregoing expression (3).

When these numerical values are substituted into the foregoing expression (6), it can be understood that the resistance value $R_h$ may satisfy $R_h$<5.8 (V)/(10×10$^{-6}$ (A))=580 (kΩ). In other words, when the resistance value $R_h$ exceeds 580 (kΩ), the movable electrode 621 is pulled in the fixed electrode 611, and thus the sticking occurs.

On the other hand, in the embodiment, by driving the electronic device 60 and moving the movable electrodes 621 with respect to the fixed electrodes 611, the fuse 630 is fractured. Therefore, in consideration of the fracture of the fuse 630, the resistance value $R_h$ preferably has a value which is as large as possible while the foregoing expression (6) is satisfied. For example, as described in the foregoing (2-3-1. Method of designing shape of fuse), it is necessary to apply the electrostatic attractive force equal to or greater than 0.62 (mN) to the movable member 620 in order to fracture the fuse 630. As described above, the potential difference $V_e$ between the fixed electrode 611 and the movable electrode 621 is necessarily equal to or greater than 11.76 (V) in order to generate the electrostatic attractive force equal to or greater than 0.62 (mN). In order to set the potential difference $V_e$ to be equal to or greater than 11.76 (V) with respect to the rated voltage 12 (V), the resistance value $R_h$ of the high-resistance portion 631 is necessarily equal to or greater than 12.4 (kΩ).

From the above-described result, in order to suppress the sticking during the manufacturing process and fracture the fuse 630 when the electronic device 60 is driven in the electronic device 60 having the shape described in the foregoing (2-3-1. Method of designing shape of fuse), it can be understood that the resistance value $R_h$ of the high-resistance portion 631 of the fuse 630 may be within the range from 12.4 (kΩ) to 580 (kΩ). In practice, the resistance value $R_h$ of the high-resistance portion 631 can be appropriately selected from the foregoing range in consideration of a change in the ion current density j during the manufacturing process, a variation in the pull-in voltage caused by a dimension error, an error in the fracture stress, or the like.

The specific method of designing the resistance value of the high-resistance portion 631 of the fuse 630 has been described above. The shapes or characteristics of the constituent members of the electronic device 60 described above, the condition of the manufacturing process, and the like are merely examples in the second embodiment. Even when constituent members of the electronic device 60, the condition of the manufacturing process, and the like are different from those of the above example, the resistance value of the high-resistance portion 631 of the fuse 630 can be appropriately designed by performing the same calculation as in the above-described method.

[2-4. Modification Examples]

Next, several modifications of the above-described second embodiment will be described. In the second embodiment, the following configurations may be realized.

(2-4-1. Modification Example of High-Resistance Portion of Fuse)

In the embodiment described above with reference to FIGS. 19 to 21, the high-resistance portion 631 and the fracture portion 632 are formed in the different regions in the fuse 630. In the second embodiment, however, the high-resistance portions 631 may be formed in certain sites between the fixed member 610 and the movable member 620, and the positions at which high-resistance portions 631 are formed are not limited to the above-described examples. In the above-described embodiment, the high-resistance portion 631 has been formed, for example, by adjusting the impurity concentration in the process such as the ion injection process or the thermal diffusion process. However, the second embodiment is not limited to this example, but the high-resistance portion 631 may be formed according to other methods.

Here, as modification examples of the high-resistance portion 631 of the fuse 630, a modification example in which the high-resistance portion 631 of the fuse 630 is formed in another region and a modification example in which the high-resistance portion 631 of the fuse 630 is formed according to another method will be described. The modification examples correspond to examples in which the configuration of the fuse 630 is changed in the embodiment described with reference to FIGS. 19 to 21 and the other remaining configurations, e.g., the configurations of the fixed member 610 and the movable member 620, may be the same as those of the foregoing embodiment. Accordingly, in the description of the following modification, differences from the above-described embodiment will be mainly described and the detailed description of the repeated factors will be omitted.

Figure 26:
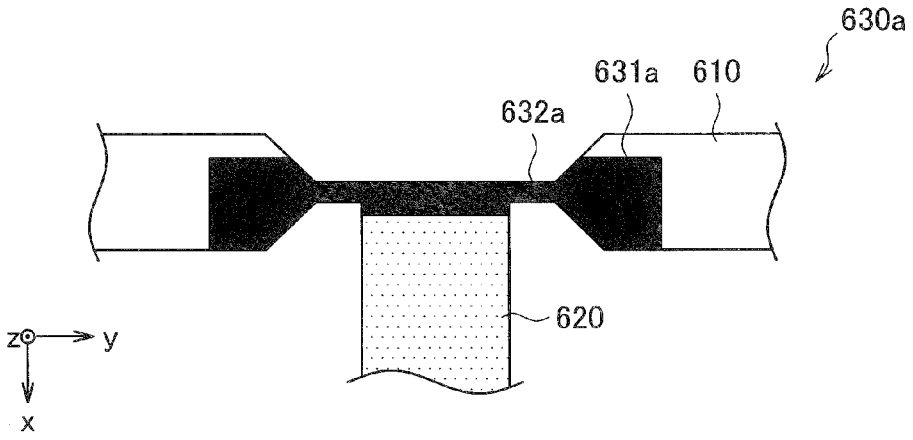
FIG. 26 is a top view illustrating an example of the configuration of a fuse according to a modification example in which a high-resistance portion is formed in another region.

First, the modification example in which the high-resistance portion of the fuse is formed in another region will be described with reference to FIG. 26. FIG. 26 is a top view illustrating an example of the configuration of the fuse according to the modification example in which the high-resistance portion is formed in another region. FIG. 26 is a drawing corresponding to FIG. 21 described above and corresponds to an enlarged view of a predetermined region including the fuse and the periphery of the fuse in the configuration of the electronic device according to the modification example.

Referring to FIG. 26, a fuse 630*a* according to the modification example is formed between the fixed member 610 and the movable member 620 and electrically connects the fixed member 610 and the movable member 620 to each other. The fuse 630*a* includes a high-resistance portion 631*a* and a fracture portion 632*a*. Here, the fuse 630*a* corresponds to, for example, the fuse 630 illustrated in FIGS. 19 and 22 and the shape of the fuse 630*a* may be the same as the shape of the fuse 630. The fracture portion 632*a* corresponds to the fracture portion 632 of the fuse 630 and has the same shape as the fracture portion 632.

In the fuse 630*a* according to the modification example, a region in which the high-resistance portion 631*a* is formed is different from the fuse 630. Specifically, in the fuse 630*a*, the high-resistance portion 631*a* is formed in a region overlapped by the fracture portion 632*a*. Even in the fuse 630*a* having such a configuration, the same advantages as those of the above-described embodiment can be obtained by appropriately designing the shape of the fracture portion 632*a* and the resistance value of the high-resistance portion 631*a* according to the method described in the foregoing [2-3. Detailed design of fuse].

Figure 27:
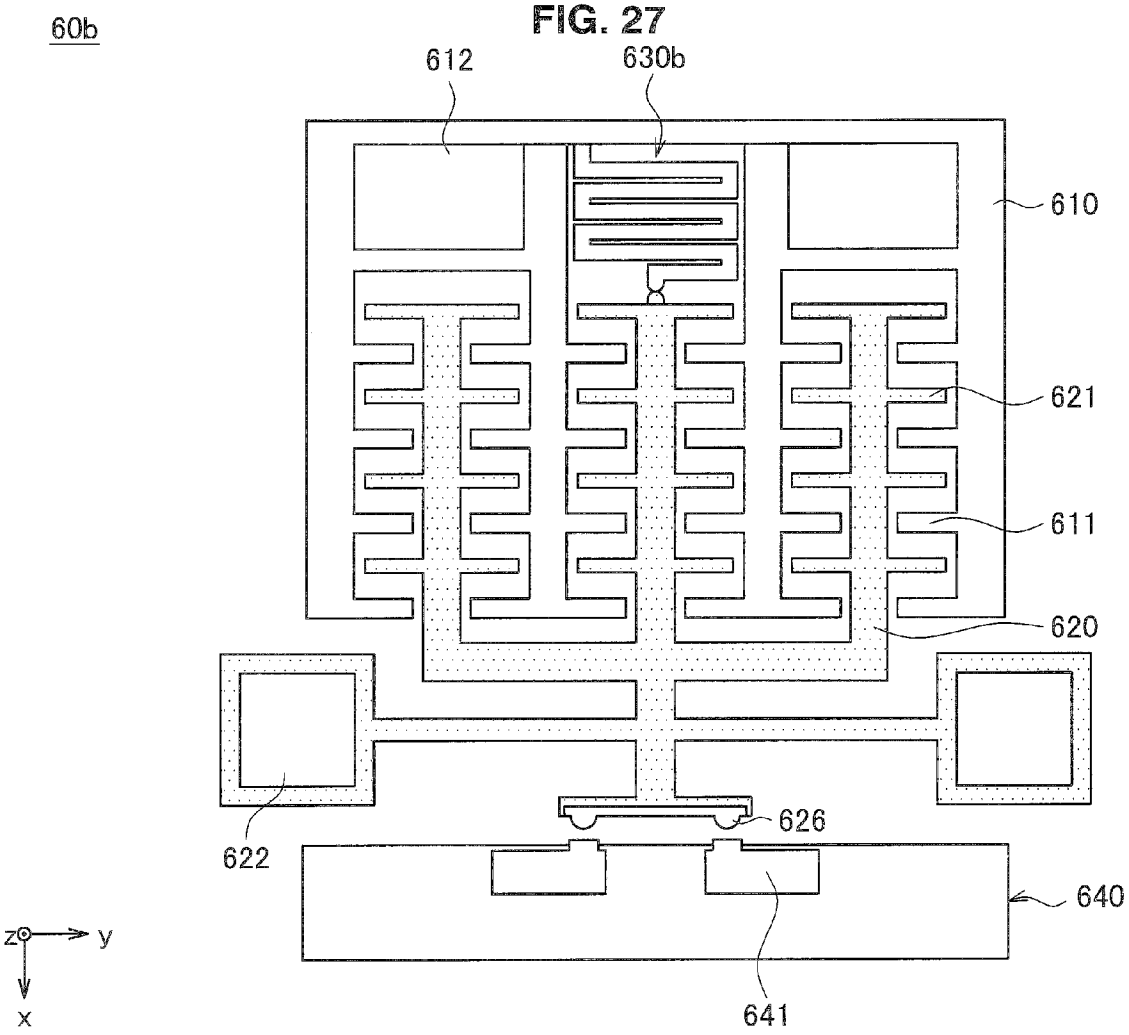
FIG. 27 is a top view illustrating an example of the configuration of an electronic device according to a modification example in which the high-resistance portion of the fuse is formed by another method.

Next, the modification example in which the high-resistance portion of the fuse is formed according to another method will be described with reference to FIG. 27. FIG. 27 is a top view illustrating an example of the configuration of the electronic device according to the modification example in which the high-resistance portion of the fuse is formed according to another method. FIG. 27 is a drawing corresponding to FIG. 19 described above and is a top view illustrating the electronic device according to the modification example.

Referring to FIG. 27, an electronic device 60*b* according to the modification example includes a fixed member 610, a movable member 620, and a fuse 630*b* that electrically connects the fixed member 610 to the movable member 620. Here, since the configurations of the fixed member 610 and the movable member 620 are the same as the configurations of these members illustrated in FIG. 19, the detailed description will be omitted.

The fuse 630*b* according to the modification example does not include the high-resistance portion of which a resistance value is changed by adjusting the impurity concentration, but a predetermined resistance value is realized by the shape of the fuse 630*b*. Specifically, as illustrated in FIG. 27, the fuse 630*b* extends to draw a meandering trajectory in the x-y plane and is formed to extend between the fixed member 610 and the movable member 620. Since the length of the fuse 630*b* can be lengthened further in this configuration, the resistance value in the fuse 630*b* can be set to be larger without adjustment of the impurity concentration. According to the modification example, for example, since it is possible to omit the fabrication of a mask or the like used at the time of the fabrication of the high-resistance portion in an ion injection process, the manufacturing cost can be reduced.

Even in the fuse 630*b* having such a configuration, the same advantages as those of the above-described embodiment can be obtained by appropriately designing the shape of the fuse 630*b* or the resistance value desired in the fuse 630*b* according to the method described in the foregoing [2-3. Detailed design of fuse]. For example, the length of the fuse 630*b* may be appropriately designed so that the resistance value desired in the fuse 630*b* is realized according to the resistance value of the substrate material, the cross-sectional shape of the fuse 630*b*, or the like.

The modification example of the position at which the high-resistance portion of the fuse is formed and the method of forming the high-resistance portion have been described with reference to FIGS. 26 and 27. According to the modification example, as described above, the high-resistance portions 631*a* may be formed in certain sites between the fixed member 610 and the movable member 620 and the positions at which the high-resistance portions 631*a* are formed are not limited. Therefore, the degree of freedom at the time of the design of the fuse 630*b* is improved. According to the modification example, the fuse 630*b* with the predetermined resistance value is realized by changing the shape of the fuse 630*b* without adjustment of the impurity concentration using a process such as an ion injection process or a thermal diffusion process when the high-resistance portion is formed. Therefore, the manufacturing cost can be reduced.

(2-4-2. Modification Example of Shape of Fuse)

In the embodiment described above with reference to FIGS. 19 to 21, the fuse 630 has a configuration in which the fracture portion 632 extending in the y-axis direction (that is, the direction perpendicular to the x-axis direction which is the movement direction of the movable member 620) having the narrower width than the other regions in the x-axis direction in the partial region is formed. The fracture portion 632 functions as the stress concentration portion on which the stress is concentrated when the movable member 620 is moved. In the second embodiment, however, the fuse 630 may electrically connect the fixed member 610 to the movable member 620 and may be formed to be fractured when the electronic device 60 is driven. The shape of the fuse 630 is not limited to the above-described example. The fuse 630 may have another shape.

Here, as a modification example of the second embodiment, a modification example in which the fuse has another shape will be described. The modification example corresponds to an example in which the configuration of the fuse 630 is altered in the embodiment described with reference to FIGS. 19 to 21 and the other remaining configurations, e.g., the configurations of the fixed member 610 and the movable member 620 may be the same as those of the foregoing embodiment. Accordingly, in the description of the following modification, differences from the above-described embodiment will be mainly described and the detailed description of the repeated factors will be omitted.

Figure 28:
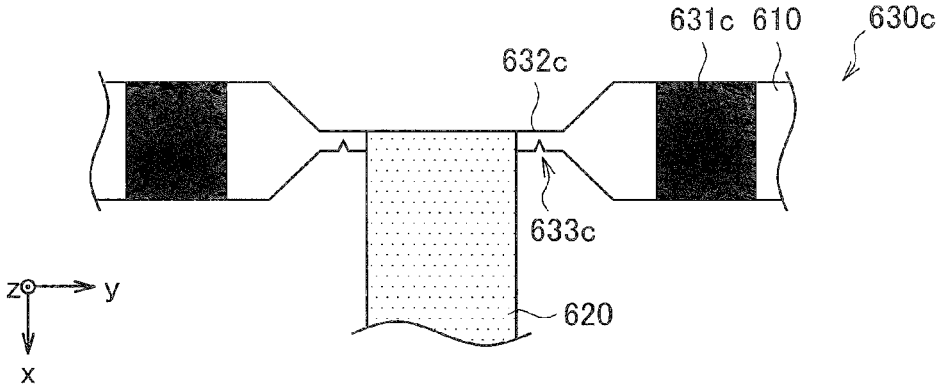
FIG. 28 is a top view illustrating an example of the configuration of a fuse according to a modification example in which a notch is formed.

A modification example in which a notch is formed in the fuse will be described with reference to FIG. 28. FIG. 28 is a top view illustrating an example of the configuration of the fuse according to a modification example in which the notch is formed. FIG. 28 is a drawing corresponding to FIG. 21 described above and corresponds to an enlarged view of a predetermined region including the fuse and the periphery of the fuse in the configuration of the electronic device according to the modification example.

Referring to FIG. 28, a fuse 630*c* according to the modification example is formed between the fixed member 610 and the movable member 620 and electrically connects the fixed member 610 and the movable member 620 to each other. The fuse 630*c* includes a high-resistance portion 631*c* and a fracture portion 632*c*. Here, the fuse 630*c* corresponds to, for example, the fuse 630 illustrated in FIGS. 19 and 22 and the shape of the fuse 630*c* may be the same as the shape of the fuse 630. The high-resistance portion 631*c* and the fracture portion 632*c* correspond to the high-resistance portion 631 and the fracture portion 632 of the fuse 630 and each of them has the same configuration as high-resistance portion 631 and the fracture portion 632, respectively.

In the fuse 630*c* according to the modification example, a notch 633*c* is formed in a partial region of the fracture portion 632*c*. The notch 633*c* may be formed in the x-axis direction which is the movement direction of the movable member 620. The notch 633*c* can function as a stress concentration portion when the movable member 620 is moved and a stress is applied to the fuse 630*c*. Therefore, by forming the notch 633*c*, the fracture stress of the fuse 630*c* can be further reduced. Accordingly, the fuse 630*c* can be fractured with a smaller electrostatic attractive force. By appropriately adjusting the shape of the notch 633*c*, it is possible to adjust the magnitude of the fracture stress. For example, as the depth of the notch 633*c* is larger in the x-axis direction, the fracture stress of the fuse 630*c* is smaller. The shape of the notch 633*c* may be appropriately adjusted so that the fracture stress by which the fuse 630*c* is not fractured by the stress applied during the manufacturing process and the fuse 630*c* can be fractured when the electronic device 60 is driven is realized.

Here, in the foregoing second embodiment, the fuse 630 is fractured by moving the movable member 620 and applying the force to the fuse 630 extending in the y-axis direction, but the second embodiment is not limited to this example. For example, the fuse 630 may be formed to extend in the x-axis direction which is the movement direction of the movable member 620.

Figure 29:
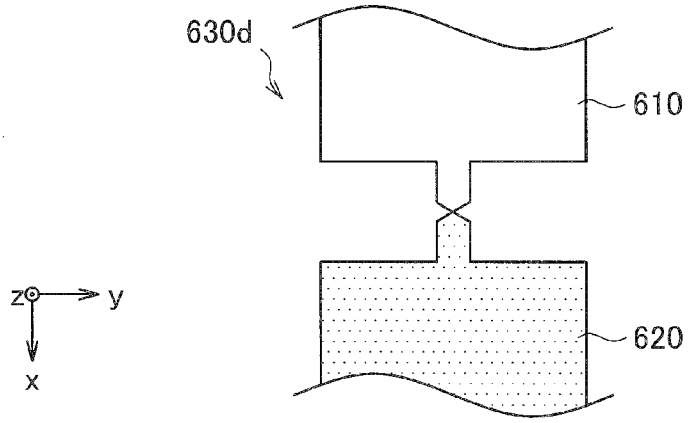
FIG. 29 is a top view illustrating an example of the configuration of a fuse according to a modification example in which the fuse extends in a direction parallel to a movement direction of a movable member.
Figure 30:
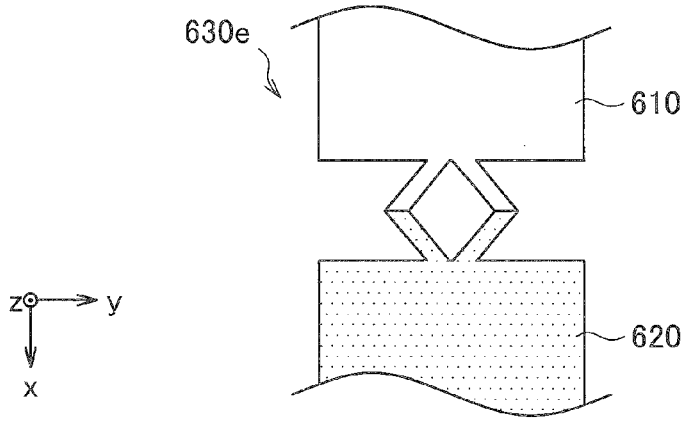
FIG. 30 is a top view illustrating another example of the configuration of the fuse according to a modification example in which the fuse extends in a direction parallel to a movement direction of a movable member.

A modification example in which the fuse is formed to extend in a direction parallel to the movement direction of the movable member 620 will be described with reference to FIGS. 29 and 30. FIG. 29 is a top view illustrating an example of the configuration of the fuse according to the modification example in which the fuse is formed to extend in the direction parallel to the movement direction of the movable member 620. FIG. 30 is a top view illustrating another example of the configuration of the fuse according to a modification example in which the fuse is formed to extend in the direction parallel to the movement direction of the movable member 620. FIGS. 29 and 30 correspond to enlarged views of a predetermined region including the fuse and the periphery of the fuse in the configuration of the electronic device according to the modification example.

Referring to FIG. 29, a fuse 630*d* according to the modification example is formed between the fixed member 610 and the movable member 620 and electrically connects the fixed member 610 and the movable member 620 to each other. Here, the fuse 630*d* is formed to extend in the x-axis direction between the fixed member 610 and the movable member 620. When the movable member 620 is moved in the positive direction (the lower direction in the drawing) of the x axis, a tensile stress is applied to the fuse 630*d* in the x-axis direction and the fuse 630*d* is fractured. In this way, by forming the fuse 630*d* to extend in the x-axis direction, the fuse 630*d* can be formed with a smaller area, and thus further miniaturization of the electronic device can be realized.

As illustrated in FIG. 29, a site with a narrower width than the other region in the y-axis direction can be formed in a partial region of the fuse 630*d*. When the movable member 620 is moved in the positive direction of the x axis, the stress is concentrated on the site. Therefore, the fuse 630*d* is fractured more easily.

Although not explicitly illustrated in FIG. 29, a high-resistance portion with a higher resistance value than the other regions can be appropriately formed in a partial region of the fuse 630*d* according to the modification example. The position at which the high-resistance portion is formed and the resistance value of the high-resistance portion may be appropriately set so that the high-resistance portion has the same function as the high-resistance portion 631 of the fuse 630 according to the foregoing embodiment.

As illustrated in FIG. 30, a fuse 630*e* formed to extend in the x-axis direction may be formed to have a ringed structure in the x-y plane. In the example illustrated in FIG. 30, the fuse 630*e* is formed to have a rhombic shape in the x-y plane between the fixed member 610 and the movable member 620 and electrically connects the fixed member 610 and the movable member 620 to each other. When the movable member 620 is moved in the positive direction (the lower direction in the drawing) of the x axis, a tensile stress is applied to the fuse 630*e* in the x-axis direction and the fuse 630*e* is fractured. Here, in the modification example, since the fuse 630*e* has the rhombic shape and includes a site protruding in the y-axis direction, a bending stress is applied to the site. The fuse 630*e* can be fractured with the smaller stress than that of the fuse 630*d* illustrated in, for example, FIG. 29. In the modification example, the fuse 630*e* may have a ringed structure in the x-y plane and the shape of the fuse 630*e* is not limited to the rhombic shape illustrated in FIG. 30. For example, the fuse 630*e* may be formed to have a substantially circular shape in the x-y plane.

Although not explicitly illustrated in FIG. 30, a high-resistance portion with a higher resistance value than the other regions can be appropriately formed in a partial region of the fuse 630*e* according to the modification example. The position at which the high-resistance portion is formed and the resistance value of the high-resistance portion may be appropriately set so that the high-resistance portion has the same function as the high-resistance portion 631 of the fuse 630 according to the foregoing embodiment.

The modification example in which the notch is formed in the fuse has been described above with reference to FIG. 28. According to the modification example, by forming the notch 633*c* in the fuse 630*c*, the fracture stress of the fuse 630*c* can be reduced further. Therefore, the fuse 630*c* can be fractured with a smaller driving force. The modification example in which the fuse extends in the direction parallel to the movement direction of the movable member 620 has been described with reference to FIGS. 29 and 30. In the modification example, the fuses 630*d* and 630*e* can be formed with the smaller areas than when the fuse 630 is formed to extend in the direction perpendicular to the movement direction of the movable member 620. Therefore, further miniaturization of the electronic device can be realized.

(2-4-3. Modification Example in which Re-Contact Prevention Mechanism of Fuse) after Fracture is Formed In the embodiment described above with reference to FIGS. 19 to 21, when the fuse 630 is fractured, the fuse 630 after the fracture has a shape similar to a pair of cantilevers each supported in the connection sites with the fixed member 610 or the movable member 620. When the potential difference between the fixed member 610 and the movable member 620 of the electronic device 60 becomes zero (that is, a switch is turned off), the movable member 620 returns to the original position by a force of restitution of a return spring. Therefore, there is a concern of the fracture surfaces of the fuse 630 coming into re-contact with each other. When the fracture surfaces of the fuse 630 come into re-contact with each other and the potential difference is supplied between the fixed member 610 and the movable member 620 again (that is, when the switch is turned on), a current flows between the fixed member 610 and the movable member 620, although the current is slight. Therefore, there is a concern of power consumption increasing or a switching speed deteriorating.

Accordingly, in the modification example, a re-contact prevention mechanism is formed so that the fuse 630 after the fracture does not come into re-contact. The re-contact prevention mechanism can be realized as, for example, a mechanism that fixes the position of the fuse 630 after the fracture to a position different from the position of the fuse 630 before the fracture. As a modification example of the second embodiment, a modification example in which such a re-contact prevention mechanism of the fuse after the fracture is formed will be described. The modification example corresponds to an example in which the configuration of the fuse 630 is altered in the embodiment described with reference to FIGS. 19 to 21 and the other remaining configurations, e.g., the configurations of the fixed member 610 and the movable member 620 may be the same as those of the foregoing embodiment. Accordingly, in the description of the following modification, differences from the above-described embodiment will be mainly described and the detailed description of the repeated factors will be omitted.

Figure 31A:
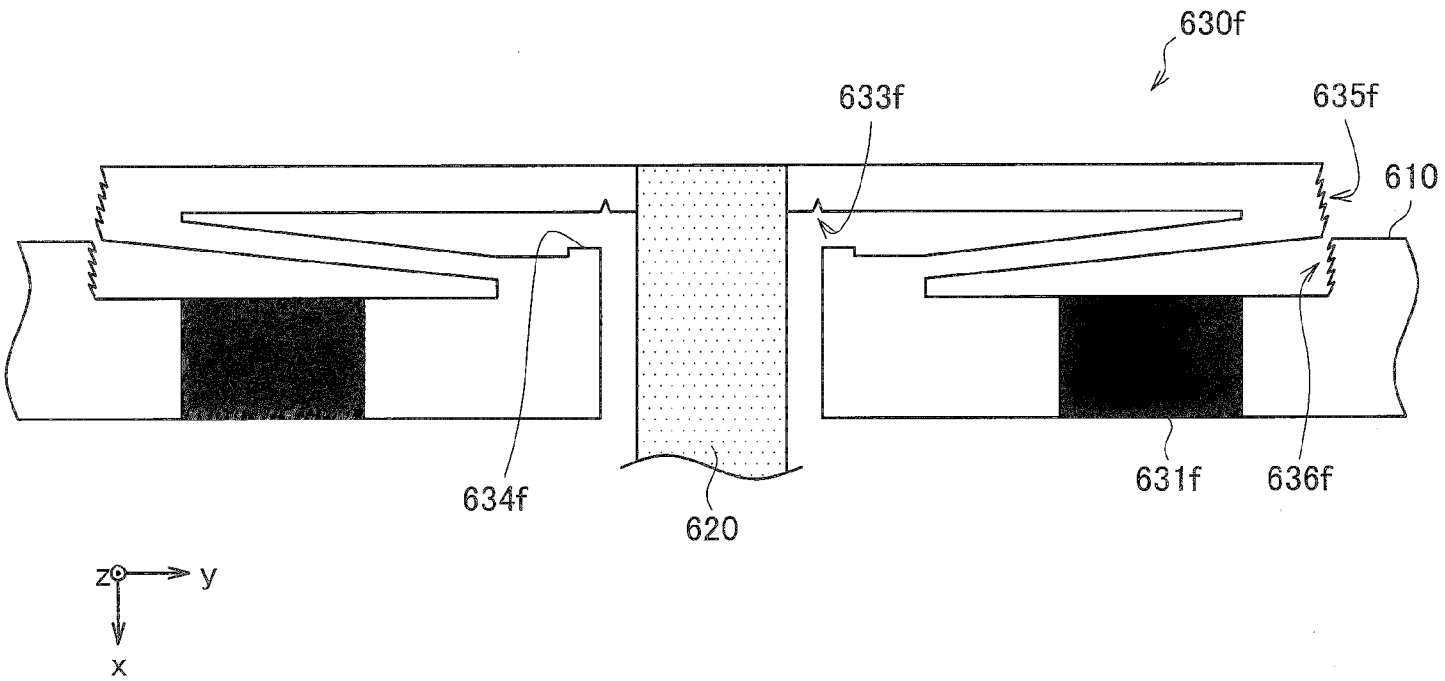
FIG. 31A is a top view illustrating an example of the configuration of a fuse according to a modification example in which a re-contact prevention mechanism of the fuse after fracture is formed.
Figure 31B:
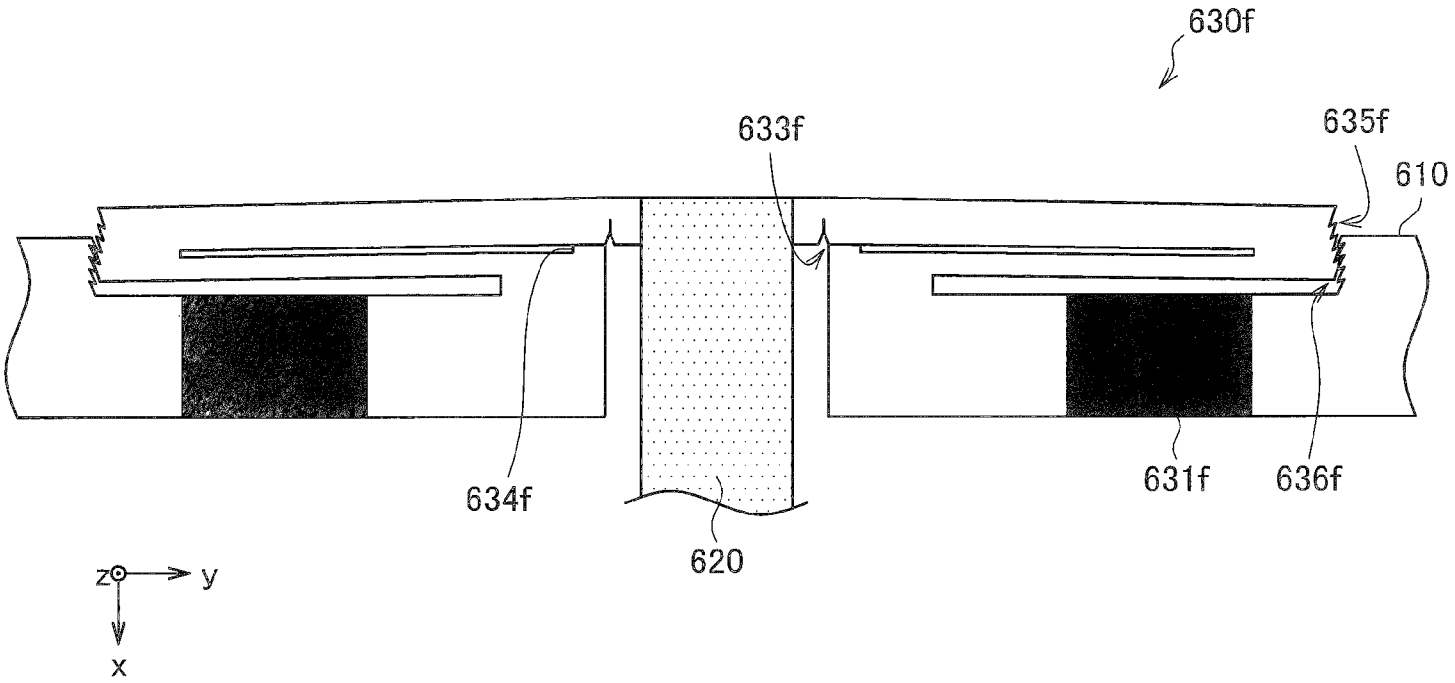
FIG. 31B is a top view illustrating the example of the configuration of the fuse according to the modification example in which the re-contact prevention mechanism of the fuse after fracture is formed.
Figure 31C:
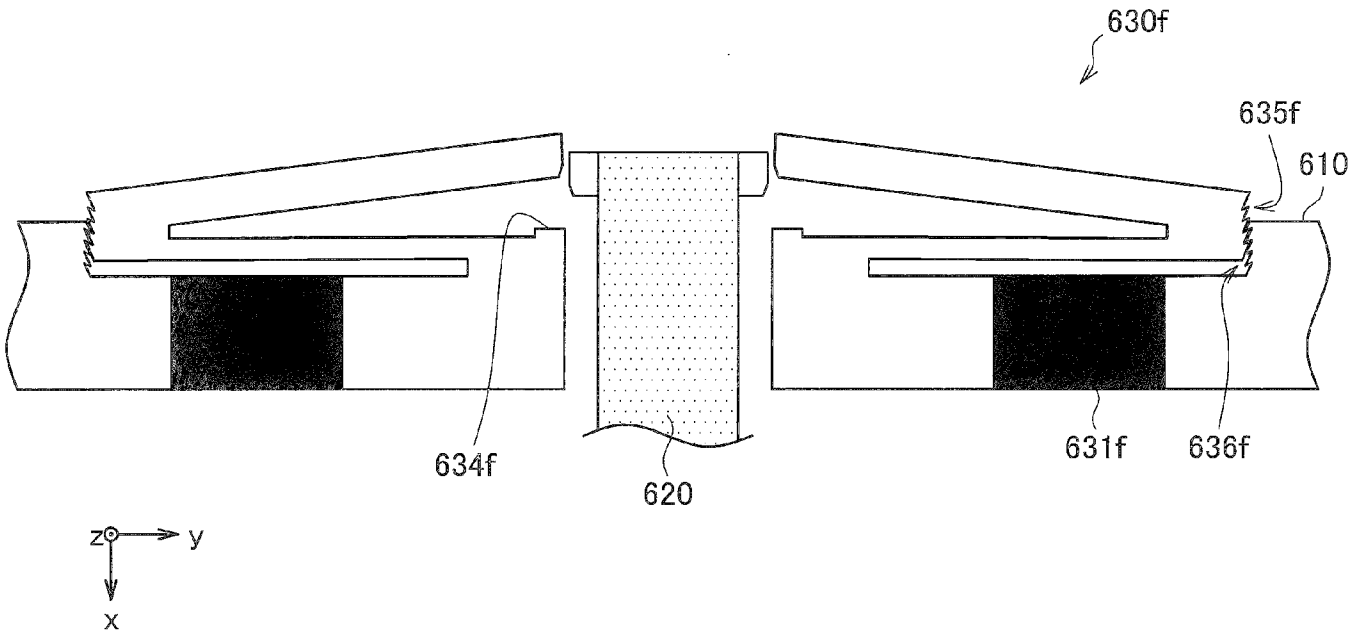
FIG. 31C is a top view illustrating the example of the configuration of the fuse according to the modification example in which the re-contact prevention mechanism of the fuse after fracture is formed.

First, an example of the configuration of the fuse according to the modification example in which the re-contact prevention mechanism of the fuse after the fracture is formed will be described with reference to FIGS. 31A to 31C. FIGS. 31A to 31C are top views illustrating an example of the configuration of the fuse according to the modification example in which the re-contact prevention mechanism of the fuse after fracture is formed. FIGS. 31A to 31C correspond to enlarged drawings of a predetermined region including the fuse and the periphery of the fuse in the configuration of the electronic device according to the modification example.

FIG. 31A illustrates a form of the fixed member 610 and the movable member 620 before the fracture of the fuse and a fuse 630*f* according to the modification example. Referring to FIG. 31A, the fuse 630*f* according to the modification example is formed between the fixed member 610 and the movable member 620 and electrically connects the fixed member 610 and the movable member 620 to each other. A high-resistance portion 631*f* is formed in a partial region of the fuse 630*f*. Here, the fuse 630*f* corresponds to, for example, the fuse 630 illustrated in FIGS. 19 and 22 and may be the same as the fuse 630 in that the fuse 630*f* has electric characteristics, i.e., the fuse 630*f* electrically connects the fixed member 610 to the movable member 620 so that no sticking occurs and has a sufficient resistance value to move the movable member 620 so that a fracture-enabled stress occurs. The high-resistance portion 631*f* corresponds to the high-resistance portion 631 of the fuse 630 and may have the same electric characteristics.

The fuse 630*f* according to the modification example includes a first contact surface which comes into contact with the fixed member 610 when the fuse 630*f* is fractured (that is, a stress is applied and deformation occurs by moving the movable member 620). A first occlusion projection 635*f* is formed on the first contact surface. In the fixed member 610, a second occlusion projection 636*f* fitted to the first occlusion projection 635*f* is formed on a second contact surface which comes into contact with the first contact surface when the fuse 630*f* is fractured. When the stress is applied and the fuse 630*f* is deformed, the first occlusion projection 635*f* is fitted to the second occlusion projection 636*f*, so that a partial region of the fuse 630*f* is fixed to the fixed member 610. In this state, even when the fuse 630*f* is fractured and the movable member 620 returns to the original position, the partial region of the fuse 630*f* after the fracture is fixed to the fixed member 610 via the first occlusion projection 635*f* and the second occlusion projection 636*f* and the position of the fuse 630*f* after the fracture is fixed to the position different from the position of the fuse 630*f* before the fracture. Therefore, the re-contact of the fuse 630*f* after the fracture is prevented.

The configuration of the fuse 630*f* will be described in more detail with reference to FIGS. 31A to 31C. In the example illustrated in FIG. 31A, the fuse 630*f* extends to have substantially a Z shape in the x-y plane. One end of the Z shape is connected to the movable member 620 and the other end thereof is connected to the fixed member 610. A notch 633*f* is formed near the connection site of the fuse 630*f* with the movable member 620. The notch 633*f* may have the same function and configuration as the notch 633*c* described with reference to FIG. 28 in the foregoing (2-4-2. Modification example of shape of fuse). A projection 634*f* is formed in a site of the fuse 630*f* facing the notch 633*f*. The projection 634*f* has a function of pressurizing the vicinity of the notch 633*f* and supplying a bending stress to the fuse 630*f* when the movable member 620 is moved in the positive direction of the x axis.

The first occlusion projection 635*f* is formed in an end surface (corresponding to the above-described first surface) facing the fixed member 610 of the site of the Z shape extending in the y-axis direction (horizontal direction in the drawing). The second occlusion projection 636*f* which can be fitted to the first occlusion projection 635*f* is formed on a surface (corresponding to the above-described second surface) facing the end surface of the fuse 630*f* of the fixed member 610. As illustrated in FIG. 31A, the first occlusion projection 635*f* and the second occlusion projection 636*f* have a saw-like shape in which a plurality of uneven shapes are formed in the x-y plane. For example, the first occlusion projection 635*f* and the second occlusion projection 636*f* can be formed using processes such as photolithography and dry etching.

FIG. 31B illustrates a form in which the electronic device according to the modification example is driven and the movable member 620 is moved in the positive direction of the x axis. As described above, by moving the movable member 620 in the positive direction of the x axis, the projection 634*f* pressurizes the vicinity of the notch 633*f* and the bending stress is supplied to the fuse 630*f*. Since the notch 633*f* can function as a stress concentration portion in the fuse 630*f*, for example, a crack extends from the notch 633*f* in the x-axis direction and the fuse 630*f* can be fractured. As illustrated in FIG. 31B, by moving the movable member 620 in the positive direction of the x axis, the first surface of the fuse 630*f* comes into contact with the second surface of the fixed member 610 and the first occlusion projection 635*f* is fitted to the second occlusion projection 636*f*. Thus, the partial region (first surface) of the fuse 630*f* is fixed to the fixed member 610 via the first occlusion projection 635*f* and the second occlusion projection 636*f*.

FIG. 31C illustrates a form in which, after the fuse 630*f* is fractured, the movable member 620 returns to the original position (that is, the position of the movable member 620 when the potential difference between the fixed member 610 and the movable member 620 is zero). As described above, since the partial region of the fuse 630*f* is fixed to the fixed member 610 via the first occlusion projection 635*f* and the second occlusion projection 636*f*, the position of the fuse 630*f* after the fracture is fixed to the position different from the position of the fuse 630*f* before the fracture, as illustrated in FIG. 31A. In the example illustrated in FIG. 31C, the fuse 630*f* after the fracture is fixed at the position raised in the negative direction (the upper direction in the drawing) of the x axis. Accordingly, when the movable member 620 returns to the original position, the fracture surfaces of the fuse 630*f* are prevented from coming into re-contact with each other.

Figure 32A:
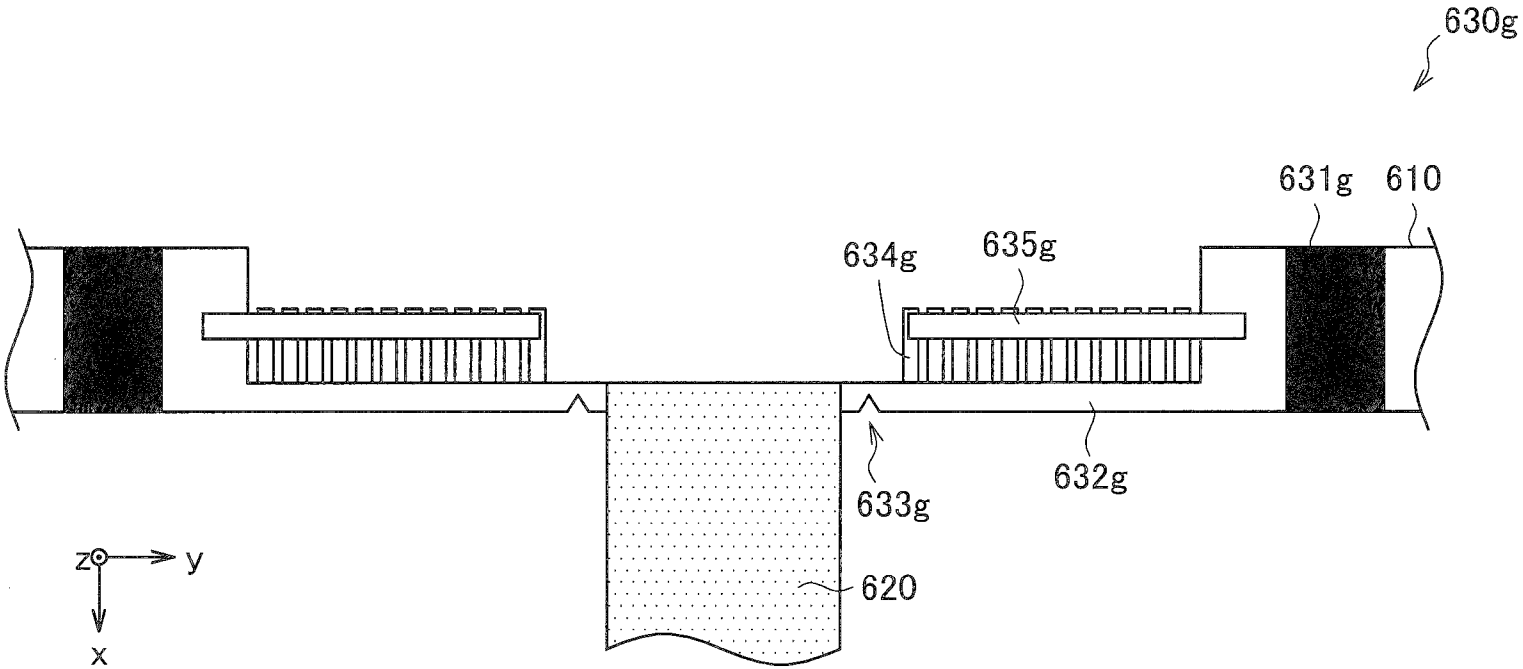
FIG. 32A is a top view illustrating another example of the configuration of a fuse according to a modification example in which a re-contact prevention mechanism of the fuse after fracture is formed.
Figure 32B:
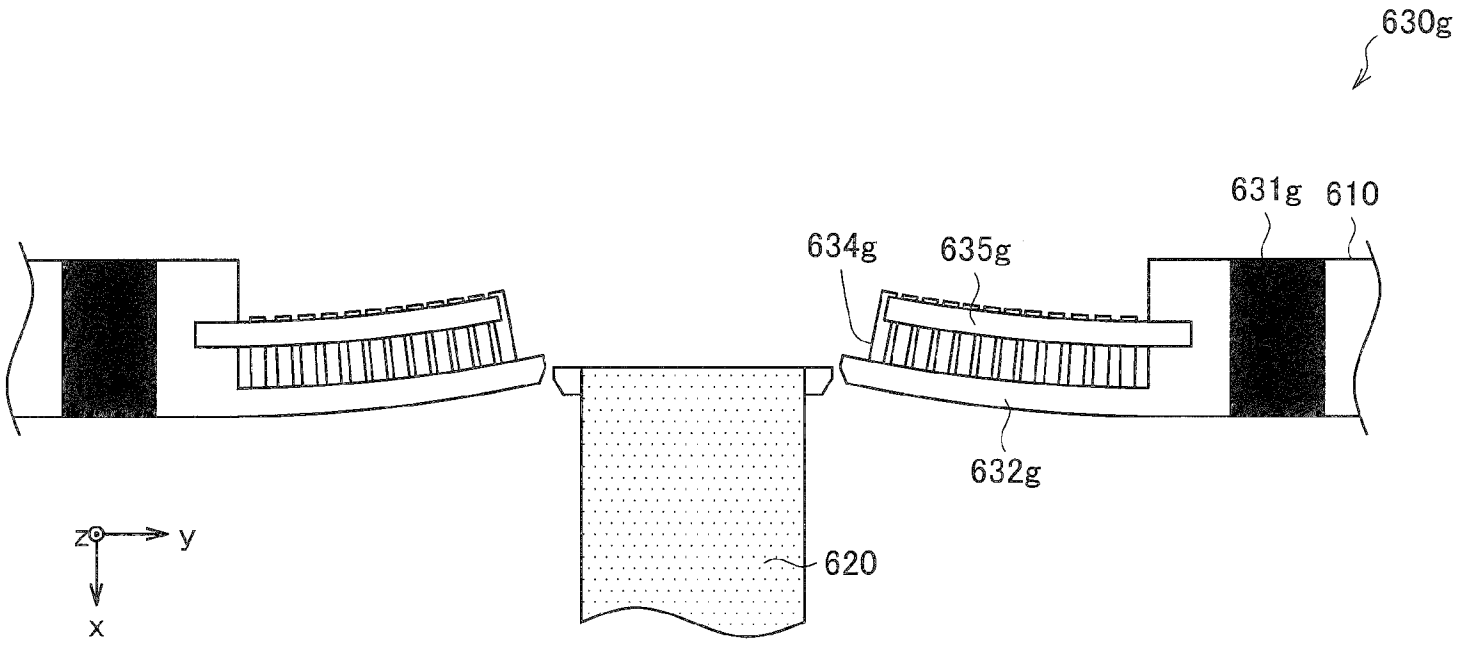
FIG. 32B is a top view illustrating another example of the configuration of a fuse according to a modification example in which a re-contact prevention mechanism of the fuse after fracture is formed.

Next, another example of the configuration of the fuse according to the modification example in which the re-contact prevention mechanism of the fuse after the fracture is formed will be described with reference to FIGS. 32A and 32B. FIGS. 32A and 32B are top views illustrating another example of the configuration of the fuse according to the modification example in which the re-contact prevention mechanism of the fuse after fracture is formed. FIGS. 32A and 32B correspond to enlarged drawings of a predetermined region including the fuse and the periphery of the fuse in the configuration of the electronic device according to the modification example.

FIG. 32A illustrates a form of the fixed member 610 and the movable member 620 before the fracture of the fuse and a fuse 630*g* according to the modification example. Referring to FIG. 32A, the fuse 630*g* according to the modification example is formed between the fixed member 610 and the movable member 620 and electrically connects the fixed member 610 and the movable member 620 to each other. A high-resistance portion 631*g* is formed in a partial region of the fuse 630*g*. Here, the fuse 630*g* corresponds to, for example, the fuse 630 illustrated in FIGS. 19 and 22 and may be the same as the fuse 630 in that the fuse 630*g* has electric characteristics, i.e., the fuse 630*g* electrically connects the fixed member 610 to the movable member 620 so that no sticking occurs and has a sufficient resistance value to move the movable member 620 so that a fracture-enabled stress occurs. The high-resistance portion 631*f* corresponds to the high-resistance portion 631 of the fuse 630 and may have the same electric characteristics.

The fuse 630*g* according to the modification example has a configuration in which a metal film is formed on the substrate material. By deforming the shape of the fuse 630*g* after the fracture by a residual stress in the metal film, the re-contact of the fuse 630*g* after the fracture is prevented.

The configuration of the fuse 630*g* will be described in more detail with reference to FIGS. 32A and 32B. In the example illustrated in FIG. 32A, the fuse 630*g* is formed to have a beam shape extending in the y-axis direction. A notch 633*g* is formed near the connection site of the fuse 630*g* with the movable member 620. The notch 633*g* may have the same function and configuration as the notch 633*c* described with reference to FIG. 28 in the foregoing (2-4-2. Modification example of shape of fuse). When the electronic device according to the modification example is driven and a stress is applied to the fuse 630*g*, the notch 633*g* functions as a stress concentration portion, a crack extends from the notch 633*g* in the x-axis direction, and the fuse 630*g* can be fractured.

On one surface of the fuse 630*g* parallel to the y-z plane of the beam shape, a plurality of fins 634*g* protruding in the x-axis direction which is a direction perpendicular to the extension direction (y-axis direction) of the beam are formed to be arranged in the y-axis direction. A metal film 635*g* is erected on the plurality of fins 634*g*. Thus, in the fuse 630*g* according to the modification example, the metal film 635*g* is formed to bridge the plurality of fins 634*g* arranged in the extension direction of the fuse 630*g*. The fins 634*g* and the metal film 635*g* can be formed, for example, by forming the metal film 635*g* in a corresponding region before depth etching of the substrate material is performed to form the fixed electrodes 611 and the movable electrodes 621 and by performing an isotropic etching process on the substrate material immediately below the metal film 635*g* after the depth etching is performed.

FIG. 32B illustrates a form in which, after the electronic device according to the modification example is driven and the fuse 630*g* is fractured, the movable member 620 returns to the original position (that is, the position of the movable member 620 when the potential difference between the fixed member 610 and the movable member 620 is zero). The fuse 630*g* after the fracture can be considered as a cantilever supported in the connection site with the fixed member 610. Here, in general, when a metal film is formed during a semiconductor process, the metal film is known to have a residual stress in its plane. Accordingly, the fuse 630*g* after the fracture is pulled to be curved, for example, in the negative direction (the upper direction in the drawing) of the x axis, as illustrated in FIG. 32B, by the residual stress of the metal film 635*g*. Thus, by the residual stress of the metal film 635*g*, the fuse 630*f* after the fracture is fixed to the position different from the position before the fracture illustrated in FIG. 32A. Accordingly, when the movable member 620 returns to the original position, the fracture surfaces of the fuse 630*g* are prevented from coming into re-contact with each other.

Figure 33:
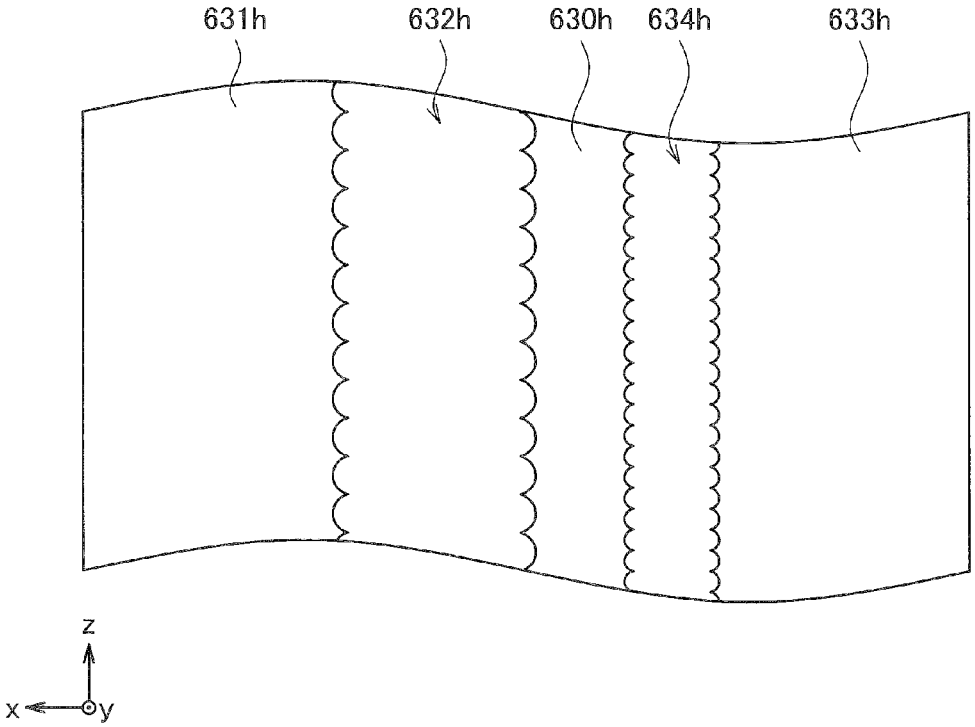
FIG. 33 is an explanatory diagram illustrating still another example of the configuration of a fuse according to a modification example in which a re-contact prevention mechanism of the fuse after fracture is formed.

Next, still another example of the configuration of a fuse according to a modification example in which a re-contact prevention mechanism of the fuse after the fracture is formed will be described with reference to FIG. 33. FIG. 33 is an explanatory diagram illustrating still another example of the configuration of the fuse according to the modification example in which the re-contact prevention mechanism of the fuse after fracture is formed. FIG. 33 corresponds to the sectional view illustrating a predetermined region including the fuse and the periphery of the fuse in the depth direction (that is, the z-axis direction) of the substrate in the configuration of the electronic device according to the modification example. Specifically, FIG. 33 illustrates a form of the cross-sectional surface of the fuse and the substrate material located on both sides of the fuse on the cross-sectional surface (x-z plane) perpendicular to the extension direction of the fuse according to the modification example.

A fuse 630*h* according to the modification example extends in, for example, the y-axis direction, is formed between the fixed member (not illustrated) and the movable member (not illustrated), and electrically connects the fixed member and the movable member to each other. As illustrated in FIG. 33, the fuse 630*h* according to the modification example is formed so that intervals between other members located on both sides are mutually different in a plane (the x-z plane in the drawing) perpendicular to the extension direction. In the example illustrated in FIG. 33, an interval 632*h* between the fuse 630*h* and a member 631*h* located in the positive direction of the x axis of the fuse 630*h* is formed to be greater than an interval 634*h* between the fuse 630*h* and a member 633*h* located in the negative direction of the x axis of the fuse 630*h*. The members 631*h* and 633*h* can be parts of the fixed member and/or the movable member. That is, the intervals 632*h* and 634*h* can be grooves formed when the substrate material is subject to depth etching to form the fixed member, the movable member, and the fuse 630*h*.

Here, in general, when a substrate material is subjected to depth etching to form a groove or a via in a semiconductor process, a wavy rough shape (scallop shape) is known to occur in the depth direction on the inner wall surface of the groove or the via. The scallop shape has a property in which a narrower width of the groove results in narrower intervals of the wavy form and a broader width of the groove results in larger intervals of the wavy form. Accordingly, in the modification example, as illustrated in FIG. 33, the intervals of the wavy shape of the scallop shape at the intervals 632*h* formed to be larger can be narrower than the intervals of the wavy shape of the scallop shape at the intervals 634*h* formed to be narrower.

When a groove is formed by depth etching, a residual stress according to the shape of the wall surface can occur in the in-plane direction of the inner wall surface of the groove. For example, when a scallop shape is formed in the inner wall surface and the intervals of the wavy shape of the scallop shape are different, the value of the residual stress occurring on the inner wall surface is also considered to be different. Accordingly, in the example illustrated in FIG. 33, in the fuse 630*h*, residual stresses with mutually different magnitudes can occur on the wall surface facing in the positive direction of the x axis and the wall surface facing in the negative direction of the x axis. Accordingly, after the fracture, the fuse 630*h* becomes curved in the positive direction or the negative direction of the x axis according to a difference between the residual stresses. Thus, the fuse 630*f* after the fracture is fixed to a position different from the position before the fracture by the residual stress on the side wall of the fuse 630*f*. Accordingly, as in the fuses 630*f* and 630*g* described above with reference to FIGS. 31A to 31C, 32A, and 32B, when the movable member returns to the original position after the fracture of the fuse 630*h*, the fracture surfaces of the fuse 630*h* are prevented from coming in re-contact with each other.

The modification examples in which the re-contact prevention mechanism of the fuse after the fracture is formed have been described above with reference to FIGS. 31A to 31C, 32A, 32B, and 33. In the modification examples, as described above, by using the first occlusion projection 635*f* and the second occlusion projection 636*f* or the residual stress occurring in each constituent member during the manufacturing process, the fuses 630*f*, 630*g*, and 630*h* after the fracture are fixed to the positions different from the positions at which the fuses 630*f*, 630*g*, and 630*h* before the fracture are formed. Accordingly, when the movable member 620 returns to the original position after the fracture of the fuses 630*f*, 630*g*, and 630*h*, the fracture surfaces of the fuses 630*f*, 630*g*, and 630*h* are prevented from coming into re-contact with each other. Accordingly, it is possible to suppress an increase in power consumption in the electronic device or occurrence of the deterioration in the switching speed or the like due to the re-contact of the fractured fuses 630*f*, 630*g*, and 630*h*, and thus an improvement in the performance of the electronic device is realized.

(2-4-4. Modification Example in which the Position at which the Fuse is Formed is Different)

In the embodiment described above with reference to FIGS. 19 to 21, the fuse 630 is formed between the member serving as a base on which the fixed electrodes 611 are erected in the fixed member 610 and the member serving as a base on which the movable electrodes 621 are erected in the movable member 620. In the second embodiment, the fuse 630 may be formed to electrically connect the fixed member 610 to the movable member 620 and to be fractured when the electronic device 60 is driven. The position at which the fuse 630 is formed is not limited to the above-described examples.

As a modification example of the second embodiment, a modification example in which the position at which the fuse is formed is different will be described. The modification example corresponds to an example in which the position at which the fuse 630 is formed is different in the embodiment described with reference to FIGS. 19 to 21 and the other remaining configurations, e.g., the configurations of the fixed member 610 and the movable member 620 may be the same as those of the foregoing embodiment. Accordingly, in the description of the following modification, differences from the above-described embodiment will be mainly described and the detailed description of the repeated factors will be omitted.

Figure 34:
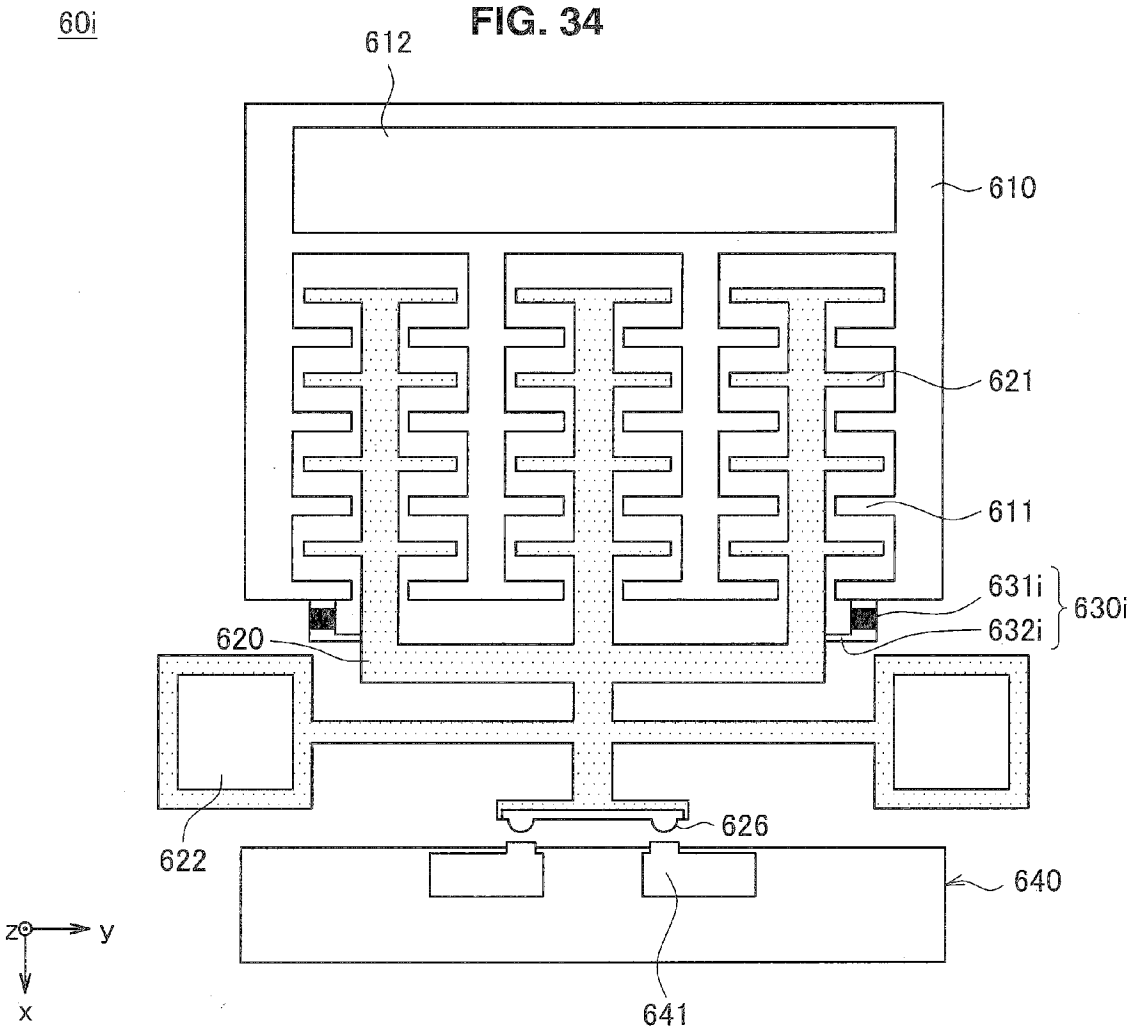
FIG. 34 is a top view illustrating an example of the configuration of an electronic device according to a modification example in which the position at which the fuse is formed is different.

An example of the configuration of the electronic device according to a modification example in which the position at which the fuse is formed is different will be described with reference to FIG. 34. FIG. 34 is a top view illustrating an example of the configuration of the electronic device according to the modification example in which the position at which the fuse is formed is different. FIG. 34 is a drawing corresponding to FIG. 19 described above and is a top view illustrating the electronic device according to the modification example.

Referring to FIG. 34, an electronic device 60*i* according to the modification example includes a fixed member 610, a movable member 620, and a fuse 630*i* that electrically connects the fixed member 610 to the movable member 620. Here, since the configurations of the fixed member 610 and the movable member 620 are the same as the configurations of these members illustrated in FIG. 19, the detailed description will be omitted.

The fuse 630*i* according to the modification example includes a high-resistance portion 631*i* which is formed in a partial region of the fuse 630*i* and has a higher resistance value than the other regions and a fracture portion 632*i* which is formed with a narrower width than the other regions in the fracture direction. Here, the fuse 630*g* corresponds to, for example, the fuse 630 illustrated in FIGS. 19 and 22 and may be the same as the fuse 630 in that the fuse 630*i* has electric characteristics, i.e., the fuse 630*i* electrically connects the fixed member 610 to the movable member 620 so that no sticking occurs and has a sufficient resistance value to move the movable member 620 so that a fracture-enabled stress occurs. The high-resistance portion 631*i* and the fracture portion 632*i* correspond to the high-resistance portion 631 and the fracture portion 632 of the fuse 630 and may have the same functions as the high-resistance portion 631 and the fracture portion 632.

The fuse 630*i* according to the modification example is different from the fuse 630 illustrated in FIG. 19. For example, the fuse 630*i* is formed to have an L shape extending the x-axis direction and the y-axis direction between an exterior portion of the fixed member 610 and the exterior portion of the movable member 620. Even when the fuse 630*i* is formed at such a position, the same advantages as those of the above-described embodiment can be obtained by appropriately designing the shape of the fuse 630*i* and the resistance value desired in the fuse 630*i* according to the same method as the method described in the foregoing [2-3. Detailed design of fuse] and forming the high-resistance portion 631*i* and the fracture portion 632*i*.

Figure 35:
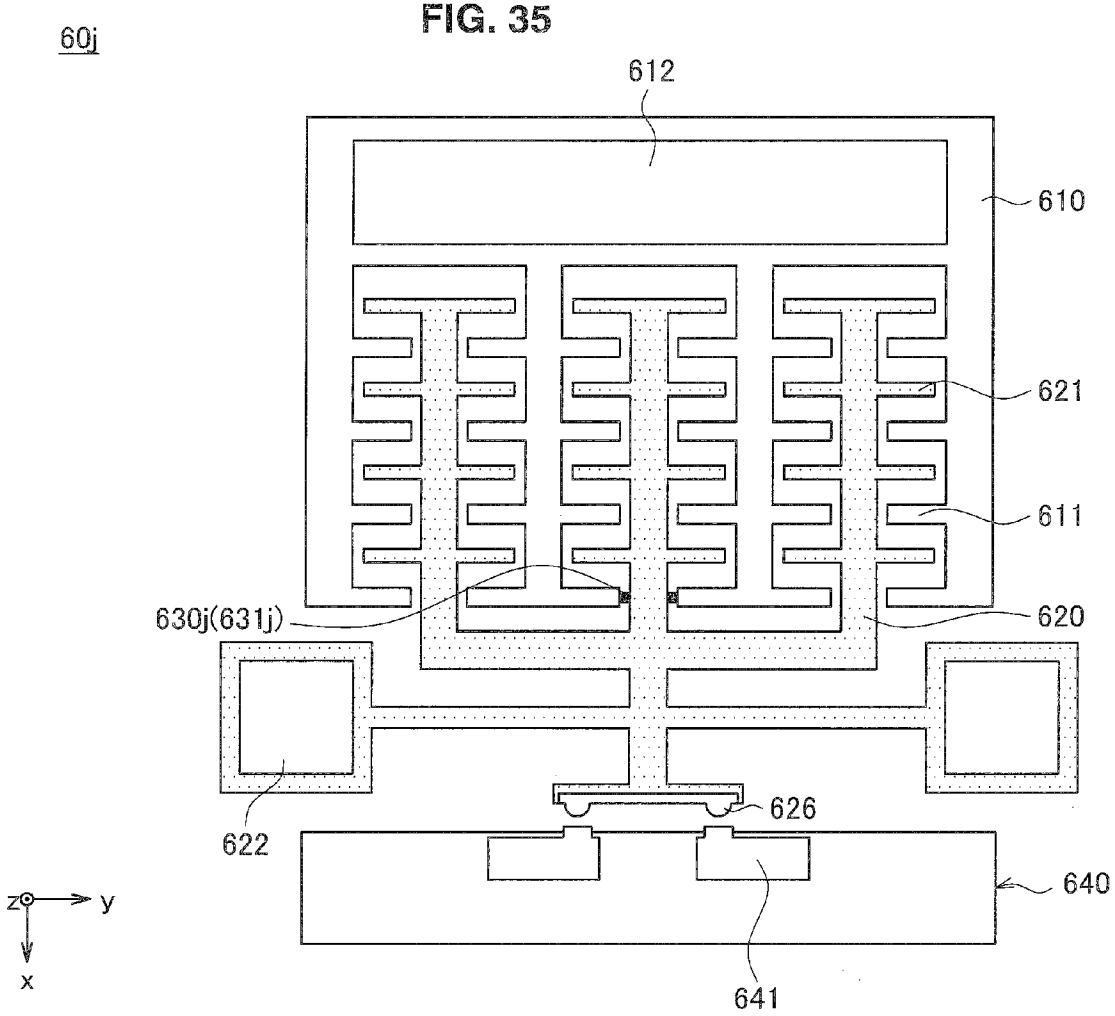
FIG. 35 is a top view illustrating another example of the configuration of an electronic device according to a modification example in which a position at which a fuse is formed differs.

Another example of the configuration of the electronic device according to a modification example in which the position at which the fuse is formed is different will be described with reference to FIG. 35. FIG. 35 is a top view illustrating another example of the configuration of the electronic device according to the modification example in which the position at which the fuse is formed is different.

FIG. 35 is a drawing corresponding to FIG. 19 described above and is a top view illustrating the electronic device according to the modification example. Referring to FIG. 35, an electronic device 60*j* according to the modification example includes a fixed member 610, a movable member 620, and a fuse 630*j* that electrically connects the fixed member 610 to the movable member 620. Here, since the configurations of the fixed member 610 and the movable member 620 are the same as the configurations of these members illustrated in FIG. 19, the detailed description will be omitted.

The fuse 630*j* corresponds to, for example, the fuse 630 illustrated in FIGS. 19 and 22 and may be the same as the fuse 630 in that the fuse 630*j* has electric characteristics, i.e., the fuse 630*j* electrically connects the fixed member 610 to the movable member 620 so that no sticking occurs and has a sufficient resistance value to move the movable member 620 so that a fracture-enabled stress occurs. Although not explicitly illustrated in FIG. 35, the fuse 630*j* may include a high-resistance portion 631*j* which is formed in a partial region of the fuse 630*j* and has a higher resistance value than the other regions and a fracture portion which is formed with a narrower width than the other regions in the fracture direction, as in the fuse 630. The high-resistance portion 631*j* and the fracture portion correspond to the high-resistance portion 631 and the fracture portion 632 of the fuse 630 and may have the same functions as the high-resistance portion 631 and the fracture portion 632.

The fuse 630*j* according to the modification example is different from the fuse 630 illustrated in FIG. 19. For example, the fuse 630*j* is formed to extend in the y-axis direction between the front end of one fixed electrode 611 of the fixed member 610 and the movable member 620. Even when the fuse 630*j* is formed at such a position, the same advantages as those of the above-described embodiment can be obtained by appropriately designing the shape of the fuse 630*j* and the resistance value desired in the fuse 630*j* according to the same method as the method described in the foregoing [2-3. Detailed design of fuse] and forming the high-resistance portion 631*j* and the fracture portion.

The modification examples in which the position at which the fuse is formed is different have been described above with reference to FIGS. 34 and 35. In the embodiment, as described above, the fuses 630*i* and 630*j* may electrically connect the fixed member 610 to the movable member 620 and may be fractured when the electronic device 60 is driven. The positions at which the fuses 630*i* and 630*j* are formed not limited. Accordingly, the degree of freedom at the time of the design of the fuses 630*i* and 630*j* is improved.

Here, in the foregoing (2-4-2. Modification example of shape of fuse) and this section, the modification examples in which the shape of the fuse 630 and the position at which the fuse 630 is formed are changed have been described. The shape of the fuse 630 and the position at which the fuse 630 is formed are preferably designed in consideration of a movement amount or the like of the fuse 630. For example, in the second embodiment, the displacement of the fuse 630 (that is, the displacement of the fracture portion 632) can be comprehended as a state in which a spring with a predetermined spring constant is deformed. When the spring constant is relatively large, the displacement amount of the fuse 630 decreases. However, the electrostatic attractive force necessary for the fracture increases. Conversely, when the spring constant is relatively small, the electrostatic attractive force necessary for the fracture decreases. However, the displacement amount of the fuse 630 increases. It is necessary to design the shape of the fuse 630 and the shape of the fracture portion 632 according to the potential difference supplied between the fixed member 610 and the movable member 620 and the inter-electrode distance between the fixed electrode 611 and the movable electrode 621 (that is, the maximum movement amount when the electronic device 60 is driven).

In the second embodiment, the shapes of the fuse 630 and the fracture portion 632 and the positions at which the fuse 630 and the fracture portion 632 are formed are preferably bilaterally symmetric with respect to a direction in which the electrostatic attractive force acts, i.e., the movement direction of the movable member 620. Here, the bilateral symmetry means a symmetric property in the y-axis direction (right and left directions) in FIG. 19. In a bilaterally asymmetric case of the shape of the fuse 630 after the fracture, there is a probability of the displacement amount of the movable member 620 being bilaterally asymmetric when the electronic device 60 is driven and the movable member 620 is displaced. Thus, there is a concern of the fracture surfaces of the fuse 630 or the fixed electrode 611 and the movable electrode 621 coming into contact with each other. When the fracture surfaces of the fuse 630 or the fixed electrode 611 and the movable electrode 621 come into contact with each other, the current leaks between the fixed member 610 and the movable member 620, and thus the predetermined potential difference is not caused between the fixed member 610 and the movable member 620. Therefore, there is a probability of an operation failure of the electronic device 60.

Accordingly, the shapes of the fuse 630 and the fracture portion 632 and the positions at which the fuse 630 and the fracture portion 632 are formed are preferably designed to be bilaterally symmetric so that the shape of the fuse 630 after the fracture is bilaterally symmetric.

(2-4-5. Modification Example in which Electronic Device is Surface MEMS)

In the embodiment described above with reference to FIGS. 19 to 21, the electronic device 60 according to the second embodiment has been the bulk MEMS fabricated by processing the substrate material by the depth etching. However, the second embodiment is not limited to this example, but the electronic device according to the second embodiment may be a surface MEMS fabricated by processing a metal film layer and the like stacked on the substrate.

Figure 36:
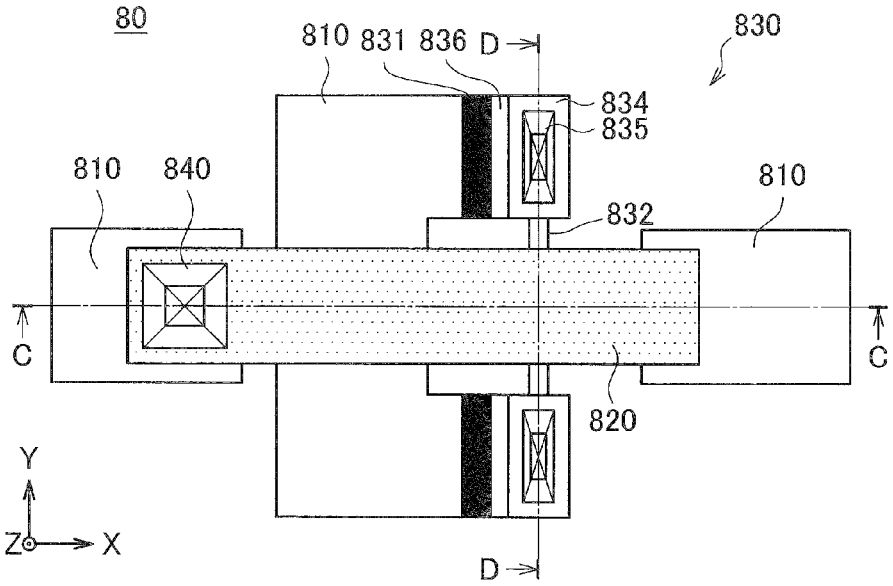
FIG. 36 is a top view illustrating an example of the configuration of an electronic device according to a modification example in which the electronic device is a surface MEMS.
Figure 37:
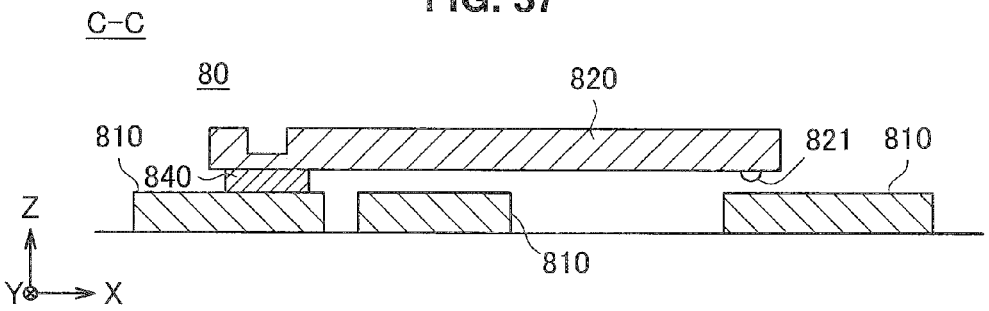
FIG. 37 is a sectional view illustrating the electronic device illustrated in FIG. 36 and taken along the line C-C.
Figure 38:
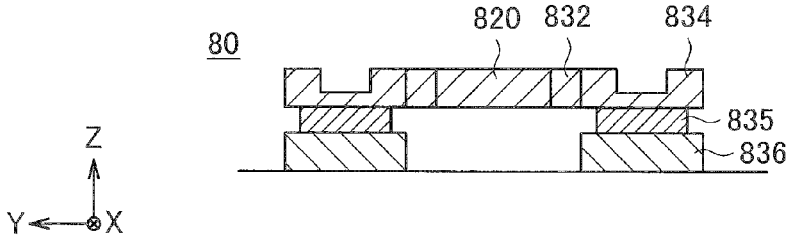
FIG. 38 is a sectional view illustrating the electronic device illustrated in FIG. 36 and taken along the line C-C.

As a modification example of the second embodiment, a modification example in which the electronic device is the surface MEMS will be described. An example of the configuration of the electronic apparatus according to the modification example in which the electronic device is the surface MEMS will be described with reference to FIGS. 36 to 38. FIG. 36 is a top view illustrating an example of the configuration of the electronic device according to the modification example in which the electronic device is the surface MEMS. FIG. 37 is a sectional view illustrating the electronic device illustrated in FIG. 36 and taken along the line C-C. FIG. 38 is a sectional view illustrating the electronic device illustrated in FIG. 36 and taken along the line D-D.

Referring to FIGS. 36 to 38, an electronic device 80 according to the modification example is, for example, a surface MEMS formed on a substrate formed of a semiconductor material such as Si. The electronic device 80 is fabricated by stacking a wiring layer formed of a conductive material such as polysilicon or a metal on the substrate and processing the wiring layer. In FIGS. 36 to 38, only constituents on the substrate are illustrated and the substrate is not illustrated for simplicity.

In the following description, a depth direction of the substrate in which the electronic device 80 is formed is referred to as a Z-axis direction. A direction of a surface of the substrate in which the electronic device 80 is formed is referred to as the upper direction or the positive direction of the Z axis and its opposite direction is referred to as the lower direction or the negative direction of the Z axis. Further, two directions perpendicular to each other in a plane parallel to the surface of the substrate are referred to as the X-axis direction and the Y-axis direction.

Referring to FIGS. 36 to 38, the electronic device 80 includes a fixed member 810 which is formed by a first-layer wiring layer (first wiring layer) formed immediately above the substrate and a movable member 820 which is formed on a second-layer wiring layer (second wiring layer) formed in the upper layer of the first wiring layer. The fixed member 810 and the movable member 820 can both be formed of a conductive material, and thus can be considered as a fixed electrode and a movable electrode, respectively. The movable member 820 is formed to be movable with respect to the fixed member 810 and the movable member 820 is moved to come in and out of contact with the fixed member 810, so that the electronic device 80 functions as a switching element.

Specifically, the movable member 820 has a beam-like shape extending above the fixed member 810 in one direction (the X-axis direction in the example illustrated in FIGS. 36 to 38) in the X-Y plane and is formed to face the fixed member 810 via a predetermined air gap therebetween. One end (fixed end) of the movable member 820 is fixed to the fixed member 810 via, for example, a contact 840 formed in a pillar shape in the Z-axis direction. In the contact 840, the fixed member 810 and the movable member 820 are connected via, for example, an insulation film layer (not illustrated) in an electrical insulation state. On the other hand, at the other end (free end) of the movable member 820, a protrusion 821 protruding toward the fixed member 810 is formed in a partial region of the surface facing the fixed member 810.

When the electronic device 80 is driven, a predetermined potential difference is supplied between the fixed member 810 and the movable member 820. The free end of the movable member 820 is moved to be warped downward by the potential difference and the protrusion 821 comes into contact with the surface of the fixed member 810. Thus, the fixed member 810 and the movable member 820 enter an electrically conductive state, i.e., a switch is turned on. By allowing the potential difference between the fixed member 810 and the movable member 820 to be, for example, zero, the movable member 820 returns to the original position and the fixed member 810 and the movable member 820 enter an electrically insulated state, i.e., the switch is turned off. Thus, the electronic device 80 may be a switching element including a so-called cantilever type mechanism. The electronic device 80 according to the modification example may have a configuration in which the fuse 830 according to the embodiment is formed between the fixed member and the movable member in the surface MEMS including a general cantilever type mechanism. Any of the various known configurations may be applied as the configuration of the surface MEMS.

The electronic device 80 further includes the fuse 830 electrically connecting the fixed member 810 to the movable member 820. The fuse 830 corresponds to, for example, the fuse 630 illustrated in FIGS. 19 and 22 and is formed to electrically connect the fixed member 810 to the movable member 820 so that sticking does not occur and to have a sufficient resistance value to move the movable member 820 so that a stress by which the fuse 830 can be fractured at the time of driving of the electronic device 80 is caused. In the modification example, since the fixed member 810 and the movable member 820 are electrically connected by the fuse 830 during the manufacturing process, sticking between the fixed member 810 and the movable member 820 is prevented during the manufacturing process. The fuse 830 is fractured with the driving of the electronic device 80. Thereafter, the electronic device 80 can be driven in the state in which the fixed member 810 and the movable member 820 are electrically insulated.

The configuration illustrated in FIGS. 36 to 38 shows the electronic device 80 during the manufacturing process and shows the state before the fuse 830 is fractured. Referring to FIGS. 36 to 38, the fuse 830 includes a high-resistance portion 831 and a fracture portion 832. As illustrated in FIGS. 36 to 38, the fracture portion 832 is formed to extend from a partial region in an extension direction (X-axis direction) of the movable member 820 in the direction (Y-axis direction) perpendicular to the extension direction. The movable member 820 is connected to a second connection portion 834 formed by the second wiring layer via the fracture portion 832. The fracture portion 832 is designed to have a width formed in the X-axis direction to be narrower than the movable member 820 or the second connection portion 834 and to be fractured by a stress supplied by downward bending of the free end of the movable member 820.

The second connection portion 834 is formed immediately above the first connection portion 836 formed by the first wiring layer, and thus the first connection portion 836 and the second connection portion 834 are connected by a contact 835 to be electrically conductive. The first connection portion 836 is formed to be electrically connected to the fixed member 810 and is formed in, for example, the same island as the fixed member 810. The high-resistance portion 831 having a resistance value electrically higher than those of the other regions is formed between the fixed member 810 and the first connection portion 836. Thus, in the example illustrated in FIGS. 36 to 38, the fuse 830 includes the high-resistance portion 831, the first connection portion 836, the contact 835, the second connection portion 834, and the fracture portion 832. The fixed member 810 and the movable member 820 are electrically connected via such a configuration.

Thus, in the modification example, the fixed member 810 and the movable member 820 are electrically connected via the high-resistance portion 831. Here, the value of the high-resistance portion 831 is designed so that sticking does not occur between the fixed member 810 and the movable member 820 during the manufacturing process according to the same method as the method described in, for example, the preceding [2-3. Detailed design of fuse] and a sufficient stress to fracture the fracture portion 832 is applied to the fracture portion 832 when the electronic device 80 is driven to move the movable member 820. Likewise, according to the same method as the method described in, for example, the preceding [2-3. Detailed design of fuse], the shape of the fracture portion 832 is designed to have a fracture stress so that the fracture portion can be fractured by a stress applied when the electronic device 80 is driven by a voltage drop in the high-resistance portion 831. Accordingly, in the modification example, the same advantages as those of the above-described embodiment can be obtained by appropriately designing the resistance value of the high-resistance portion 831 and the shape of the fracture portion 832.

An example of the configuration of the electronic device according to the modification example in which the electronic device is the surface MEMS has been described above with reference to FIGS. 36 to 38. In the modification example, as described above, even when the electronic device is the surface MEMS, the sticking is suppressed during the manufacturing process by electrically connecting the fixed member 810 to the movable member 820 by the fuse 830 including the high-resistance portion 831, and the fracture of the fuse 830 is realized by driving the electronic device 80. Accordingly, since it is not necessary to perform a separate process of fracturing the fuse 830, the manufacturing cost is reduced.

The configuration illustrated in FIGS. 36 to 38 is merely an example of the configuration of the electronic device 80 according to the modification example. The configuration of the electronic device 80 according to the modification example is not limited to the illustrated example, but the electronic device 80 may have a configuration of another surface MEMS. Even when the electronic device 80 has another configuration, the same advantages can be obtained by forming the fuse 830 having an appropriate resistance value and shape between the fixed member 810 and the movable member 820.

[2-5. Application Example]

(2-5-1. Application to Switching Element of Electronic Apparatus)

Figure 39:
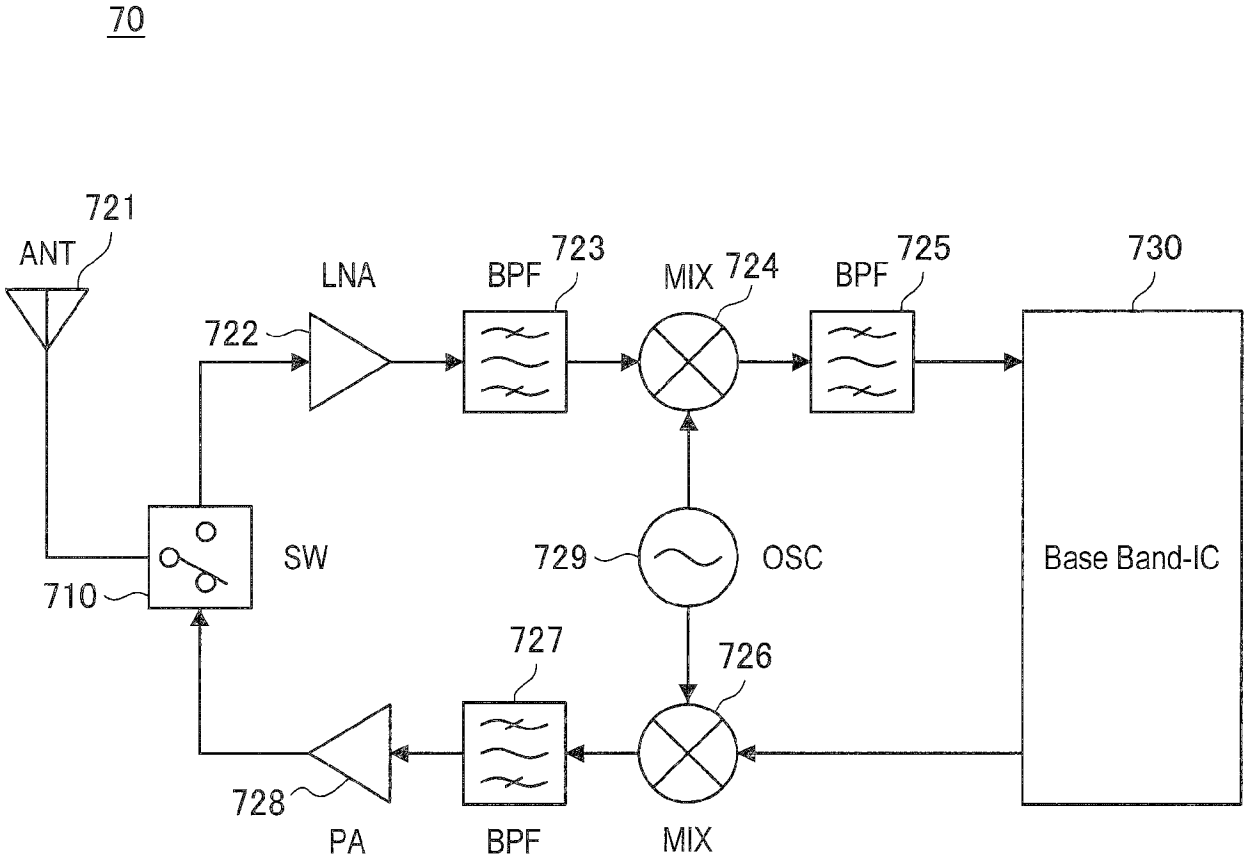
FIG. 39 is a schematic view illustrating an example of the configuration of an electronic apparatus in which the electronic device according to the second embodiment is applied as a switching element.
Figure 40:
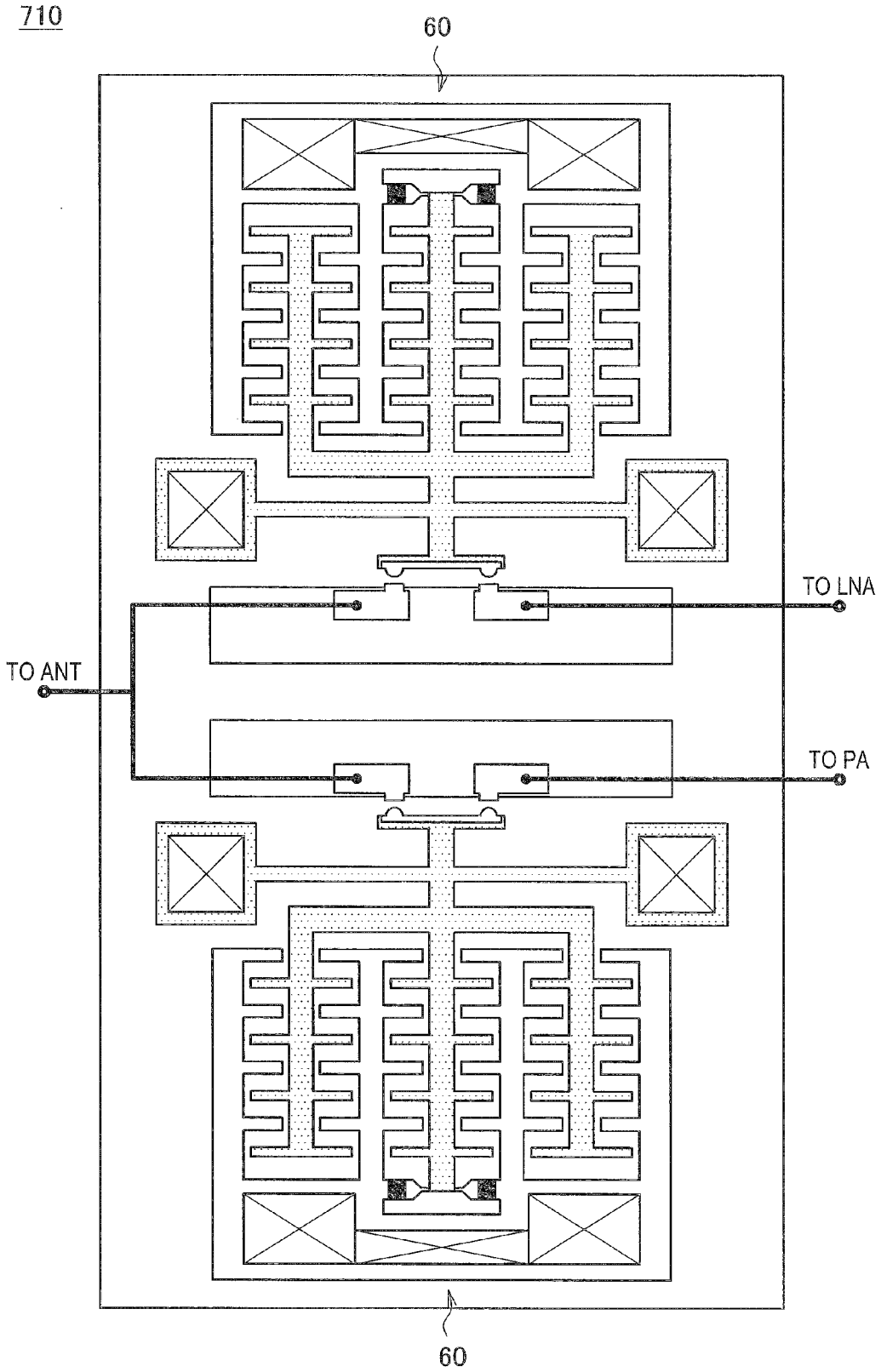
FIG. 40 is a schematic view illustrating an example of the configuration of the switching element illustrated in FIG. 39.

The electronic device 60 according to the second embodiment is properly applicable as, for example, a switching element in any of various electronic apparatuses. An example of the configuration of an electronic apparatus in which the electronic device 60 according to the second embodiment is applied as a switching element will be described with reference to FIGS. 39 and 40. FIG. 39 is a schematic view illustrating an example of the configuration of the electronic apparatus in which the electronic device 60 according to the second embodiment is applied as the switching element. FIG. 40 is a schematic view illustrating an example of the configuration of the switching element illustrated in FIG. 39.

Here, the configuration of a communication apparatus transmitting and receiving various signals to and from another external apparatus via, for example, radio waves will be described as an example of the electronic apparatus to which the electronic device 60 according to the second embodiment is applied. However, the electronic apparatus to which the electronic device 60 according to the second embodiment is applied is not limited to the communication device, but another electronic apparatus may be used as long as a general switching element is formed in the electronic apparatus. The configuration of the communication apparatus is not limited to the configuration exemplified in FIG. 39, but the electronic device 60 according to the second embodiment may be applied to any of the various known communication apparatuses including the switching element.

Referring to FIG. 39, a communication apparatus 70 includes a switching element (SW) 710, an antenna (ANT) 721, a low noise amplifier (LNA) 722, band pass filters (BPF) 723, 725, and 727, mixers (MIX) 724 and 726, a power amplifier (PA) 728, an oscillator (OSC), and a band integrated circuit (IC) 730.

The communication apparatus 70 receives a signal transmitted from another external apparatus via the ANT 721, and then inputs the signal to the base band IC 730 and outputs the signal subjected to a predetermined process by the base band IC 730 to the outside of the communication apparatus 70 via the ANT 721. Specifically, in the communication apparatus 70, after the LNA 722 and the BPF 723 appropriately perform amplification and band filtering on the signal received by the ANT 721, the MIX 724 mixes the signal with a criterion signal having a criterion frequency generated by the OSC 729 and the mixed signal is input to the base band IC 730 via the BPF 725 on the rear stage. In the communication apparatus 70, the MIX 726 mixes the signal subjected to a predetermined process by the base band IC 730 with the criterion signal generated by the OSC 729, and the BPF 727 and the PA 728 appropriately perform band filtering and amplification. Thereafter, the signal is output from the ANT 721 to the outside of the communication apparatus 70.

The switching element 710 is connected to the ANT 721 and has a function of switching a path of a signal in the communication apparatus 70 when the ANT 721 receives the signal and when the ANT 721 transmits the signal. For example, when the ANT 721 receives the signal, the switching element 710 circuit-connects the ANT 721 to the LNA 722, and thus the signal received by the ANT 721 is transferred to the LNA 722. For example, when the ANT 721 transmits the signal, the switching element 710 circuit-connects the ANT 721 to the PA 728, and thus the signal supplied from the PA 728 is transferred to the ANT 721.

The configuration of the switching element 710 will be described in more detail with reference to FIG. 40. Referring to FIG. 40, the switching element 710 has a configuration in which two electronic devices 60 according to the second embodiment are combined. Since the configuration of the electronic device 60 has been described above with reference to FIG. 19, the detailed description will be omitted. In the switching element 710, the connection of the ANT 721 and the LNA 722 and the connection of the ANT 721 and the PA 728 can be switched by turning on one electronic device 60 and turning off the other electronic device 60. The switching of the switching element 710, i.e., the driving of the electronic device 60, may be controlled by a control circuit (not illustrated) installed in the communication device. The control circuit may have the same function as, for example, the control circuit 20 illustrated in FIGS. 4A and 4B.

An example of the configuration of the electronic apparatus in which the electronic device 60 according to the second embodiment is applied as the switching element has been described above with reference to FIGS. 39 and 40. As described above, by applying the electronic device 60 which is the MEMS as the switching element 710, a high isolation property and a high pressure-resistance property are realized compared to a switching element including a general semiconductor device. Accordingly, it is possible to further improve reliability of an operation of the communication apparatus 70. As described above, in the electronic device 60 according to the second embodiment, the sticking is suppressed during the manufacturing process by electrically connecting the fixed member 610 to the movable member 620 by the fuse 630 including the high-resistance portion 631, and the fracture of the fuse 630 is realized by driving the electronic device 60. Accordingly, since it is not necessary to perform a separate process of fracturing the fuse 630, the manufacturing cost of the communication apparatus 70 is reduced.

The case in which the electronic device 60 according to the second embodiment exemplified in FIG. 19 is applied to the electronic apparatus has been described above as one application example, but the application example is not limited to this example. Likewise, the electronic device according to each modification example of the second embodiment described above is also applicable as a switching element of an electronic apparatus. Likewise, the electronic device 10 according to the first embodiment described above and the electronic device according to each modification example of the first embodiment are also applicable to a switching element of an electronic apparatus.

[2-6. Conclusion of Second Embodiment]

In the second embodiment, as described above, the electronic device 60 includes the fixed member 610 which is the first member, the movable member 620 which is the second member, and the fuse 630 electrically connecting the fixed member 610 to the movable member 620. The high-resistance portion 631 with a higher resistance value than the other regions is formed in a partial region of the fuse 630. The resistance value of the high-resistance portion 631 can be adjusted to a sufficient value to electrify both of the fixed member 610 and the movable member 620 so that sticking does not occur between the fixed member 610 and the movable member 620 and to generate a potential difference so that the movable member 620 is moved with respect to the fixed member 610 when a predetermined voltage value is applied between the fixed member 610 and the movable member 620. Accordingly, the electronic device 60 can be driven in the state of the connection with the fuse 630, while suppressing sticking during the manufacturing process. The shape of the fuse 630 is designed so that the fuse 630 can be fractured by driving the electronic device 60. Accordingly, since the fuse 630 can be fractured by performing an operation of operating the normal electronic device 60, for example, in product inspection (for example, an operation test) before shipment, it is not necessary to perform a separate process of fracturing the fuse 630. Thus, according to the second embodiment, the fuse 630 can be fractured more easily and the manufacturing cost of the electronic device 60 can be further reduced.

Here, as described above, in the technologies disclosed in JP 2012-222241A, JP 2006-514786T, JP 2006-221956A, and JP 2005-260398A, it is necessary to separately provide a configuration for fracturing the fuse, such as a vibrator for cutting the fuse or a pad for applying a current at the time of melting of the fuse, inside the electronic device. In the technologies disclosed in JP 2012-222241A, JP 2006-514786T, JP 2006-221956A, and JP 2005-260398A, in order to fracture the fuse, it is necessary to separately prepare dedicated equipment for fracturing the fuse, e.g., power equipment capable of applying a large current or equipment performing etching or dicing, which is not used in a process of manufacturing a general electronic device.

In the embodiment, as described above, in the electronic device 60 according to the second embodiment, the fuse 630 is fractured by driving the electronic device 60. Therefore, it is not necessary to separately provide the configuration for fracturing the fuse inside the electronic device 60. Accordingly, the electronic device 60 can be fabricated in a smaller area. In the second embodiment, since the fuse 630 is embedded between the fixed member 610 and the movable member 620, it is not necessary to ensure a region in which the fuse 630 is formed in a region other than the fixed member 610 and the movable member 620 and the electronic device 60 can be miniaturized further. Thus, the device area of the electronic device 60 is reduced, and thus the manufacturing cost of the electronic device 60 can be reduced further.

In the second embodiment, equipment used in a process of manufacturing a normal electronic device, e.g., equipment for performing an operation test, can be used as equipment for fracturing the fuse 630. Accordingly, it is not necessary to use dedicated equipment for fracturing the fuse, e.g., an etching apparatus or a power apparatus applying a large current, a dicing apparatus, or the like, and thus the manufacturing cost of the electronic device 60 can be reduced further.

Thus, by reducing the manufacturing cost of the electronic device 60, it is consequently possible to reduce the manufacturing cost of a final product such as an electronic apparatus on which the electronic device 60 is mounted. By realizing the miniaturization of the electronic device 60, it is consequently possible to miniaturize a final product such as an electronic apparatus on which the electronic device 60 is mounted.

The second embodiment and each modification example described above may be combined to be applied within the possible scope. By combining and applying the configurations described in the second embodiment and each modification example, it is possible to obtain the advantages obtained in the embodiment and each modification example as well. The second embodiment and each modification example may be combined with the first embodiment and each modification example of the first embodiment within a possible range. Thus, by mutually combining at least one of the first embodiment and the modification examples of the first embodiment and at least one of the second embodiment and the modification examples of the second embodiment, it is possible to obtain the advantages obtained in each embodiment and each modification example as well.

<3. Supplement>

The preferred embodiments of the present disclosure have been described in detail with reference to the appended drawings, but the technical scope of the present disclosure is not limited to the examples. It should be understood by those skilled in the art of the present disclosure that various modifications and alterations may occur within the scope of the technical spirit and essence described in the claims, and the modifications and the alterations are, of course, construed to pertain to the technical scope of the present disclosure.

The advantages described in the present specification are merely explanatory or exemplary, and thus are not limited. That is, in the technology in the present disclosure, other advantages apparent to those skilled in the art can be obtained from the description of the present specification along with the foregoing advantages or instead of the foregoing advantages.

Additionally, the present technology may also be configured as below.

(1) An electronic device including:
- a first member formed to include at least a part of a substrate material;
- a second member formed to include at least a part of the substrate material and configured to be relatively movable with respect to the first member; and
- a fuse configured to include at least a part of the substrate material and configured to electrically connect the first member to the second member via the substrate material.

(2) The electronic device according to (1), wherein the fuse is fractured by applying an outside force to the fuse in a direction perpendicular to an extension direction of the fuse.

(3) The electronic device according to (2), wherein, in a partial region of the fuse, a stress concentration portion is formed to have a smaller width than other regions in a direction in which the outside force is applied.

(4) The electronic device according to (3), wherein the stress concentration portion is a notch formed in a partial region of the fuse.

(5) The electronic device according to any one of (2) to (4), further including:
- a fuse fracture portion configured to fracture the fuse by applying the outside force to the fuse.

(6) The electronic device according to (5), wherein the fuse fracture portion includes a fuse electrode portion which applies a predetermined electrostatic attractive force to the fuse when a predetermined potential difference is supplied between the fuse and the fuse electrode portion.

(7) The electronic device according to (6), wherein a voltage value applied to the fuse electrode portion is changed at a frequency corresponding to a natural frequency of the fuse.

(8) The electronic device according to (6) or (7), wherein, even after the fuse is fractured, a predetermined voltage is applied to the fuse electrode portion, and a fractured end of the fuse is welded to the fuse electrode portion.

(9) The electronic device according to any one of (6) to (8), wherein the fuse fracture portion includes a plurality of the fuse electrode portions, and wherein at least one fuse electrode portion is disposed in a manner that the electrostatic attractive force is applied to a first region of the fuse in a first direction and at least another fuse electrode portion is disposed in a manner that the electrostatic attractive force is applied to a second region different from the first region of the fuse in a second direction which is an opposite direction to the first direction.

(10) The electronic device according to any one of (5) to (9), wherein the fuse fracture portion includes a fracture driving portion which fractures the fuse by pressurizing a partial region of the fuse in a predetermined direction.

(11) The electronic device according to any one of (2) to (10), wherein the fuse is fractured by a bending stress caused by a Lorentz force generated in the fuse by applying a magnetic field to the fuse when a predetermined current is applied to the fuse.

(12) The electronic device according to any one of (1) to (11), wherein the fuse is formed in a manner that a fracture surface of the fuse is parallel to a cleavage surface of the substrate material.

(13) A fuse that is installed between a first member formed to include at least a part of a substrate material and a second member formed to include at least a part of the substrate material and to be relatively movable with respect to the first member, the fuse including:

at least a part of the substrate material, the fuse electrically connecting the first member to the second member via the substrate material.

(14) An electronic apparatus including:

an electronic device including
- a first member formed to include at least a part of a substrate material,
- a second member formed to include at least a part of the substrate material and configured to be relatively movable with respect to the first member, and
- a fuse formed to include at least a part of the substrate material and configured to electrically connect the first member to the second member via the substrate material.

Additionally, the present technology may also be configured as below.

(1) An electronic device including a first member, a second member configured to be moved relatively with respect to the first member when a predetermined potential difference is supplied between the first and second members, and a fuse configured to electrically connect the first member to the second member. In at least a partial region of the fuse, a high-resistance portion with a resistance value causing at least the predetermined potential difference is formed between the first and second members.

(2) The electronic device according to (1), wherein the fuse is fractured by moving the second member relatively with respect to the first member.

(3) The electronic device according to (2), wherein a fracture portion with a lower fracture strength than other regions is formed in at least a partial region of the fuse.

(4) The electronic device according to (3), wherein the fracture portion is formed to have a smaller width than other regions in an extension direction of the fuse.

(5) The electronic device according to (3) or (4), wherein a notch formed in a direction perpendicular to the extension direction of the fuse is formed in a partial region of the fracture portion.

(6) The electronic device according to any one of (1) to (5), wherein a resistance value $R_h$ of the high-resistance portion satisfies a relation of $R_h<V_{pull\text{-}in}/I_{in}$ where $I_{in}$ is a current value corresponding to a charge amount supplied to at least one of the first and second members during a manufacturing process and $V_{pull\text{-}in}$ is a Pull-in voltage of the electronic device.

(7) The electronic device according to any one of (1) to (6), wherein the resistance value of the high-resistance portion is controlled by adjusting an impurity concentration of the high-resistance portion.

(8) The electronic device according to any one of (1) to (7), wherein the resistance value of the high-resistance portion is controlled by adjusting a length of the fuse.

(9) The electronic device according to any one of (1) to (8), wherein a re-contact prevention mechanism fixing the position of the fuse after the fracture to a position different from the position of the fuse before the fracture is formed.

(10) The electronic device according to (9), wherein the re-contact prevention mechanism includes a first occlusion projection formed in at least a partial region of a first surface coming into contact with the first member when the fuse is fractured, and a second occlusion projection formed in at least a partial region of a second surface coming into contact with the first surface when the fuse is fractured. When the fuse is fractured, the first occlusion projection and the second occlusion projection may be fitted.

(11) The electronic device according to (9), wherein the re-contact prevention mechanism includes a plurality of fins formed to be arranged in the extension direction of the fuse and a metal film erected on the plurality of fins.

(12) The electronic device according to (9), wherein the re-contact prevention mechanism has a configuration in which grooves formed on both sides in a direction perpendicular to the extension direction of the fuse are formed such that widths of the grooves have different sizes.

(13) A fuse that is installed between a first member and a second member moved relatively with respect to the first member when a predetermined potential difference is supplied between the first member and the second member and electrically connects the first member to the second member, the fuse including:

in at least a partial region, a high-resistance portion with a resistance value causing at least the predetermined potential difference between the first member and the second member.

(14) An electronic apparatus including:

an electronic device including a first member, a second member configured to be moved relatively with respect to the first member when a predetermined potential difference is supplied between the first member and the second member, and a fuse that electrically connects the first member to the second member and in which a high-resistance portion with a resistance value causing at least the predetermined potential difference is formed between the first member and the second member in at least a partial region.

What is claimed is:

1. A fuse that is installed between a first member disposed in a first region of a substrate that is formed of a substrate material, the first member including at least a part of the substrate material, and a second member disposed in a second region of the substrate, the second member including at least a part of the substrate material, the second member configured to be relatively movable with respect to the first member, the fuse comprising:

at least a part of the substrate material, the fuse electrically connecting the first member to the second member via the substrate material.

2. An electronic apparatus comprising:

an electronic device including a substrate formed of a substrate material;

a first member disposed in a first region of the substrate and including at least a part of the substrate material, a second member disposed in a second region of the substrate and including at least a part of the substrate material, the second member configured to be relatively movable with respect to the first member, and a fuse including at least a part of the substrate material and configured to electrically connect the first member to the second member via the substrate material.

3. An electronic device comprising:

a substrate formed of a substrate material;

a first member disposed in a first region of the substrate and including at least a part of the substrate material;

a second member disposed in a second region of the substrate and including at least a part of the substrate material, the second member configured to be relatively movable with respect to the first member; and a fuse including at least a part of the substrate material and configured to electrically connect the first member to the second member via the substrate material.

4. The electronic device according to claim 3, wherein the fuse is formed in a manner that a fracture surface of the fuse is parallel to a cleavage surface of the substrate material.

5. The electronic device according to claim 3, wherein the fuse is fractured by applying an outside force to the fuse in a direction perpendicular to an extension direction of the fuse.

6. The electronic device according to claim 5, wherein the fuse is fractured by a bending stress caused by a Lorentz force generated in the fuse by applying a magnetic field to the fuse when a predetermined current is applied to the fuse.

7. The electronic device according to claim 5, wherein, in a partial region of the fuse, a stress concentration portion is formed to have a smaller width than other regions in a direction in which the outside force is applied.

8. The electronic device according to claim 7, wherein the stress concentration portion is a notch formed in a partial region of the fuse.

9. The electronic device according to claim 5, further comprising:

a fuse fracture portion configured to fracture the fuse by applying the outside force to the fuse.

10. The electronic device according to claim 9, wherein the fuse fracture portion includes a fracture driving portion which fractures the fuse by pressurizing a partial region of the fuse in a predetermined direction.

11. The electronic device according to claim 9, wherein the fuse fracture portion includes a fuse electrode portion which applies a predetermined electrostatic attractive force to the fuse when a predetermined potential difference is supplied between the fuse and the fuse electrode portion.

12. The electronic device according to claim 11, wherein a voltage value applied to the fuse electrode portion is changed at a frequency corresponding to a natural frequency of the fuse.

13. The electronic device according to claim 11, wherein, even after the fuse is fractured, a predetermined voltage is applied to the fuse electrode portion, and a fractured end of the fuse is welded to the fuse electrode portion.

14. The electronic device according to claim 11, wherein the fuse fracture portion includes a plurality of the fuse electrode portions, and wherein at least one fuse electrode portion is disposed in a manner that the electrostatic attractive force is applied to a first region of the fuse in a first direction and at least another fuse electrode portion is disposed in a manner that the electrostatic attractive force is applied to a second region different from the first region of the fuse in a second direction which is an opposite direction to the first direction.

15. A fuse that is installed between a first member and a second member moved relatively with respect to the first member when a predetermined potential difference is supplied between the first member and the second member and electrically connects the first member to the second member, the fuse comprising:

in at least a partial region, a high-resistance portion with a resistance value causing at least the predetermined potential difference between the first member and the second member, wherein the fuse is fractured by moving the second member relatively with respect to the first member, and wherein a resistance value $R_h$ of the high-resistance portion satisfies a relation of $R_h<V_{pull\text{-}in}/I_{in}$ where $I_{in}$; is a current value corresponding to a charge amount supplied to at least one of the first member and the second member during a manufacturing process and $V_{pull\text{-}in}$ is a pull-in voltage of an electronic device comprising the fuse.

16. An electronic apparatus comprising:

an electronic device including a first member, a second member configured to be moved relatively with respect to the first member when a predetermined potential difference is supplied between the first member and the second member, and a fuse that electrically connects the first member to the second member and in which a high-resistance portion with a resistance value causing at least the predetermined potential difference is formed between the first member and the second member in at least a partial region, wherein, in at least a partial region of the fuse, a high-resistance portion with a resistance value causing at least the predetermined potential difference is formed between the first member and the second member, wherein the fuse is fractured by moving the second member relatively with respect to the first member, and wherein a resistance value $R_h$ of the high-resistance portion satisfies a relation of $R_h<V_{pull\text{-}in}/I_{in}$ where $I_{in}$; is a current value corresponding to a charge amount supplied to at least one of the first member and the second member during a manufacturing process and $V_{pull\text{-}in}$ is a pull in voltage of the electronic device.

17. An electronic device comprising:

a first member;

a second member configured to be moved relatively with respect to the first member when a predetermined potential difference is supplied between the first member and the second member; and a fuse configured to electrically connect the first member to the second member, wherein, in at least a partial region of the fuse, a high-resistance portion with a resistance value causing at least the predetermined potential difference is formed between the first member and the second member, wherein the fuse is fractured by moving the second member relatively with respect to the first member, and wherein a resistance value $R_h$ of the high-resistance portion satisfies a relation of $R_h<V_{pull\text{-}in}/I_{in}$ where $I_{in}$; is a current value corresponding to a charge amount supplied to at least one of the first member and the second member during a manufacturing process and $V_{pull\text{-}in}$ is a pull-in voltage of the electronic device.

18. The electronic device according to claim 17, wherein a fracture portion with a lower fracture strength than other regions is formed in at least a partial region of the fuse.

* * * * *